US007406272B2

(12) United States Patent
Nishiyama et al.

(10) Patent No.: US 7,406,272 B2
(45) Date of Patent: Jul. 29, 2008

(54) IMAGE FORMING APPARATUS AND SYSTEM WITH ATTACHABLE AND DETACHABLE DEVELOPER CONTAINER

(75) Inventors: Kazuhiro Nishiyama, Nagano-ken (JP); Minoru Kishigami, Nagano-ken (JP); Katsumi Okamoto, Nagano-ken (JP); Masaharu Inui, Nagano-ken (JP)

(73) Assignee: Seiko Epson Corporation, Tokyo (JP)

( * ) Notice: Subject to any disclaimer, the term of this patent is extended or adjusted under 35 U.S.C. 154(b) by 395 days.

(21) Appl. No.: 11/179,026

(22) Filed: Jul. 11, 2005

(65) Prior Publication Data

US 2006/0013598 A1 Jan. 19, 2006

(30) Foreign Application Priority Data

Jul. 12, 2004 (JP) ..... 2004-204820
Jul. 12, 2004 (JP) ..... 2004-204821
Jan. 27, 2005 (JP) ..... 2005-019971

(51) Int. Cl.
*G03G 15/00* (2006.01)

(52) U.S. Cl. ..... 399/12; 399/227

(58) Field of Classification Search ..... 399/12, 399/119, 223, 227, 228
See application file for complete search history.

(56) References Cited

U.S. PATENT DOCUMENTS 4,868,606 A * 9/1989 Miyamoto et al. ..... 399/157
5,014,094 A * 5/1991 Amitani et al. ..... 399/12
6,029,018 A * 2/2000 Rogers et al. ..... 399/12
6,061,535 A * 5/2000 Yokomori et al. ..... 399/61
6,151,459 A 11/2000 Hashimoto et al.
6,889,024 B2 * 5/2005 Shiraki et al. ..... 399/227
7,171,131 B2 * 1/2007 Maruyama et al. ..... 399/12
7,236,725 B2 * 6/2007 Inukai et al. ..... 399/223
2002/0085857 A1 7/2002 Kim et al.
2005/0163515 A1 * 7/2005 Inukai ..... 399/12

FOREIGN PATENT DOCUMENTS

JP 02135381 A * 5/1990
JP 02-181766 7/1990
JP 02203358 A * 8/1990
JP 09166952 A * 6/1997
JP 2000-075659 3/2000
JP 2002-351190 12/2002
JP 2002-358748 12/2002
JP 2003-015409 1/2003
JP 2003050495 A * 2/2003
JP 2003-131471 5/2003
JP 2003-241495 8/2003
JP 2003-316106 11/2003
JP 2004-004466 1/2004

* cited by examiner

*Primary Examiner*—Robert Beatty
(74) *Attorney, Agent, or Firm*—Hogan & Hartson LLP

(57) ABSTRACT

An image forming apparatus includes: an image bearing body for bearing a latent image; a plurality of attach/detach sections to each of which a developer container for containing developer used for developing the latent image can be attached; and a container attachment mechanism for allowing a developer container containing developer of a certain color to be attached to any of the plurality of attach/detach sections, and a developer container containing developer of a color other than the certain color to be attached only to a predetermined attach/detach section of among the plurality of attach/detach sections.

11 Claims, 43 Drawing Sheets

IMAGE FORMING APPARATUS AND SYSTEM WITH ATTACHABLE AND DETACHABLE DEVELOPER CONTAINER

CROSS-REFERENCE TO RELATED APPLICATIONS

The present application claims priority upon Japanese Patent Application No. 2004-204820 filed on Jul. 12, 2004, Japanese Patent Application No. 2004-204821 filed on Jul. 12, 2004, and Japanese Patent Application No. 2005-019971 filed on Jan. 27, 2005, which are herein incorporated by reference.

BACKGROUND OF THE INVENTION

1. Field of the Invention

The present invention relates to image forming apparatuses and image forming systems.

2. Description of the Related Art (1) Printers having, for example, an image bearing body for bearing a latent image, and a plurality of attach/detach sections to each of which a developer container for containing developer used for developing the latent image can be attached, are known as image forming apparatuses. (See, for example, JP 2003-15409A and JP 2004-4466A.)

In this type of printer, a plurality of developer containers, each containing developer of a color different from one another, are attached to each of the attach/detach sections to form color images. Further, from the viewpoint of forming a large number of monochrome images, the above-mentioned printer may form monochrome images by allowing developer containers, each containing developer of the same certain color, to be attached to all of the plurality of attach/detach sections. It should be noted that, from the viewpoint of keeping the color-image quality high, it is preferable to attach each of the developer containers that contain the developer other than the single-color developer only to a predetermined one of the attach/detach sections.

In order to achieve this, there has been a demand for an image forming apparatus that allows, with ease and without giving rise to attachment errors, the developer container containing the single-color developer to be attached to any of the plurality of attach/detach sections, and each of the developer containers containing developer of a color other than the certain color to be attached only to a predetermined attach/detach section.

(2) Also known as image forming apparatuses are printers having, for example, an image bearing body for bearing a latent image, and an attach/detach section to which a developer container for containing developer used for developing the latent image can be attached. In this printer, the developer container is attached to the attach/detach section with a portion thereof covered by a lid unit. (See, for example, JP 2003-131471A.)

In this type of printer, there are cases in which the developer container is colored to have the same color as that of the developer contained therein, from the viewpoint of letting a user etc. distinguish the color of the developer contained in the developer container. Further, there are cases in which the front face of the lid unit is colored from the viewpoint of allowing a proper developer container to be attached to the attach/detach section.

In such cases, if the color of the lid unit is the same as that of the developer container at a boundary section between the lid unit and the developer container, then there is a possibility that the user etc. may incorrectly recognize the lid unit as a part of the developer container and may try to detach the developer container in a state where the lid unit is still covering a portion of the developer container. This may cause damages in the lid unit etc. when trying to detach the developer container from the attach/detach section.

(3) Also known as image forming apparatuses are printers having, for example, an image bearing body for bearing a latent image, and a plurality of attach/detach sections to each of which a developer container for containing developer used for developing the latent image can be attached. Such printers are capable of forming images using a plurality of types of developer (See, for example, JP 2003-15409A and JP 2004-4466A.)

Such printers are capable of handling a plurality of types of developer. However, in cases where the developer that can be used is determined in advance due to specifications of the printer etc. or in cases where a plurality of colors of developer are used when forming color images, the attach/detach section to which each of the developer containers containing the respective colors of developer can be attached is fixed in advance. In view of the above, there has been a demand for an image forming apparatus that allows a developer container containing a suitable developer to be easily attached to the attach/detach section.

SUMMARY OF THE INVENTION

The present invention has been made in view of the above and other issues.

(1) An object of the present invention is to achieve a user-friendly image forming apparatus that allows a developer container to be attached to an attach/detach section easily and without giving rise to attachment errors.

(2) Another object of the present invention is to achieve an image forming apparatus that allows a developer container to be properly detached from an attach/detach section.

(3) Another object of the present invention is to achieve a user-friendly image forming apparatus and image forming system that allow a developer container to be attached to an attach/detach section easily and without giving rise to attachment errors.

(1) An aspect of the present invention is an image forming apparatus comprising: an image bearing body for bearing a latent image; a plurality of attach/detach sections to each of which a developer container for containing developer used for developing the latent image can be attached; and a container attachment mechanism for allowing a developer container containing developer of a certain color to be attached to any of the plurality of attach/detach sections, and a developer container containing developer of a color other than the certain color to be attached only to a predetermined attach/detach section of among the plurality of attach/detach sections.

(2) Another aspect of the present invention is an image forming apparatus comprising: an image bearing body for bearing a latent image; an attach/detach section to which a developer container for containing developer used for developing the latent image can be attached; and a lid unit that covers a portion of the developer container attached to the attach/detach section and whose color is different from a color of the developer container at a boundary section between the lid unit and the developer container.

(3) Another aspect of the present invention is an image forming apparatus comprising: (a) an image bearing body for bearing a latent image; (b) an attach/detach section to which a developer container for containing developer used for developing the latent image can be attached; and (c) a lid body that is connected to the attach/detach section in a turnable fashion about a turn axis, the lid body being provided with engaging sections for engaging with the developer container, at least one of the engaging sections being provided on a side closer to the turn axis and at least one of the engaging section being provided on a side farther from the turn axis, the lid body being able to close the attach/detach section when a developer container that should be attached is attached to the attach/detach section due to all of the engaging sections being engaged with the developer container, whereas the lid body being unable to close the attach/detach section when a developer container that should not be attached is attached to the attach/detach section due to one of the engaging sections not being engaged with the developer container.

Features and objects of the present invention other than the above will become clear by reading the description of the present specification with reference to the accompanying drawings.

BRIEF DESCRIPTION OF THE DRAWINGS

In order to facilitate further understanding of the present invention and the advantages thereof, reference is now made to the following description taken in conjunction with the accompanying drawings wherein.

DETAILED DESCRIPTION OF THE INVENTION

Figure 1:
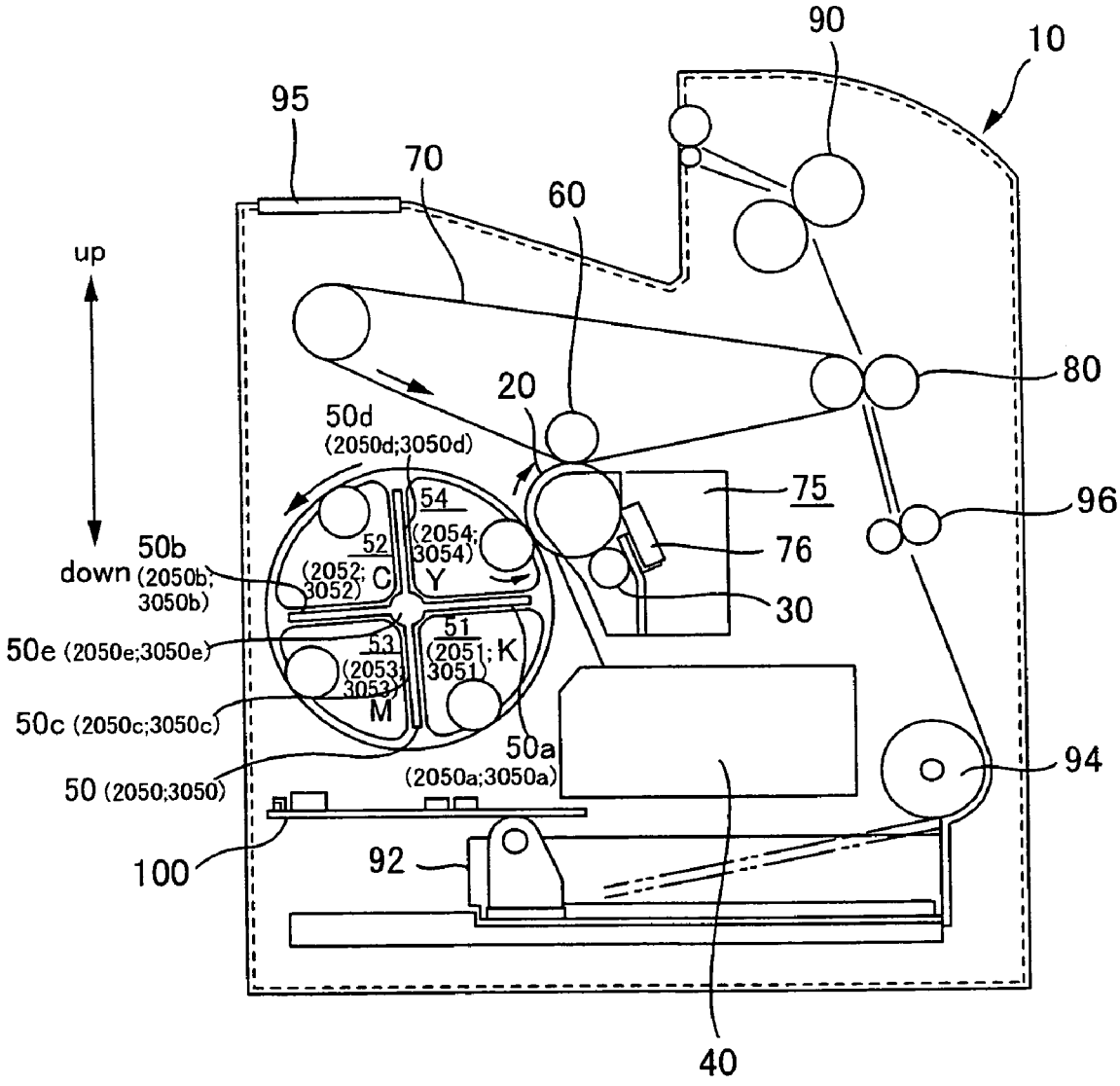
FIG. 1 is a diagram showing the main structural components for when a printer 10 is used as a color printer.

At least the following matters will be made clear by the description below with reference to the accompanying drawings.

(1) An image forming apparatus of a first aspect comprises: an image bearing body for bearing a latent image; a plurality of attach/detach sections to each of which a developer container for containing developer used for developing the latent image can be attached; and a container attachment mechanism for allowing a developer container containing developer of a certain color to be attached to any of the plurality of attach/detach sections, and a developer container containing developer of a color other than the certain color to be attached only to a predetermined attach/detach section of among the plurality of attach/detach sections.

With this image forming apparatus, a user etc. can attach the developer containers to the attach/detach sections using the container attachment mechanism with ease and without attachment errors. Therefore, it becomes possible to achieve a user-friendly image forming apparatus.

In this image forming apparatus, the container attachment mechanism may include a plurality of openable/closable lid units, each of the lid units being connected to a respective one of the plurality of attach/detach sections and allowing the developer container to be attached to the attach/detach section by being closed; and the lid unit may close when the developer container containing the developer of the certain color is inserted into any of the plurality of attach/detach sections, whereas the lid unit may close only when the developer container containing the developer of the color other than the certain color is inserted into the predetermined attach/detach section of among the plurality of attach/detach sections.

In this way, it is possible to confirm whether the developer container has been attached to the proper attach/detach section by checking whether the lid unit closes or not. Therefore, it is possible to achieve an image forming apparatus that is even more user friendly.

In this image forming apparatus, each of the developer container containing the developer of the certain color and developer containers that each contains developer of a color other than the certain color and different among each developer container, may be provided with a projecting section; the lid units connected to each of the plurality of attach/detach sections may have a cut-out section for preventing the projecting section from interfering with that lid unit so that that lid unit will close; and the lid unit may close when the developer container containing the developer of the certain color is inserted into any of the plurality of attach/detach sections due to the cut-out section preventing the interference, whereas the lid unit may close only when the developer container containing the developer of the color other than the certain color is inserted into the predetermined attach/detach section of among the plurality of attach/detach sections due to the cut-out section preventing the interference.

In this way, it is possible to achieve a user-friendly image forming apparatus through a simple structure.

In this image forming apparatus, the plurality of attach/detach sections may include attach/detach sections corresponding respectively to the developer containers each containing the developer of the respective colors other than the certain color; the position of the projecting section provided on each of the developer containers may be different among the developer container containing the developer of the certain color and the developer containers each containing the developer of the respective colors other than the certain color; all of the lid units connected to the plurality of attach/detach sections each may have a first cut-out section for preventing the projecting section provided on the developer container containing the developer of the certain color from interfering with that lid unit; and the lid units connected to the attach/detach sections corresponding to the developer containers each containing the developer of the respective colors other than the certain color each may have a second cut-out section for preventing the projecting section provided on each of those developer containers from interfering with that lid unit.

In this way, it becomes possible to allow the developer container containing the developer of the certain color to be attached to any of the attach/detach sections more reliably, and allow the developer containers each containing the developer of the respective colors other than the certain color to be attached only to the predetermined attach/detach sections more reliably.

In this image forming apparatus, each of the developer containers each containing the developer of the respective colors other than the certain color may have a second projecting section at a same position as the projecting section provided on the developer container containing the developer of the certain color.

In this way, the distance between the second projecting section, which is arranged at the same position as the other second projecting sections, and the projecting section, which is arranged at a different position from the other projecting sections, differs among the developer containers. Therefore, it becomes possible to effectively prevent the developer containers from being erroneously attached, even when the lid unit is out of position when being closed.

In this image forming apparatus, each of the lid units may have a connecting section that is connected to the attach/detach section, and may be openable/closable taking the connecting section as an axis; and a distance between the connecting section and the first cut-out section may be larger than a distance between the connecting section and the second cut-out section.

If a developer container containing developer of a color other than the certain color is erroneously inserted to an attach/detach section, then the projecting section will interfere with the lid unit. If the user tries to close the lid unit in a state where the projecting section is interfering with the lid unit, a load will be applied to the connecting section. If this load is large, then the lid unit may break. Therefore, it is preferable to reduce the load applied to the connecting section in case of insertion error. By making the distance between the connecting section and the first cut-out section larger than the distance between the connecting section and the second cut-out section, it becomes possible to reduce the load applied to the connecting section in case of insertion error, compared to the converse case.

In this image forming apparatus, the lid unit may engage with and is fastened to the developer container at a fastening position when closed; and a distance between the fastening position and the first cut-out section may be smaller than a distance between the fastening position and the second cut-out section.

If the developer container is erroneously inserted to the attach/detach section, the projecting section will interfere with the lid unit and a gap will be created between the lid unit and the side wall. The size of the gap is larger when the distance between the fastening position and the first cut-out section is smaller than the distance between the fastening position and the second cut-out section, compared to the converse case. This is because the lid unit elastically deforms when the projecting section interferes with the lid unit, and the amount of deformation becomes larger the farther the fastening position is from the position of interference. Therefore, it becomes possible to effectively prevent the lid unit from being erroneously fastened to the side wall in cases where the gap is large, that is, in cases where the distance between the fastening position and the first cut-out section is smaller than the distance between the fastening position and the second cut-out section.

In this image forming apparatus, the developer container may be a developing device provided with a developer bearing body for bearing the developer used for developing the latent image borne on the image bearing body.

A developing device is detached when the amount of contained developer becomes small and/or when the developer bearing body has worn out, for example. Therefore, the frequency of attaching the developer container is higher for when the developer container is a developing device. In such cases, the possibility that a user tries to detach the developing device while it is still covered by the lid unit will increase. Therefore, the effect that it is possible to achieve a user-friendly image forming apparatus, can be attained more advantageously.

In this image forming apparatus, the developer of the certain color may be black developer.

The frequency of forming monochrome images using black developer is high. Therefore, by allowing developer containers containing black developer to be attached to all of the attach/detach sections, it becomes possible to form a large number of monochrome images, and thus achieve an image forming apparatus that is even more user friendly.

It is also possible to achieve an image forming apparatus comprising: an image bearing body for bearing a latent image; a plurality of attach/detach sections to each of which a developer container for containing developer used for developing the latent image can be attached; and a container attachment mechanism for allowing a developer container containing developer of a certain color to be attached to any of the plurality of attach/detach sections, and a developer container containing developer of a color other than the certain color to be attached only to a predetermined attach/detach section of among the plurality of attach/detach sections; wherein the container attachment mechanism includes a plurality of openable/closable lid units, each of the lid units being connected to a respective one of the plurality of attach/detach sections and allowing the developer container to be attached to the attach/detach section by being closed; the lid unit closes when the developer container containing the developer of the certain color is inserted into any of the plurality of attach/detach sections, whereas the lid unit closes only when the developer container containing the developer of the color other than the certain color is inserted into the predetermined attach/detach section of among the plurality of attach/detach sections; each of the developer container containing the developer of the certain color and developer containers that each contains developer of a color other than the certain color and different among each developer container, is provided with a projecting section; the lid units connected to each of the plurality of attach/detach sections has a cut-out section for preventing the projecting section from interfering with that lid unit so that that lid unit will close; the lid unit closes when the developer container containing the developer of the certain color is inserted into any of the plurality of attach/detach sections due to the cut-out section preventing the interference, whereas the lid unit closes only when the developer container containing the developer of the color other than the certain color is inserted into the predetermined attach/detach section of among the plurality of attach/detach sections due to the cut-out section preventing the interference; the plurality of attach/detach sections include attach/detach sections corresponding respectively to the developer containers each containing the developer of the respective colors other than the certain color; the position of the projecting section provided on each of the developer containers is different among the developer container containing the developer of the certain color and the developer containers each containing the developer of the respective colors other than the certain color; all of the lid units connected to the plurality of attach/detach sections each has a first cut-out section for preventing the projecting section provided on the developer container containing the developer of the certain color from interfering with that lid unit; the lid units connected to the attach/detach sections corresponding to the developer containers each containing the developer of the respective colors other than the certain color each has a second cut-out section for preventing the projecting section provided on each of those developer containers from interfering with that lid unit; each of the developer containers each containing the developer of the respective colors other than the certain color has a second projecting section at a same position as the projecting section provided on the developer container containing the developer of the certain color; each of the lid units has a connecting section that is connected to the attach/detach section, and is openable/closable taking the connecting section as an axis; a distance between the connecting section and the first cut-out section is larger than a distance between the connecting section and the second cut-out section; the lid unit engages with and is fastened to the developer container at a fastening position when closed; a distance between the fastening position and the first cut-out section is smaller than a distance between the fastening position and the second cut-out section; the developer container is a developing device provided with a developer bearing body for bearing the developer used for developing the latent image borne on the image bearing body; and the developer of the certain color is black developer.

With this image forming apparatus, the effect of achieving a convenient image forming apparatus is attained most effectively.

It is also possible to achieve an image forming system comprising: a computer; and an image forming apparatus that is connectable to the computer and that includes: an image bearing body for bearing a latent image; a plurality of attach/detach sections to each of which a developer container for containing developer used for developing the latent image can be attached; and a container attachment mechanism for allowing a developer container containing developer of a certain color to be attached to any of the plurality of attach/detach sections, and a developer container containing developer of a color other than the certain color to be attached only to a predetermined attach/detach section of among the plurality of attach/detach sections.

Such an image forming system is provided with a convenient image forming apparatus. Therefore, it becomes possible to achieve an image forming system that is superior to conventional systems.

(2) An image forming apparatus of a second aspect comprises: an image bearing body for bearing a latent image; an attach/detach section to which a developer container for containing developer used for developing the latent image can be attached; and a lid unit that covers a portion of the developer container attached to the attach/detach section and whose color is different from a color of the developer container at a boundary section between the lid unit and the developer container.

With this image forming apparatus, a user etc. can distinguish the lid unit from the developer container, and thus, it is possible to prevent the developer container from being detached from the attach/detach section when it is still covered by the lid unit. Therefore, it becomes possible to achieve an image forming apparatus that allows a developer container to be properly detached from an attach/detach section.

In this image forming apparatus, the lid unit may cover a portion of a side wall of the developer container attached to the attach/detach section, and the color of the lid unit may be different from a color of the side wall at a boundary section between the lid unit and the side wall.

Often, a color is applied to the side wall, from the viewpoint of letting a user etc. distinguish the developer contained in the developer container. Further, there are cases in which the front face of the lid unit covering the side wall of the developer container is also colored. In such cases, if the color of the lid unit is the same as that of the side wall at a boundary section between the lid unit and the side wall, then there is a possibility that the user etc. may incorrectly recognize the lid unit as a part of the side wall and may try to detach the developer container in a state where the lid unit is still covering the developer container. In such cases, the possibility of the lid unit being damaged becomes high. On the other hand, if the color of the lid unit is different from the color of the side wall at a boundary section between the lid unit and the side wall, the user etc. will be able to distinguish the lid unit from the side wall, and can therefore detach the developer container from the attach/detach section properly.

In this image forming apparatus, the side wall may be provided with a handle; and the portion of the side wall covered by the lid unit may be a portion other than the handle.

If the handle is covered by the lid unit, the user etc. will think that it is necessary to open the lid unit in order to detach the developer container. On the other hand, if the handle is not covered by the lid unit, then the user etc. may incorrectly recognize that the developer container can be detached even when the lid unit is closed. In such cases, the possibility of the lid unit being damaged becomes high. Therefore, the effect that it is possible to achieve an image forming apparatus that allows a developer container to be properly detached from an attach/detach section, can be attained more advantageously in cases where the portion of the side wall covered by the lid unit is a portion other than the handle.

In this image forming apparatus, the lid unit may have a lid member that covers the portion of the sidewall, the lid member having a connecting section that is connected to the attach/detach section and being openable/closable taking the connecting section as an axis; the boundary section may be a portion of the lid member; and a color of the lid member may be different from the color of the side wall.

In this way, it is easy to distinguish the lid member from the side wall. Therefore, in cases where the color of the lid member is different from the color of the side wall, it becomes possible to prevent, more effectively, the developer container from being detached when a portion of the side wall is still covered by the lid unit.

In this image forming apparatus, a member having a same color as the color of the side wall may be supported on a back side of the lid member.

In this way, the user etc. can see the member having the same color as the side wall when the lid member is opened. Therefore, it becomes possible to let the user etc. know the appropriate developer container that should be attached to the attach/detach section.

In this image forming apparatus, the lid unit may have a holding member for holding the lid member in a closed state; and the holding member may be the member having the same color as the color of the side wall.

In this way, it becomes possible to let the user know the developer container that should be attached to the attach/detach section by the color of the holding member, and therefore, it becomes possible to achieve an image forming apparatus that is convenient for the user etc.

In this image forming apparatus, the lid unit may have an operation member that is connected to the holding member for operating the holding member.

In this case, the closed lid member needs to be opened using the operation member in order to detach the developer container from the attach/detach section. If the user etc. tries to detach the developer container in a state where the side wall is still covered by the lid unit, then the holding member and/or the lid member may break. Therefore, the effect that it is possible to achieve an image forming apparatus that allows a developer container to be properly detached from an attach/detach section, can be attained more advantageously in cases where an operation member is provided.

In this image forming apparatus, a color of the operation member may be different from the color of the side wall.

In this way, the user etc. can distinguish the operation member from the side wall. Therefore, it becomes possible to prevent, more effectively, the developer container from being detached in a state where a portion of the side wall is still covered by the lid unit.

In this image forming apparatus, there may be a plurality of attach/detach sections.

In this case, the frequency at which the developer container is detached in a state where it is still covered by the lid unit increases, and therefore, the possibility that the lid unit etc. will break also becomes high. Therefore, the effect that it is possible to achieve an image forming apparatus that allows a developer container to be properly detached from an attach/detach section, can be attained more advantageously in cases where there are a plurality of attach/detach sections.

In this image forming apparatus, the developer container may be a developing device provided with a developer bearing body for bearing the developer used for developing the latent image borne on the image bearing body.

A developing device is detached when the amount of contained developer becomes small and/or when the developer bearing body has worn out, for example. Therefore, the frequency of detaching the developer container is higher for when the developer container is a developing device, and thus, the possibility of the lid unit etc. being damaged also becomes high. Therefore, the effect that it is possible to achieve an image forming apparatus that allows a developer container to be properly detached from an attach/detach section, can be attained more advantageously in cases where the developer container is a developing device.

It is also possible to achieve an image forming apparatus comprising: an image bearing body for bearing a latent image; an attach/detach section to which a developer container for containing developer used for developing the latent image can be attached; and a lid unit that covers a portion of the developer container attached to the attach/detach section and whose color is different from a color of the developer container at a boundary section between the lid unit and the developer container; wherein the lid unit covers a portion of a side wall of the developer container attached to the attach/ detach section, and the color of the lid unit is different from a color of the side wall at a boundary section between the lid unit and the side wall; the side wall is provided with a handle; the portion of the side wall covered by the lid unit is a portion other than the handle; the lid unit has a lid member that covers the portion of the side wall, the lid member having a connecting section that is connected to the attach/detach section and being openable/closable taking the connecting section as an axis; the boundary section is a portion of the lid member; a color of the lid member is different from the color of the side wall; a member having a same color as the color of the side wall is supported on a back side of the lid member; the lid unit has a holding member for holding the lid member in a closed state; the holding member is the member having the same color as the color of the side wall; the lid unit has an operation member that is connected to the holding member for operating the holding member; a color of the operation member is different from the color of the side wall; there are a plurality of attach/detach sections; and the developer container is a developing device provided with a developer bearing body for bearing the developer used for developing the latent image borne on the image bearing body.

With this image forming apparatus, the effect of being able to achieve an image forming apparatus that allows a developer container to be properly detached from an attach/detach section is attained most effectively.

It is also possible to achieve an image forming system comprising: a computer; and an image forming apparatus that is connectable to the computer and that includes: an image bearing body for bearing a latent image; an attach/detach section to which a developer container for containing developer used for developing the latent image can be attached; and a lid unit that covers a portion of the developer container attached to the attach/detach section and whose color is different from a color of the developer container at a boundary section between the lid unit and the developer container.

Such an image forming system is provided with an image forming apparatus that allows a developer container to be properly detached from an attach/detach section. Therefore, it becomes possible to achieve an image forming system that is superior to conventional systems.

(3) An image forming apparatus of a third aspect comprises: (a) an image bearing body for bearing a latent image; (b) an attach/detach section to which a developer container for containing developer used for developing the latent image can be attached; and (c) a lid body that is connected to the attach/detach section in a turnable fashion about a turn axis, the lid body being provided with engaging sections for engaging with the developer container, at least one of the engaging sections being provided on a side closer to the turn axis and at least one of the engaging section being provided on a side farther from the turn axis, the lid body being able to close the attach/detach section when a developer container that should be attached is attached to the attach/detach section due to all of the engaging sections being engaged with the developer container, whereas the lid body being unable to close the attach/detach section when a developer container that should not be attached is attached to the attach/detach section due to one of the engaging sections not being engaged with the developer container.

With this image forming apparatus, the lid body will be able to close the attach/detach section when a developer container that should be attached is attached to the attach/detach section, and the lid body will not be able to close the attach/detach section when a developer container that should not be attached is attached to the attach/detach section; therefore, the user etc. can attach the developer container that should be attached to the attach/detach section through the simple operation of attaching the developer container to the attach/detach section and closing the lid body, that is, just by attaching the developer container. Further, even if the wrong developer container is inserted into the attach/detach section, it is possible to acknowledge that the inserted developer container is a developer container that should not be attached to that attach/detach section when the lid body cannot be closed. Therefore, it becomes possible to prevent the wrong developer container from being attached, and thus achieve a user-friendly image forming apparatus. Further, at least one engaging section for preventing attachment errors is provided respectively on the side closer to and on the side farther from the turn axis where the lid body turns. Since attachment errors are prevented using two engaging sections, it is possible to prevent attachment errors more reliably.

In this image forming apparatus, it is preferable that a timing at which the at least one engaging section on the closer side starts engaging with the developer container is different from a timing at which the at least one engaging section on the farther side starts engaging with the developer container.

With this image forming apparatus, by letting the at least one engaging section respectively provided on the closer and farther sides engage with the developer container at different timings, the engaging sections and the developer container can easily engage because the two engaging sections do not engage simultaneously. Therefore, when the developer container that should be attached is attached to the attach/detach section, the user can easily close the lid body without expending due care. Further, if a developer container that should not be attached has been attached, then the user can easily recognize that the lid body cannot close the attach/detach section, and thus it is possible to prevent attachment errors more reliably.

In this image forming apparatus, it is preferable that, of among the at least one engaging section on the closer side and the at least one engaging section on the farther side, the engaging section that engages with the developer container first restricts a behavior of the lid body when the other engaging section engages with the developer container afterward.

With this image forming apparatus, of among the at least one engaging section respectively provided on the closer and farther sides, one of the engaging sections engages with the developer container first and restricts the behavior of the lid body, and therefore, the other engaging section that engages with the developer container afterwards can easily engage therewith due to the stable behavior of the lid body.

In this image forming apparatus, it is preferable that the at least one engaging section on the closer side and the at least one engaging section on the farther side are aligned in a direction that intersects with the turn axis.

With this image forming apparatus, the at least one engaging sections respectively provided on the closer and farther sides are aligned in a direction that intersects with the turn axis, and therefore, the two engaging sections are arranged substantially on a straight line that extends from the side closer to the turn axis to the farther side. Therefore, even if the surface of the lid body is twisted with respect to the turn axis and moves in a swaying manner as the lid body is turned, by the engagement of one of the engaging sections, the other engaging section that is arranged substantially on the same line is kept in a stable position, and thus, it becomes possible to close the lid body easily.

In this image forming apparatus, it is preferable that the developer container has at least two shaped information sections that indicate information about that developer container with a predetermined outer shape; and the engaging sections engage with the shaped information sections.

With this image forming apparatus, the engaging sections of the lid body engage with the shaped information sections that are provided on the developer container and that indicate information about the developer container using predetermined outer shapes. Thus, by the engagement of the engaging sections of the lid body and the shaped information sections of the developer container, the developer container indicating information that suits the attach/detach section by means of the shaped information sections can be attached to that attach/detach section.

In this image forming apparatus, it is preferable that a piece of information about the developer container is distinguishable by the at least one engaging section on the closer side and the at least one engaging section on the farther side respectively engaging with the at least two shaped information sections.

With this image forming apparatus, a piece of information is distinguished by the engagement of the two engaging sections and the two shaped information sections. Therefore, it is possible to distinguish the information more correctly compared to a case employing a single engaging section and a single shaped information section.

In this image forming apparatus, a piece of information about the developer container may be distinguishable by one of the at least one engaging section on the closer side and the at least one engaging section on the farther side engaging with one of the at least two shaped information sections.

With this image forming apparatus, since a piece of information is distinguished by the engagement of a single engaging section and a single shaped information section, it is possible to distinguish many pieces of information.

In this image forming apparatus, it is preferable that the information is information indicative of a color of the developer contained in the developer container.

With this image forming apparatus, it is possible to reliably attach a developer container containing developer of a color that should be attached to the attach/detach section.

In this image forming apparatus, the information may be information indicative of a destination of the developer contained in the developer container.

With this image forming apparatus, it is possible to reliably attach a developer container containing developer that suits the destination of the image forming apparatus.

In this image forming apparatus, it is preferable that there are a plurality of attach/detach sections; and the lid body is provided for each of the attach/detach sections.

With this image forming apparatus, it is possible to reliably attach developer containers that should be attached respectively to the plurality of attach/detach sections.

It is also possible to achieve an image forming apparatus comprising: (a) an image bearing body for bearing a latent image; (b) an attach/detach section to which a developer container for containing developer used for developing the latent image can be attached; and (c) a lid body that is connected to the attach/detach section in a turnable fashion about a turn axis, the lid body being provided with engaging sections for engaging with the developer container, at least one of the engaging sections being provided on a side closer to the turn axis and at least one of the engaging section being provided on a side farther from the turn axis, the lid body being able to close the attach/detach section when a developer container that should be attached is attached to the attach/detach section due to all of the engaging sections being engaged with the developer container, whereas the lid body being unable to close the attach/detach section when a developer container that should not be attached is attached to the attach/detach section due to one of the engaging sections not being engaged with the developer container; wherein the at least one engaging section on the closer side and the at least one engaging section on the farther side are arranged in a direction that intersects with the turn axis; a timing at which the at least one engaging section on the closer side starts engaging with the developer container is different from a timing at which the at least one engaging section on the farther side starts engaging with the developer container; of among the at least one engaging section on the closer side and the at least one engaging section on the farther side, the engaging section that engages with the developer container first restricts a behavior of the lid body when the other engaging section engages with the developer container afterward; the developer container has at least two shaped information sections that indicate information about that developer container with a predetermined outer shape; the engaging sections engage with the shaped information sections; a piece of information about the developer container is distinguishable by the at least one engaging section on the closer side and the at least one engaging section on the farther side respectively engaging with the at least two shaped information sections; a piece of information about the developer container is distinguishable by one of the at least one engaging section on the closer side and the at least one engaging section on the farther side engaging with one of the at least two shaped information sections; the information is information indicative of a color of the developer contained in the developer container; the information is information indicative of a destination of the developer contained in the developer container; there are a plurality of attach/detach sections; and the lid body is provided for each of the attach/detach sections.

With this image forming apparatus, the effect of achieving a convenient image forming apparatus is attained most effectively.

It is also possible to achieve an image forming system comprising: (A) a computer; and (B) an image forming apparatus that is connectable to the computer and that includes the following elements (a) through (c): (a) an image bearing body for bearing a latent image; (b) an attach/detach section to which a developer container for containing developer used for developing the latent image can be attached; and (c) a lid body that is connected to the attach/detach section in a turnable fashion about a turn axis, the lid body being provided with engaging sections for engaging with the developer container, at least one of the engaging sections being provided on a side closer to the turn axis and at least one of the engaging section being provided on a side farther from the turn axis, the lid body being able to close the attach/detach section when a developer container that should be attached is attached to the attach/detach section due to all of the engaging sections being engaged with the developer container, whereas the lid body being unable to close the attach/detach section when a developer container that should not be attached is attached to the attach/detach section due to one of the engaging sections not being engaged with the developer container.

Such an image forming system is provided with a convenient image forming apparatus. Therefore, it becomes possible to achieve an image forming system that is superior to conventional systems.

Overall Configuration Example of Image Forming Apparatus

Figure 2:
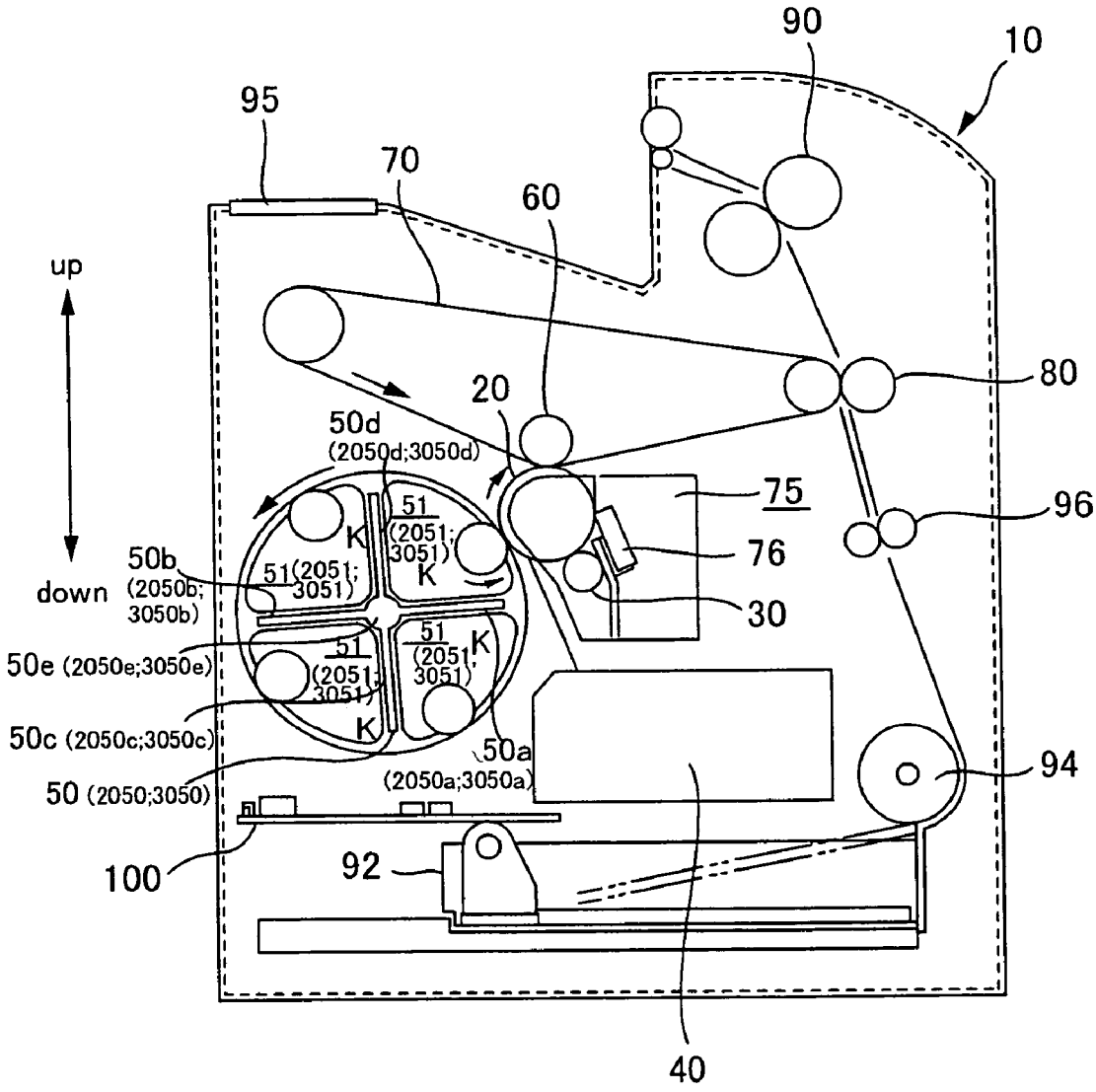
FIG. 2 is a diagram showing the main structural components for when the printer 10 is used as a monochrome printer.

Next, with reference to FIG. 1 and FIG. 2, an outline of an image-forming apparatus will be described, taking a printer 10 as an example. FIG. 1 and FIG. 2 are diagrams showing main structural components constructing the printer 10. FIG. 1 is a diagram showing the main structural components for when the printer 10 is used as a color printer, and FIG. 2 is a diagram showing the main structural components for when the printer 10 is used as a monochrome printer. The use of the printer 10 as a color printer or a monochrome printer will be described in detail further below. Note that in FIG. 1 and FIG. 2, the vertical direction is shown by the arrow, and, for example, a paper supply tray 92 is arranged at a lower section of the printer 10, and a fusing unit 90 is arranged at an upper section of the printer 10.

As shown in FIG. 1 and FIG. 2, the printer 10 includes a charging unit 30, an exposing unit 40, a developing-unit holding unit 50 (2050; 3050), a first transferring unit 60, an intermediate transferring body 70, and a cleaning unit 75, all of which being arranged in the direction of rotation of a photoconductor 20 which serves as an example of an image bearing body for bearing a latent image. The printer 10 further includes a second transferring unit 80, a fusing unit 90, a displaying unit 95 constructed of a liquid-crystal panel and serving as a displaying section for a user etc., and a control unit 100 for controlling the overall printer 10.

The photoconductor 20 has a cylindrical conductive base and a photoconductive layer formed on the outer peripheral surface of the conductive base, and it is rotatable about its central axis. In the present embodiment, the photoconductor 20 rotates clockwise, as shown by the arrow in FIG. 1 and FIG. 2.

The charging unit 30 is a device for charging the photoconductor 20. The exposing unit 40 is a device for forming a latent image on the charged photoconductor 20 by radiating laser thereon. The exposing unit 40 has, for example, a semiconductor laser, a polygon mirror, and an F-θ lens, and radiates a modulated laser beam toward the charged photoconductor 20 according to image information having been input from an external computer (not shown).

The developing-unit holding unit 50 (2050; 3050) has a plurality of attach/detach sections 50*a*, 50*b*, 50*c*, and 50*d* (2050*a*, 2050*b*, 2050*c*, and 2050*d*; 3050*a*, 3050*b*, 3050*c*, and 3050*d*) to and from which developing units, which serve as an example of developing devices (developer containers) for containing developer used for latent-image development and for developing latent images formed on the photoconductor 20, can be attached and detached. The latent image formed on the photoconductor 20 is developed using toner T, which serves as an example of the developer, contained in each of the developing units attached to the respective attach/detach sections.

Incidentally, the printer 10 according to the present embodiment can be used as a color printer (color image forming apparatus) that forms color images, and also, it can be used as a monochrome printer (monochrome image forming apparatus) that forms monochrome images.

When the printer 10 is to be used as a color printer, four (i.e., four types of) developing units, that is, a black developing unit 51 (2051; 3051), a magenta developing unit 53 (2053; 3053), a cyan developing unit 52 (2052; 3052), and a yellow developing unit 54 (2054; 3054), are attached to the four attach/detach sections 50*a*, 50*b*, 50*c*, and 50*d* (2050*a*, 2050*b*, 2050*c*, and 2050*d*; 3050*a*, 3050*b*, 3050*c*, and 3050*d*) of the developing-unit holding unit 50 (2050; 3050), as shown in FIG. 1. The latent image formed on the photoconductor 20 is developed by the toner T contained in each of the developing units 51, 52, 53, and 54 (2051, 2052, 2053, and 2054; 3051, 3052, 3053, and 3054).

Further, the developing-unit holding unit 50 (2050; 3050) can, by rotating, move the four types of developing units 51, 52, 53, and 54 (2051, 2052, 2053, and 2054; 3051, 3052, 3053, and 3054). More specifically, the developing-unit holding unit 50 (2050; 3050) is rotatably arranged about a rotation shaft 50*e* (2050*e*; 3050*e*), and the four attach/detach sections 50*a*, 50*b*, 50*c*, and 50*d* (2050*a*, 2050*b*, 2050*c*, and 2050*d*; 3050*a*, 3050*b*, 3050*c*, and 3050*d*) are provided on the developing-unit holding unit 50 (2050; 3050) such that they surround this rotation shaft 50*e* (2050*e*; 3050*e*). Therefore, when the developing-unit holding unit 50 (2050; 3050) rotates about the rotation shaft 50*e* (2050*e*; 3050*e*) with the four types of developing units 51, 52, 53, and 54 (2051, 2052, 2053, and 2054; 3051, 3052, 3053, and 3054) attached to the respective attach/detach sections, the four attached developing units 51, 52, 53, and 54 (2051, 2052, 2053, and 2054; 3051, 3052, 3053, and 3054) are moved while maintaining their relative positions. Each of the developing units 51, 52, 53, and 54 (2051, 2052, 2053, and 2054; 3051, 3052, 3053, and 3054) is moved up to a position where it comes into opposition to the photoconductor 20 when the toner T contained in each developing unit 51, 52, 53, or 54 (2051, 2052, 2053, or 2054; 3051, 3052, 3053, or 3054) is used for developing the latent image formed on the photoconductor 20. After a latent image for a single page has been developed using a certain developing unit, the developing-unit holding unit 50 (2050; 3050) is rotated by 90°, and then the adjacent developing unit is moved successively to the position in opposition to the photoconductor 20.

On the other hand, when the printer 10 is to be used as a monochrome printer, then, as shown in FIG. 2, developing units containing developer of the same color will be attached to the four attach/detach sections 50*a*, 50*b*, 50*c*, and 50*d* (2050*a*, 2050*b*, 2050*c*, and 2050*d*; 3050*a*, 3050*b*, 3050*c*, and 3050*d*) of the developing-unit holding unit 50 (2050; 3050). The latent image formed on the photoconductor 20 is developed by the toner T contained in the attached developing units which contain developer of the same color (i.e., by either one of the developing units using the single-color toner T contained in each of the attached developing units). In the present embodiment, four black developing units 51 (2051; 3051) are attached to the respective attach/detach sections 50*a*, 50*b*, 50*c*, and 50*d* (2050*a*, 2050*b*, 2050*c*, and 2050*d*; 3050*a*, 3050*b*, 3050*c*, and 3050*d*), so that the printer 10 can be used as a monochrome printer. By rotating the developing-unit holding unit 50 (2050; 3050), one of the four attached black developing units 51 (2051; 3051) is moved up to a position where it comes into opposition to the photoconductor 20. The latent image formed on the photoconductor 20 is developed with black toner T contained in the black developing unit 51 (2051; 3051), among the four attached black developing units 51 (2051; 3051), that has been moved up to a position where it comes into opposition to the photoconductor 20. Details on the developing units will be described further below.

The first transferring unit 60 is a device for transferring, onto the intermediate transferring body 70, a toner image formed on the photoconductor 20.

The intermediate transferring body 70 is a laminated endless belt that is made by providing an aluminum layer on the surface of a PET film by vapor deposition, and then further applying semiconducting coating on the outer layer thereof. The intermediate transferring body 70 is driven to rotate at substantially the same circumferential speed as the photoconductor 20.

The second transferring unit 80 is a device for transferring the toner image formed on the intermediate transferring body 70 onto a medium such as paper, film, and cloth.

The fusing unit 90 is a device for fusing the toner image, which has been transferred to the medium, onto the medium to make it into a permanent image.

The cleaning unit 75 is a device that is provided between the first transferring unit 60 and the charging unit 30, and that has a rubber cleaning blade 76 made to abut against the surface of the photoconductor 20. The cleaning unit 75 is a unit for removing the toner T remaining on the photoconductor 20 by scraping it off with the cleaning blade 76 after the toner image has been transferred onto the intermediate transferring body 70 by the first transferring unit 60.

Figure 3:
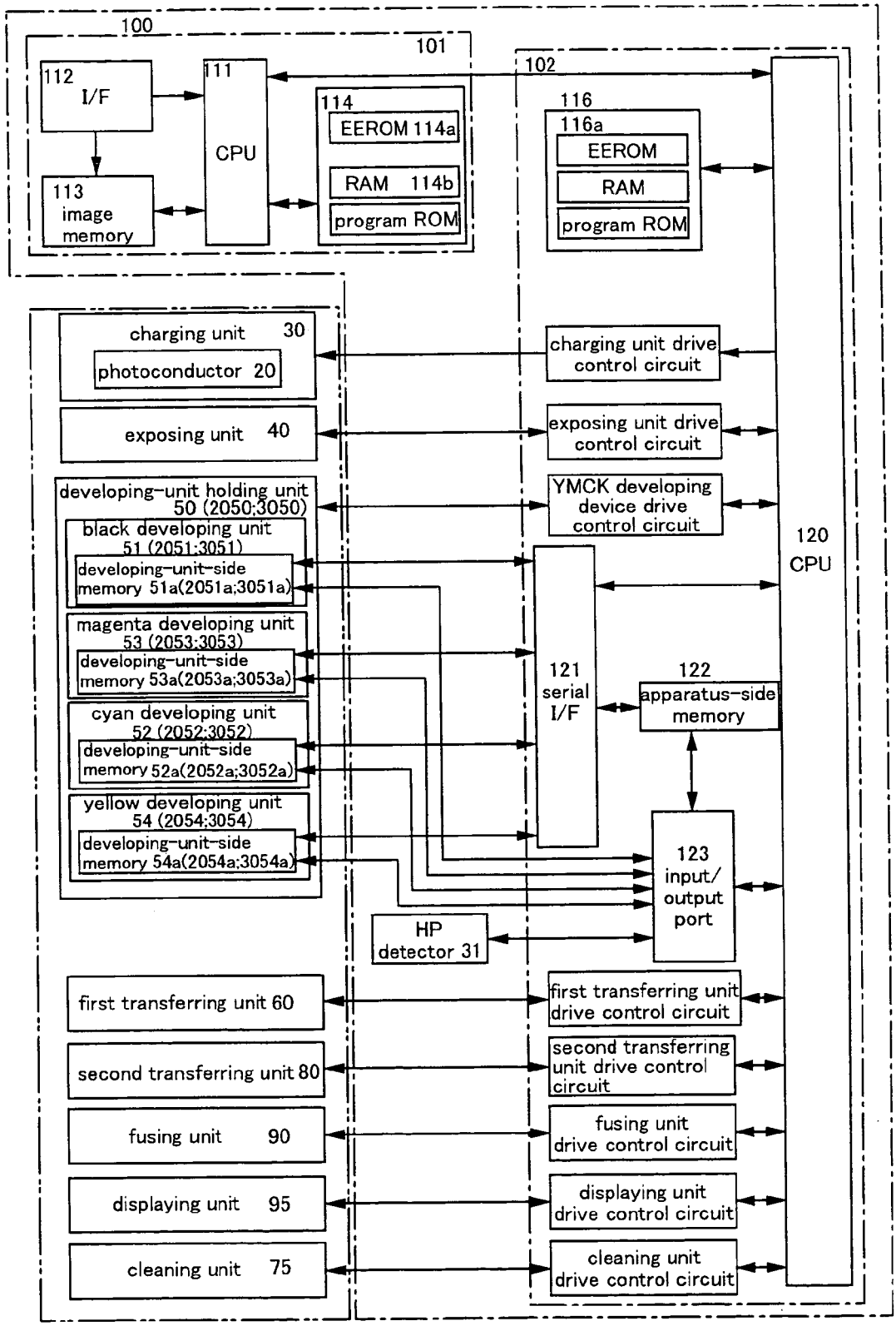
FIG. 3 is a block diagram showing a control unit 100.

The control unit 100 includes a controller section 101 and a unit controller 102 (see FIG. 3). The controller section 101 communicates with the external computer, and the unit controller 102 controls the various units etc. so as to form an image. The controller section 101 and the unit controller 102 are connected via an interface.

<<<Overview of Control Unit>>>

Next, with reference to FIG. 3, the configuration of the control unit 100 will be described. FIG. 3 is a block diagram showing the control unit 100 of the printer 10.

The controller section 101 includes a CPU 111, an interface 112 for establishing connection with a not-shown computer, an image memory 113 for storing image signals etc. that have been input from the computer, and a controller-section-side memory 114 that is made up of, for example, an electrically rewritable EEPROM 114*a*, a RAM 114*b*, and a programmable ROM in which various programs for control are written. The controller section 101 receives various information such as image signals etc. from the computer connected to the printer 10.

The controller section 101 has a function of converting the RGB data of red, green, and blue, which is the image signal sent from the computer etc., into YMCK image data of yellow, magenta, cyan, and black, and storing the converted YMCK image data in the image memory 113. Further, when the printer 10 is being used as a monochrome printer, the RGB data is converted into black image data, and the black image data thus converted is stored in the image memory 113. The controller section 101 also has a function of sending various information to the connected computer.

Further, the EEPROM 114*a* stores apparatus-type information, as apparatus information, indicative of whether the printer 10 is to be used as a color printer or as a monochrome printer. The CPU 111 receives, from the unit controller 102 at predetermined timings, developing-unit attachment information which indicates where, among the four attach/detach sections, the developing units are currently attached, and also information about each of the developing units. Based on the attachment information, the CPU 111 rewrites the apparatus-type information in the EEPROM 114*a*, if necessary. It should be noted that the apparatus-type information is 1-bit information that is written in the EEPROM 114*a*; value "0" indicates that the printer 10 is being used as a color printer, and value "1" indicates that the printer 10 is being used as a monochrome printer. When power is supplied to the printer 10, the apparatus-type information is loaded from the EEPROM 114*a* to the RAM 114*b*.

The unit controller 102 includes, for example, a CPU 120, a unit-controller-side memory 116 that is made up of, for example, an electrically rewritable EEPROM 116*a*, a RAM, and a programmable ROM in which various programs for control are written, and various drive control circuits for driving and controlling the units in the apparatus body (i.e., the charging unit 30, the exposing unit 40, the first transferring unit 60, the cleaning unit 75, the second transferring unit 80, the fusing unit 90, and the displaying unit 95) and the developing-unit holding unit 50 (2050; 3050).

Further, the CPU 120 is connected, via a serial interface (indicated herein as "I/F") 121, to a non-volatile storage element 122 (which is referred to below as "apparatus-side memory") which is, for example, a serial EEPROM. Data necessary for controlling the apparatus are stored in the apparatus-side memory 122. The CPU 120 is not only connected to the apparatus-side memory 122, but is also connected to developing-unit-side memories 51*a*, 52*a*, 53*a*, and 54*a* (2051*a*, 2052*a*, 2053*a*, and 2054*a*), which are provided on the respective developing units 51, 52, 53, and 54 (2051, 2052, 2053, and 2054), via the serial interface 121. Then, data can be exchanged between the apparatus-side memory 122 and the developing-unit-side memories 51*a*, 52*a*, 53*a*, and 54*a* (2051*a*, 2052*a*, 2053*a*, and 2054*a*), and also, it is possible to input chip-select signals CS to the developing-unit-side memories 51*a*, 52*a*, 53*a*, and 54*a* (2051*a*, 2052*a*, 2053*a*, and 2054*a*) via the input/output port 123. However, the developing-unit-side memories 51*a*, 52*a*, 53*a*, and 54*a* (2051*a*, 2052*a*, 2053*a*, and 2054*a*) do not necessarily have to be provided. The CPU 120 is also connected to the HP detector 31 via the input/output port 123.

The CPU 120 is electrically connected to each of the drive control circuits and controls the drive control circuits according to control signals from the CPU 111 of the controller section 101. More specifically, the unit controller 102 controls each of the units and the developing-unit holding unit 50 (2050; 3050) according to signals received from the controller section 101 while detecting the state of each of the units and the developing-unit holding unit 50 (2050; 3050) by receiving signals from sensors provided in each unit.

The CPU 120 also controls each of the drive control circuits according to the apparatus-type information described above. More specifically, if the value of the apparatus-type information is "0", then the CPU 120 controls the units and the developing-unit holding unit 50 (2050; 3050) of the printer 10 to function as a color printer, and if the value of the apparatus-type information is "1", then the CPU 120 controls the units of the printer 10 to function as a monochrome printer.

Operation Example of Image Forming Apparatus

Next, operations of the printer 10 structured as above are described separately for when color images are to be formed and for when monochrome images are to be formed. It should be noted that even when the printer 10 is used as a color printer, the printer 10 is able to form not only color images but also monochrome images. Therefore, the operations described below for when monochrome images are to be formed apply both to the case in which the printer 10 is used as the above-described color printer to form monochrome images, and the case in which the printer 10 is used as a monochrome printer to form monochrome images.

<Forming Color Images>

First, the operations of the printer 10 for when color images are to be formed are described below.

When image data PD and control signals COM are input from the computer 702 to the controller section 101 of the printer 10 through an interface (I/F) 112 (see FIG. 3), the photoconductor 20, a developing roller which is provided in each developing unit, and the intermediate transferring body 70 rotate under the control of the unit controller 102 based on the instructions from the controller section 101. While being rotated, the photoconductor 20 is successively charged by the charging unit 30 at a charging position.

With the rotation of the photoconductor 20, the charged area of the photoconductor 20 reaches an exposing position. A latent image that corresponds to the image information about the first color, for example, yellow Y, is formed in that area by the exposing unit 40. Here, the developing-unit holding unit 50 (2050; 3050) is positioned such that the yellow developing unit 54 (2054; 3054), which contains yellow (Y) toner, is at the developing position opposing the photoconductor 20.

With the rotation of the photoconductor 20, the latent image formed on the photoconductor 20 reaches the developing position, and is developed with the yellow toner by the yellow developing unit 54 (2054; 3054). Thus, a yellow toner image is formed on the photoconductor 20.

With the rotation of the photoconductor 20, the yellow toner image formed on the photoconductor 20 reaches a first transferring position, and is transferred onto the intermediate transferring body 70 by the first transferring unit 60. At this time, a first transferring voltage, which is in an opposite polarity from the polarity to which the toner T is charged, is applied to the first transferring unit 60. It should be noted that, during this process, the photoconductor 20 and the intermediate transferring body 70 are placed in contact with each other, but the second transferring unit 80 is kept separated from the intermediate transferring body 70.

By subsequently performing the above-mentioned processes for the second, the third, and the fourth colors for each of the developing units, toner images in four colors corresponding to the respective image signals are transferred to the intermediate transferring body 70 in a superimposed manner. As a result, a full-color toner image is formed on the intermediate transferring body 70.

With the rotation of the intermediate transferring body 70, the full-color toner image formed on the intermediate transferring body 70 reaches a second transferring position, and is transferred onto a medium, such as paper, by the second transferring unit 80. It should be noted that the medium is carried from the paper supply tray 92 to the second transferring unit 80 via the paper-feed roller 94 and resisting rollers 96. During transferring operations, a second transferring voltage is applied to the second transferring unit 80 and also the unit 80 is pressed against the intermediate transferring body 70.

The full-color toner image transferred onto the medium is heated and pressurized by the fusing unit 90 and fused to the medium.

On the other hand, after the photoconductor 20 has passed the first transferring position, the toner T adhering to the surface of the photoconductor 20 is scraped off by the cleaning blade 76 that is supported on the cleaning unit 75, and the photoconductor 20 is prepared for charging for forming the next latent image. The scraped-off toner T is collected into a remaining-toner collector of the cleaning unit 75.

<Forming Monochrome Images>

Next, the operations of the printer 10 for when monochrome images are to be formed are described below.

When image data PD and control signals COM are input from the computer 702 to the controller section 101 of the printer 10 through the interface (I/F) 112 (see FIG. 3), the photoconductor 20, the developing roller which is provided in each developing unit, and the intermediate transferring body 70 rotate under the control of the unit controller 102 based on the instructions from the controller section 101. While being rotated, the photoconductor 20 is successively charged by the charging unit 30 at the charging position.

With the rotation of the photoconductor 20, the charged area of the photoconductor 20 reaches the exposing position. A latent image that corresponds to the image information is formed in that area by the exposing unit 40. Here, the developing-unit holding unit 50 (2050; 3050) is positioned such that the black developing unit 51 (2051; 3051), which contains black toner, is at the developing position opposing the photoconductor 20.

With the rotation of the photoconductor 20, the latent image formed on the photoconductor 20 reaches the position where development is possible, and is developed by the black developing unit 51 (2051; 3051). Thus, a toner image is formed on the photoconductor 20.

With the rotation of the photoconductor 20, the toner image formed on the photoconductor 20 reaches the first transferring position, and is transferred onto the intermediate transferring body 70 by the first transferring unit 60. At this time, a first transferring voltage, which is in an opposite polarity from the polarity to which the toner is charged, is applied to the first transferring unit 60. It should be noted that, during this process, the second transferring unit 80 is kept separated from the intermediate transferring body 70.

With the rotation of the intermediate transferring body 70, the toner image formed on the intermediate transferring body 70 reaches the second transferring position, and is transferred onto a medium by the second transferring unit 80. It should be noted that the medium is carried from the paper supply tray 92 to the second transferring unit 80 via the paper-feed roller 94 and the resisting rollers 96. During transferring operations, a second transferring voltage is applied to the second transferring unit 80 and also the unit 80 is pressed against the intermediate transferring body 70.

The toner image transferred onto the medium is heated and pressurized by the fusing unit 90 and fused to the medium.

On the other hand, after the photoconductor 20 has passed the first transferring position, the toner T adhering to the surface of the photoconductor 20 is scraped off by the cleaning blade 76 that is supported on the cleaning unit 75, and the photoconductor 20 is prepared for charging for forming the next latent image. The scraped-off toner T is collected into the remaining-toner collector of the cleaning unit 75.

First Through Third Embodiments of the Developing Unit Etc.

Below, the developing units, the developing-unit holding unit, etc. will be described according to the first through third embodiments thereof.

First Embodiment

===(1) Overview of the Developing Unit===

Figure 4:
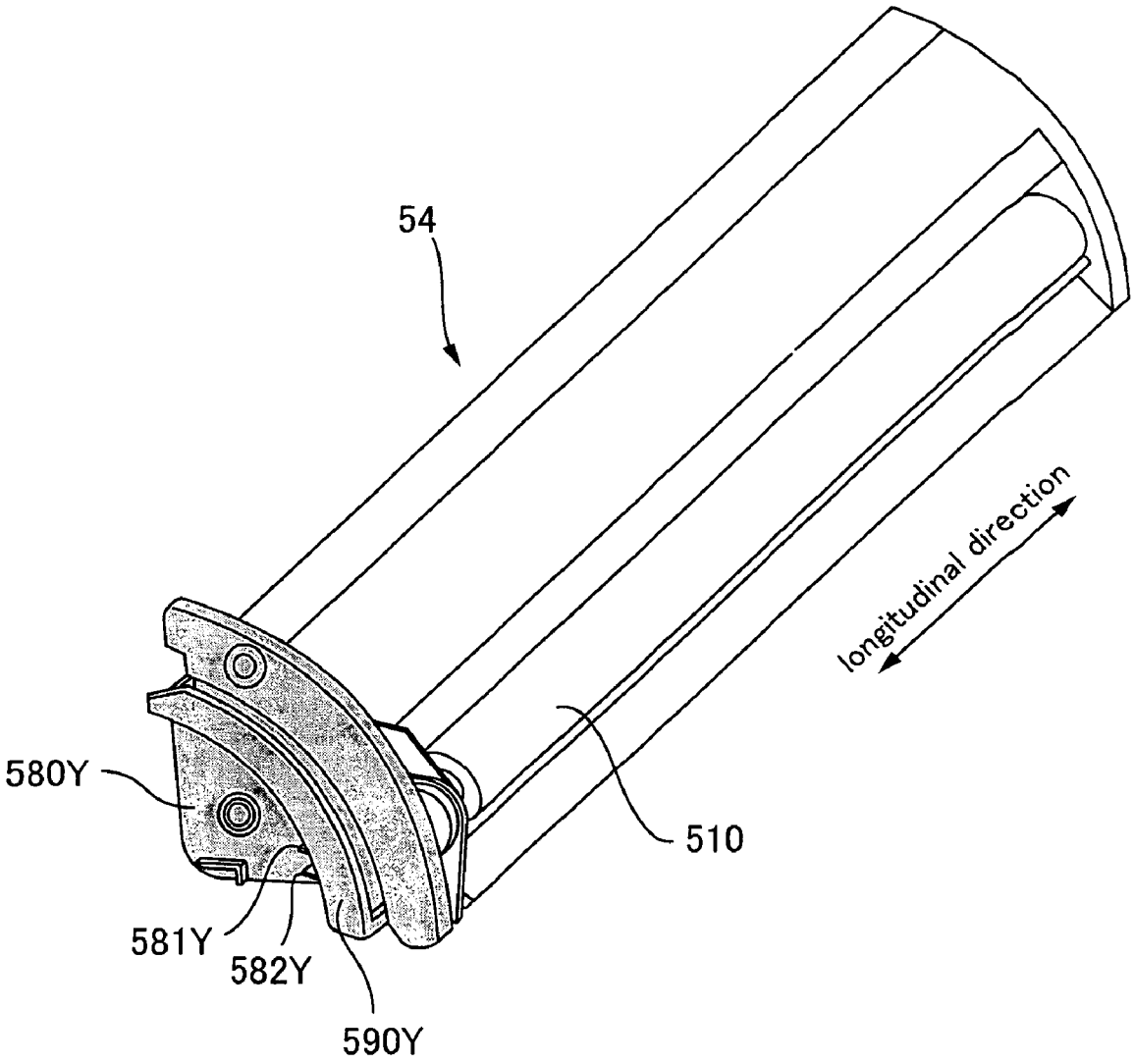
FIG. 4 is a conceptual diagram of a developing unit of a first embodiment.
Figure 5:
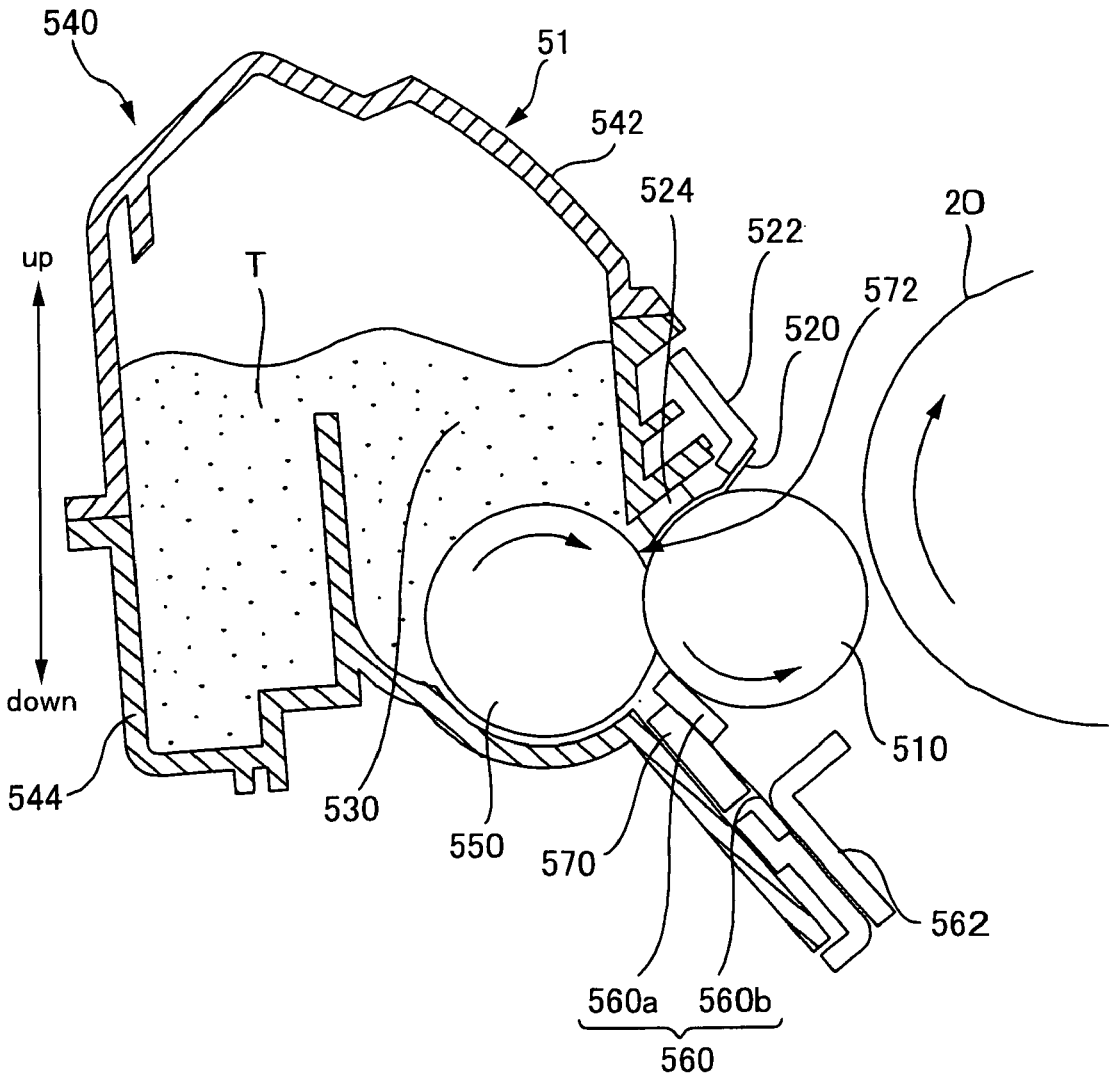
FIG. 5 is a section view showing main structural components of the developing unit.

Next, using FIG. 4 and FIG. 5, an example of a configuration of the developing units will be described. FIG. 4 is a conceptual diagram of a developing unit. FIG. 5 is a section view showing main structural components of the developing unit. Note that the section view shown in FIG. 5 is a cross section of the developing unit taken along a plane perpendicular to the longitudinal direction shown in FIG. 4. Further, in FIG. 5, the arrow indicates the vertical direction as in FIG. 1, and, for example, the yellow developing unit 54 is shown to be in a state in which it is positioned at the developing position opposing the photoconductor 20.

To the developing-unit holding unit 50, it is possible to attach: the black developing unit 51 containing black (K) toner ("developer of a certain color"); the magenta developing unit 53 containing magenta (M) toner; the cyan developing unit 52 containing cyan (C) toner; and the yellow developing unit 54 containing yellow (Y) toner. Here, explanation will be made only on the yellow developing unit 54.

The yellow developing unit 54 has, for example, a developing roller 510 serving as a developer bearing body, a sealing member 520, a toner containing section 530, a housing 540, a toner supplying roller 550, and a restriction blade 560.

The developing roller 510 bears toner T and delivers it to the developing position opposing the photoconductor 20. Further, as shown in FIG. 4, the developing roller 510 is supported at both ends in its longitudinal direction and is rotatable about its central axis. As shown in FIG. 5, the developing roller 510 rotates in the opposite direction (counterclockwise in FIG. 5) to the rotating direction of the photoconductor 20 (clockwise in FIG. 5). Further, as shown in FIG. 5, the developing roller 510 of the yellow developing unit 54 and the photoconductor 20 oppose against each other with a spacing therebetween. That is, the yellow developing unit 54 develops the latent image formed on the photoconductor 20 in a non-contacting state. Note that an alternating field is generated between the developing roller 510 and the photoconductor 20 upon development of the latent image formed on the photoconductor 20.

The sealing member 520 prevents the toner T in the yellow developing unit 54 from spilling out therefrom, and also collects the toner T, which is on the developing roller 510 that has passed the developing position, into the developing unit without scraping it off. The sealing member 520 is a seal made of, for example, polyethylene film. The sealing member 520 is pressed against the developing roller 510 by the elastic force of a seal-urging member 524 that is made of, for example, Moltoprene and that is provided on the side opposite from the side of the developing roller 510.

The housing 540 is formed by welding together a plurality of integrally-molded housing sections. As shown in FIG. 5, the housing 540 has an opening 572 opening toward the outside of the housing 540. The above-mentioned developing roller 510 is arranged from the outside of the housing 540 with its peripheral surface facing the opening 572 in such a state that a part of the roller 510 is exposed to the outside. The restriction blade 560, which is described in detail below, is also arranged from the outside of the housing 540 facing the opening 572.

Further, the housing 540 forms a toner containing section 530 that is capable of containing toner T.

The toner supplying roller 550 is provided in the toner containing section 530 described above and supplies the toner T contained in the toner containing section 530 to the developing roller 510. The toner supplying roller 550 is made of, for example, polyurethane foam, and is made to abut against the developing roller 510 in an elastically deformed state. The toner supplying roller 550 is arranged at a lower section of the toner containing section 530. The toner T contained in the toner containing section 530 is supplied to the developing roller 510 by the toner supplying roller 550 at the lower section of the toner containing section 530. The toner supplying roller 550 rotates about its central axis in the opposite direction (clockwise in FIG. 5) to the rotating direction of the developing roller 510 (counterclockwise in FIG. 5). Note that the toner supplying roller 550 has the function of supplying the toner T contained in the toner containing section 530 to the developing roller 510 as well as the function of stripping off, from the developing roller 510, the toner T remaining on the developing roller 510 after development.

The restriction blade 560 restricts the thickness of the layer of the toner T borne by the developing roller 510 and also gives charge to the toner T borne by the developing roller 510. This restriction blade 560 has a rubber section 560*a* and a rubber-supporting section 560*b*. The rubber section 560*a* is made of, for example, silicone rubber or urethane rubber. The rubber-supporting section 560*b* is a thin plate that is made of, for example, phosphor bronze or stainless steel, and that has a spring-like characteristic. The rubber section 560*a* is supported by the rubber-supporting section 560*b*. The rubber-supporting section 560*b* is attached to the housing 540 via a pair of blade-supporting metal plates 562 in a state that one end of the rubber-supporting section 560*b* is pinched between and supported by the blade-supporting metal plates 562. Further, a blade-backing member 570 made of, for example, Moltoprene is provided on one side of the restriction blade 560 opposite from the side of the developing roller 510.

The rubber section 560*a* is pressed against the developing roller 510 by the elastic force caused by the flexure of the rubber-supporting section 560*b*. Further, the blade-backing member 570 prevents the toner T from entering in between the rubber-supporting section 560*b* and the housing 540, stabilizes the elastic force caused by the flexure of the rubber-supporting section 560*b*, and also, applies force to the rubber section 560*a* from the back thereof towards the developing roller 510 to press the rubber section 560*a* against the developing roller 510. In this way, the blade-backing member 570 makes the rubber section 560*a* abut against the developing roller 510 evenly.

In the yellow developing unit 54 structured as above, the toner supplying roller 550 supplies the toner T contained in the toner containing section 530 to the developing roller 510. With the rotation of the developing roller 510, the toner T, which has been supplied to the developing roller 510, reaches the abutting position of the restriction blade 560; then, as the toner T passes the abutting position, the toner is electrically charged and its layer thickness is restricted. With further rotation of the developing roller 510, the toner T on the developing roller 510, whose layer thickness has been restricted, reaches the developing position opposing the photoconductor 20; then, under the alternating field, the toner T is used at the developing position for developing the latent image formed on the photo conductor 20. With further rotation of the developing roller 510, the toner T on the developing roller 510, which has passed the developing position, passes the sealing member 520 and is collected into the developing unit by the sealing member 520 without being scraped off.

Further, as shown in FIG. 4, a handle 590Y, a first rib 581Y which serves as a projecting section, and a second rib 582Y which serves as a second projecting section are provided on a side wall 580Y of the yellow developing unit 54.

The handle 590Y is for the user etc. to hold the yellow developing unit 54 when attaching the yellow developing unit 54 to the attach/detach section 50*d* or detaching it therefrom. It should be noted that when the yellow developing unit 54 has been attached to the attach/detach section 50*d*, a portion of the side wall 580Y, that is, a portion other than the handle 590Y, is covered by a later-described lid unit 640.

The role of the first rib 581Y and the second rib 582Y will be described further below.

In the foregoing, only the yellow developing unit 54 was described, but since the structure of the side wall of each of the developing units 51, 52, 53, and 54 is different, the structure of the side walls 580K, 580C, and 580M of the developing units 51, 52, and 53 will be described below.

Figure 8:
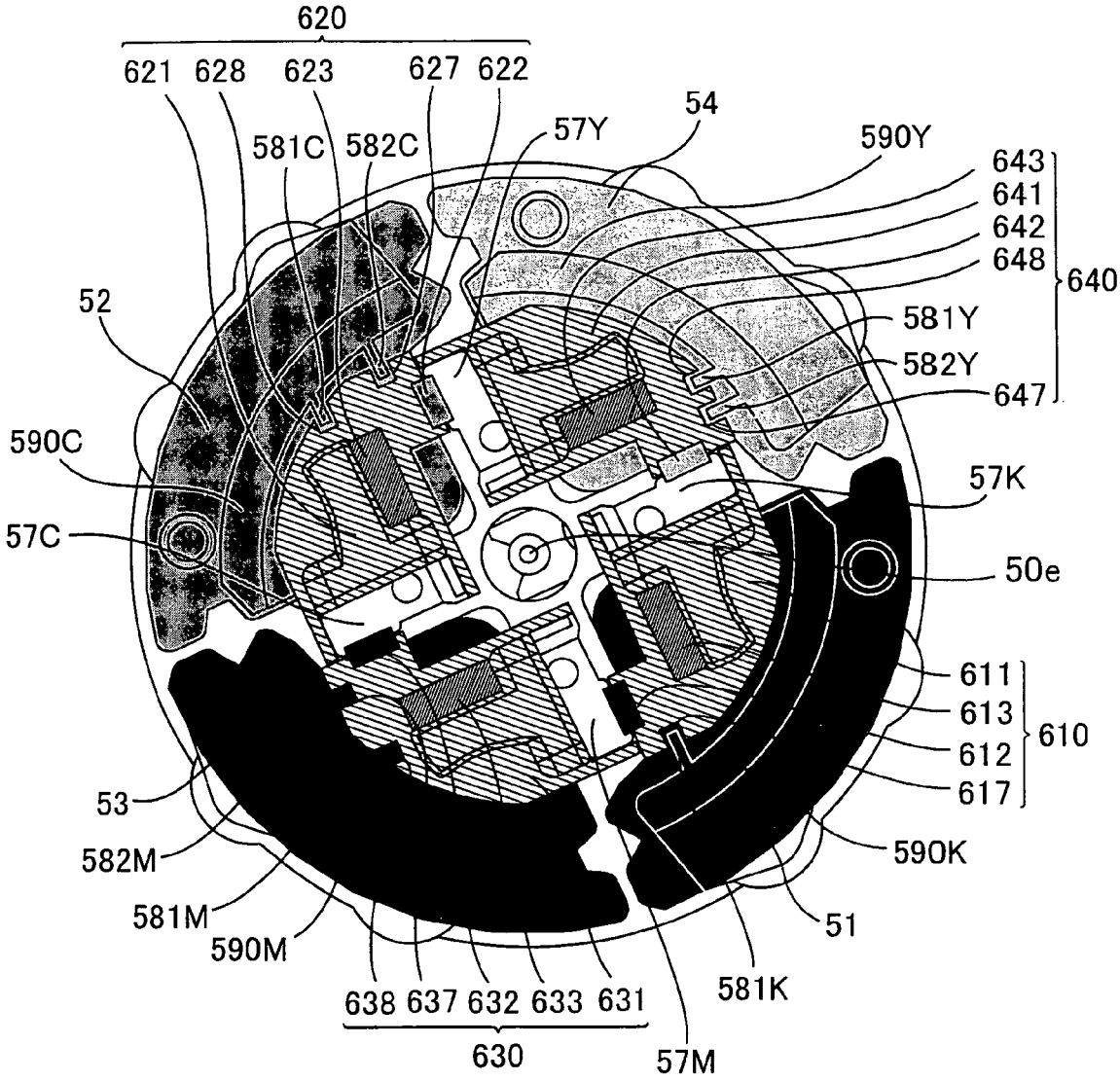
FIG. 8 shows a state in which the developing units 51, 52, 53, and 54 have respectively been attached to their attach/detach sections.

The side wall 580K of the black developing unit 51 is provided with a handle 590K and a first rib 581K which serves as a projecting section (see FIG. 8). It should be noted that the side wall 580K is not provided with a second rib. The side wall 580C of the cyan developing unit 52 is provided with a handle 590C, a first rib 581C which serves as a projecting section, and a second rib 582C which serves as a second projecting section (see FIG. 8). The side wall 580M of the magenta developing unit 53 is provided with a handle 590M, a first rib 581M which serves as a projecting section, and a second rib 582M which serves as a second projecting section (see FIG. 8).

The first ribs 581K, 581C, 581M, and 581Y are provided at positions different from one another. On the other hand, the second ribs 582C, 582M, and 582Y are provided at the same position as the first rib 581K of the black developing unit 51. Thus, the distance between the first rib and the second rib differs among the developing units 52, 53, and 54.

It should be noted that, in order to discriminate destinations, the positions of the first rib 581K and the second ribs 582C, 582M, and 582Y may be shifted for developing units that are to be attached to printers 10 having different destinations. In this case, however, the first rib 581K and the second ribs 582C, 582M, and 582Y, whose positions have been shifted, will be provided at the same position with respect to one another.

Each developing unit 51, 52, 53, and 54 is also provided with a storage element, for example, a non-volatile storage memory such as a serial EEPROM (which is also referred to below as a "developing-unit-side memory") 51*a*, 52*a*, 53*a*, and 54*a* that is for storing various kinds of information about the developing unit, such as color information about the color of the toner contained in each developing unit, toner consumption amount, and the amount of time of rotation of the developing roller 510.

Developing-unit-side connectors 51*b*, 52*b*, 53*b*, and 54*b*, which are provided on one end surface of the respective developing units, come into connection, as necessary, with an apparatus-side connector 34, which is provided on the apparatus side (i.e., the printer side), and in this way, the developing-unit-side memories 51*a*, 52*a*, 53*a*, and 54*a* are electrically connected to the unit controller 102 of the control unit 100 of the apparatus.

===(1) Overview of the Developing-unit Holding Unit===

Next, an overview of the developing-unit holding unit 50 will be described using FIG. 6A through FIG. 6C. It should be noted that in the present section, an example is described in which four developing units 51, 52, 53, and 54 are attached to the respective attach/detach sections 50*a*, 50*b*, 50*c*, and 50*d*, for the sake of convenience. The description below, however, is also applicable to cases in which developing units containing developer of the same color are attached the four attach/detach sections 50*a*, 50*b*, 50*c*, and 50*d*.

The developing-unit holding unit 50 has a rotating shaft 50*e* positioned at the center. A support frame 55 for holding the developing units is fixed to the rotating shaft 50*e*. The rotating shaft 50*e* is provided extending between two frame side plates (not shown) which form a casing of the printer 10, and both ends of the shaft 50*e* are supported. It should be noted that the axial direction of the rotating shaft 50*e* intersects with the vertical direction.

The support frame 55 is provided with the four attach/detach sections 50*a*, 50*b*, 50*c*, and 50*d*, to which the above-described developing units 51, 52, 53, and 54 of the four colors are attached in an attachable/detachable manner about the rotating shaft 50*e*, that are arranged in the circumferential direction at an interval of 90°.

A pulse motor, which is not shown, is connected to the rotating shaft 50*e*. By driving the pulse motor, it is possible to rotate the support frame 55 and position the four developing units 51, 52, 53, and 54 mentioned above at predetermined positions.

Figure 6A:
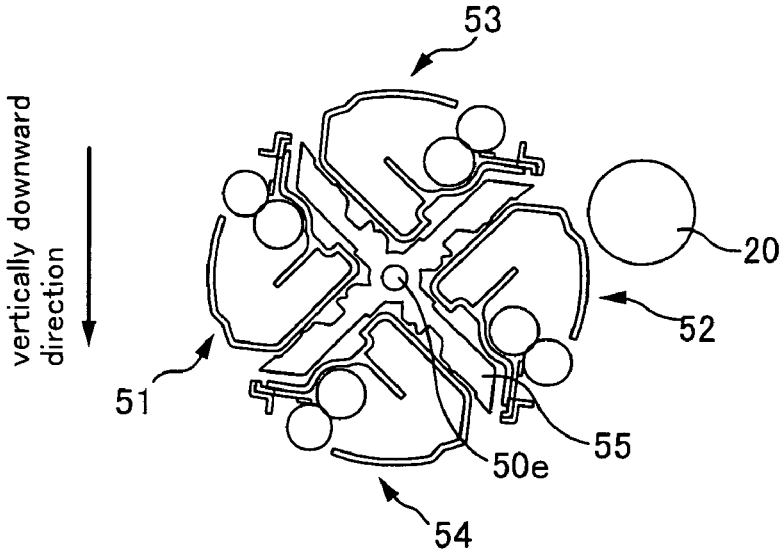
FIG. 6A shows the home position (referred to as "HP position" below) which is the standby position for when the printer is on standby for image formation to be carried out, and which is also the halt position serving as the reference position in the rotating direction of a developing-unit holding unit 50.
Figure 6B:
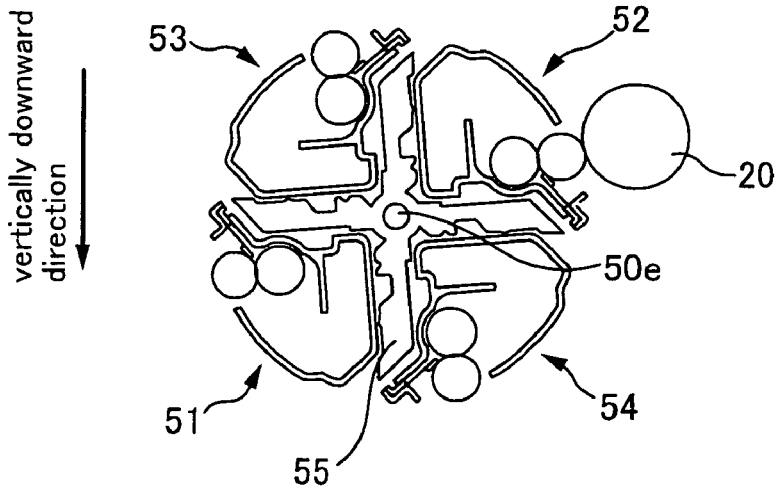
FIG. 6B shows the connector attach/detach position where the developing-unit-side connector 54*b* of a yellow developing unit 54, which is attached to the developing-unit holding unit 50, and the apparatus-side connector 34, which is provided on the apparatus side, come into opposition.
Figure 6C:
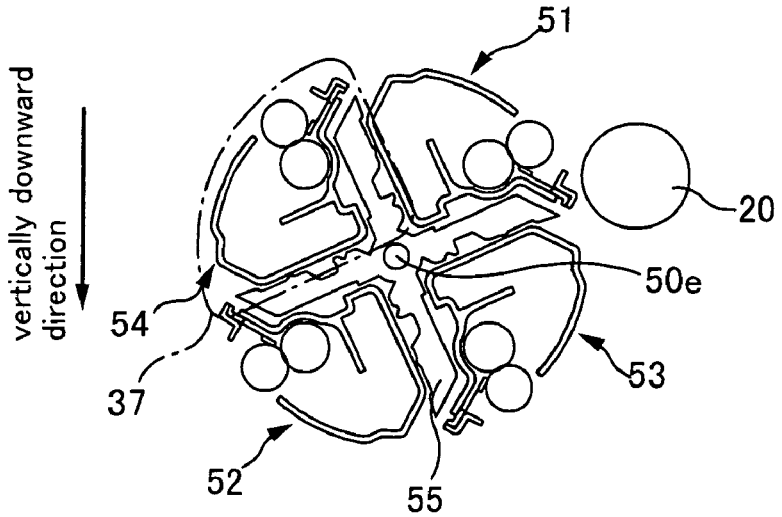
FIG. 6C shows the attach/detach position where the yellow developing unit 54 is attached and detached.

FIG. 6A through FIG. 6C are diagrams showing three stop positions of the rotating developing-unit holding unit 50. FIG. 6A shows the home position (referred to as "HP position" below) which is the standby position for when the printer is on standby for image formation to be carried out, and which is also the halt position serving as the reference position in the rotating direction of the developing-unit holding unit 50. FIG. 6B shows the connector attach/detach position where the developing-unit-side connector 54*b* of the yellow developing unit 54, which is attached to the developing-unit holding unit 50, and the apparatus-side connector 34, which is provided on the apparatus side, come into opposition. FIG. 6C shows the attach/detach position where the yellow developing unit 54 is attached and detached.

In FIG. 6B and FIG. 6C, the connector attach/detach position and the developing unit attach/detach position are explained with regard to the yellow developing unit 54, but these positions become the connector attach/detach position and the developing unit attach/detach position for each of the other developing units when the developing-unit holding unit 50 is rotated at 90° intervals.

First, the HP position shown in FIG. 6A will be described. An HP detector 31 (FIG. 3) for detecting the HP position is provided on the side of one end of the rotating shaft 50*e* of the developing-unit holding unit 50. The HP detector 31 is structured of a disk that is for generating signals and that is fixed to one end of the rotating shaft 50*e*, and an HP sensor that is made up of, for example, a photointerrupter having a light emitting section and a light receiving section. The peripheral section of the disk is arranged such that it is located between the light emitting section and the light receiving section of the HP sensor. When a slit formed in the disk moves up to a detecting position of the HP sensor, the signal that is output from the HP sensor changes from "L" to "H". The device is constructed such that the HP position of the developing-unit holding unit 50 is detected based on this change in signal level and the number of pulses of the pulse motor, and by taking this HP position as a reference, each of the developing units can be positioned at the developing position etc.

FIG. 6B shows the connector attach/detach position of the yellow developing unit 54 which is achieved by rotating the pulse motor for a predetermined number of pulses from the above-mentioned HP position. At this connector attach/detach position, the developing-unit-side connector 54*b* of the yellow developing unit 54, which is attached to the developing-unit holding unit 50, and the apparatus-side connector 34, which is provided on the apparatus side, come into opposition, and it becomes possible to connect or separate these connecters.

Figure 7A:
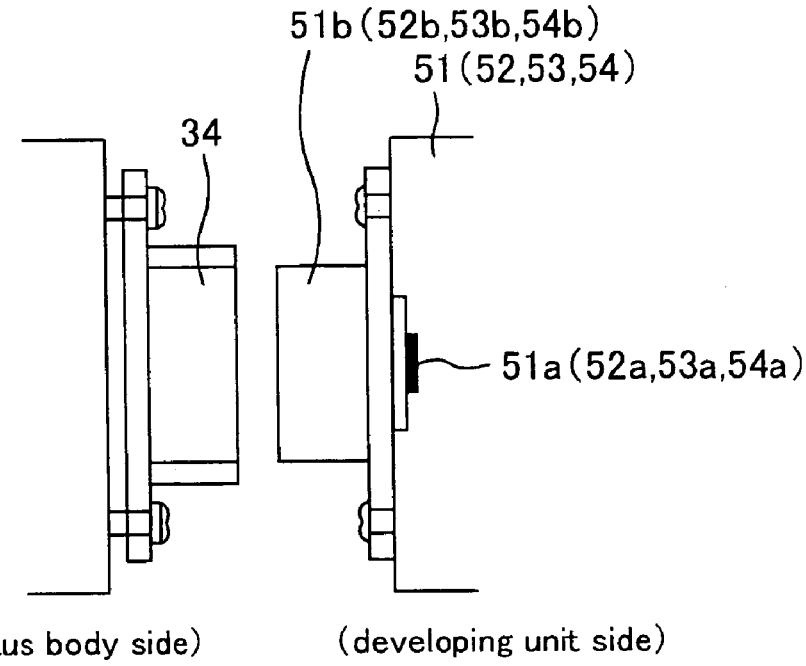
FIG. 7A is a diagram showing a separated position.
Figure 7B:
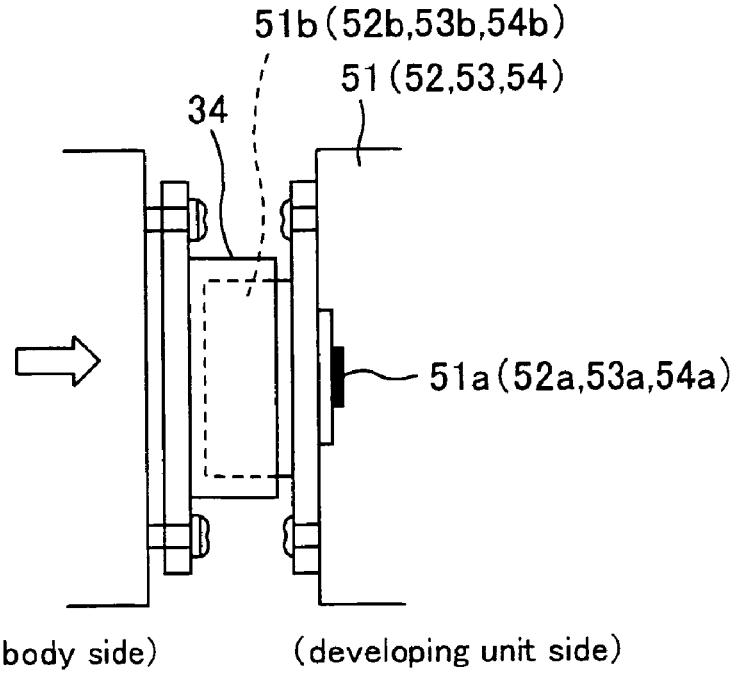
FIG. 7B is a diagram showing an abutting position.

Further explanation is given using FIG. 7A and FIG. 7B. FIG. 7A is a diagram showing a separated position where the apparatus-side connector 34 and the developing-unit-side connector 54*b* of the yellow developing unit 54 are separated from each other. FIG. 7B is a diagram showing an abutting position where the apparatus-side connector 34 and the developing-unit-side connector 54*b* of the yellow developing unit 54 are in abutment against each other.

FIG. 7A shows a state in which the apparatus-side connector 34 and the developing-unit-side connector 54*b* of the yellow developing unit 54 are separated from each other. The apparatus-side connector 34 is structured such that it can move toward, and move away from, the yellow developing unit 54. When necessary, the apparatus-side connector 34 moves in the direction towards the yellow developing unit 54 (the direction of the arrow shown in FIG. 7B). In this way, the apparatus-side connector 34 abuts against the developing-unit-side connector 54*b* of the yellow developing unit 54 as shown in FIG. 7B. Thus, the developing-unit-side memory 54*a* attached to the yellow developing unit 54 is electrically connected to the unit controller 102 of the control unit 100, and communication between the developing-unit-side memory 54*a* and the apparatus is established.

Conversely, the apparatus-side connector 34 moves, from the state shown in FIG. 7B in which the apparatus-side connector 34 and the developing-unit-side connector 54*b* of the yellow developing unit 54 abut against each other, in the direction away from the yellow developing unit 54 (the direction opposite to the direction of the arrow shown in FIG. 7B). In this way, the apparatus-side connector 34 is separated from the developing-unit-side connector 54*b* of the yellow developing unit 54, as shown in FIG. 7A.

It should be noted that the movement of the apparatus-side connector 34 is achieved by, for example, a not-shown mechanism structured of a pulse motor, a plurality of gears connected to the pulse motor, and an eccentric cam connected to the gears. More specifically, by rotating the pulse motor for a predetermined number of pulses, the above-mentioned mechanism moves the apparatus-side connector 34 from the predetermined separated position for a distance that corresponds to the above-mentioned number of pulses to position the apparatus-side connector 34 at the predetermined abutting position. On the contrary, by rotating the pulse motor in reverse for a predetermined number of pulses, the above-mentioned mechanism moves the apparatus-side connector 34 from the predetermined abutting position for a distance that corresponds to the above-mentioned number of pulses to position the apparatus-side connector 34 at the predetermined separated position.

Further, the connector attach/detach position for the yellow developing unit 54 is the developing position for the cyan developing unit 52 where the developing roller 510 of the cyan developing unit 52 and the photoconductor 20 oppose each other. That is, the connector attach/detach position of the developing-unit holding unit 50 for the yellow developing unit 54 is the developing position of the developing-unit holding unit 50 for the cyan developing unit 52. Further, the position achieved when the pulse motor rotates the developing-unit holding unit 50 counterclockwise by 90° is the connector attach/detach position for the black developing unit 51 and the developing position for the yellow developing unit 54; every time the developing-unit holding unit 50 is rotated by 90°, the connector attach/detach position and the developing position for each of the developing units are successively achieved.

Figure 9:
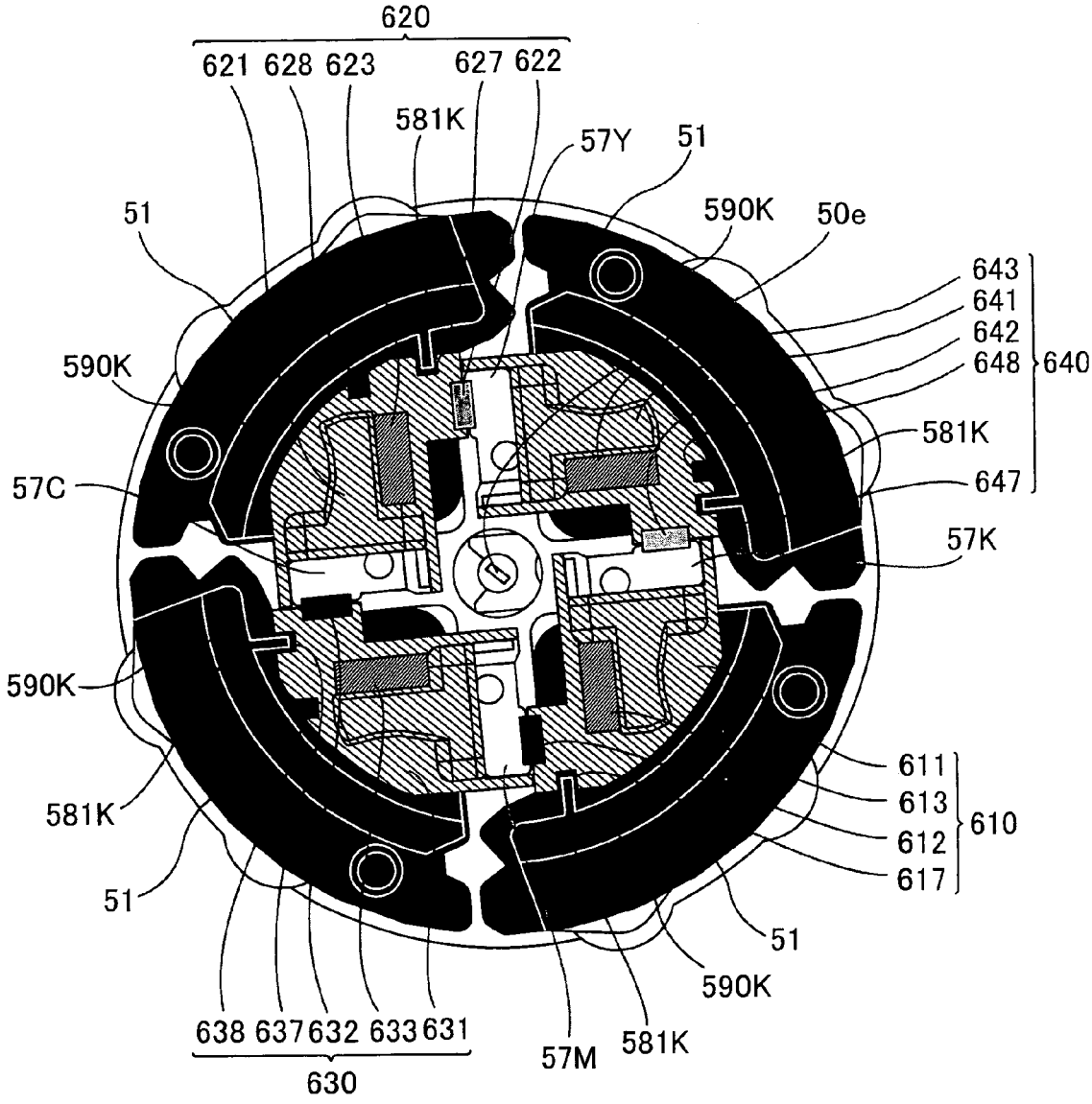
FIG. 9 shows a state in which four black developing units 51 have been attached to the four attach/detach sections 50*a*, 50*b*, 50*c*, and 50*d;*

Further, as shown in FIG. 8 and FIG. 9, lid units 610, 620, 630, and 640 are connected, respectively, to the attach/detach sections 50*a*, 50*b*, 50*c*, and 50*d*. Each of the lid units 610, 620, 630, and 640 can be opened and closed; the developing unit is "attached" by being inserted into the corresponding attach/detach section and the lid unit being closed. It should be noted that FIG. 8 shows a state in which the developing units 51, 52, 53, and 54 have respectively been attached to their attach/detach sections. FIG. 9 shows a state in which four black developing units 51 have been attached to the four attach/detach sections 50*a*, 50*b*, 50*c*, and 50*d*.

As shown in FIG. 8, the black developing unit 51 is attached to the attach/detach section 50*a* by closure of the lid unit 610; the cyan developing unit 52 is attached to the attach/detach section 50*b* by closure of the lid unit 620; the magenta developing unit 53 is attached to the attach/detach section 50*c* by closure of the lid unit 630; and the yellow developing unit 54 is attached to the attach/detach section 50*d* by closure of the lid unit 640. On the other hand, as shown in FIG. 9, the black developing units 51 can be "attached" to the attach/detach sections 50*b*, 50*c*, and 50*d*, because when the black developing units 51 are inserted into those attach/detach sections 50*b*, 50*c*, and 50*d*, the lid units 620, 630, and 640 can be closed.

It should be noted that the detailed structure of the lid units 610, 620, 630, and 640 will be given further below.

One of the two frame side plates that support the developing-unit holding unit 50 and that form the casing of the printer 10 is provided with an attach/detach dedicated opening 37 through which one developing unit can pass and an inner cover (not shown) that openably/closably covers the attach/detach dedicated opening 37. The attach/detach dedicated opening 37 is formed in a position where only a relevant developing unit (here, the yellow developing unit 54) can be pulled out and detached in the direction of the rotating shaft 50*e*, as shown in FIG. 6C, when the developing-unit holding unit 50 is rotated and each developing unit is halted at the developing unit attach/detach position which is set for each developing unit. Further, the attach/detach dedicated opening 37 is formed slightly larger than the outer shape of a developing unit. At the developing unit attach/detach position, not only is it possible to detach the developing unit, but it is also possible to insert a new developing unit through this attach/detach dedicated opening 37 in the direction of the rotating shaft 50*e* and attach the developing unit to the support frame 55. While the developing-unit holding unit 50 is positioned at positions other than the developing unit attach/detach position, the attachment/detachment of that developing unit is restricted by the frame side plates.

It should be noted that a lock mechanism, which is not shown, is provided for certainly positioning and fixing the developing-unit holding unit 50 at the positions described above.

===(1) Detailed Structure of the Lid Unit===

The detailed structure of the lid unit is described below.

Figure 10:
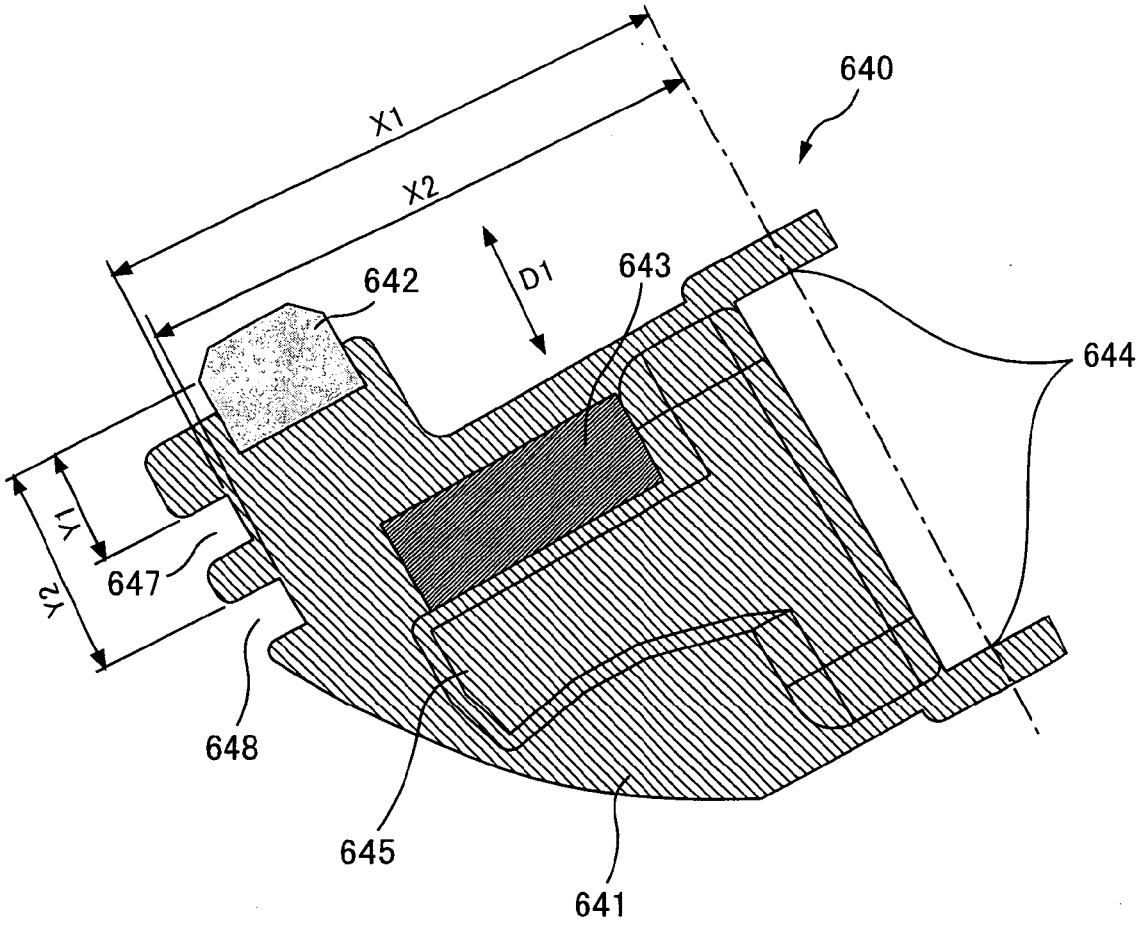
FIG. 10 is front view of a lid unit 640.
Figure 11:
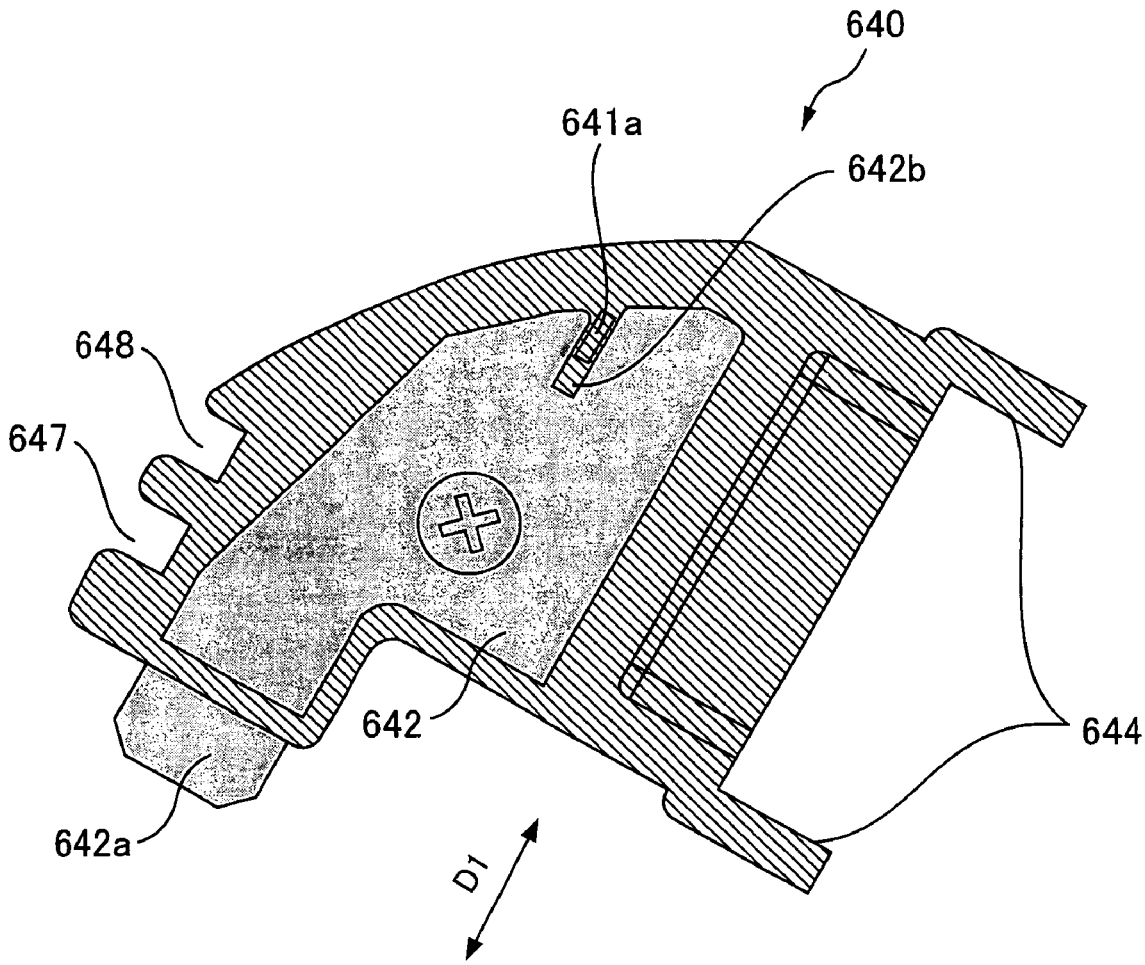
FIG. 11 is a rear view of the lid unit 640.

First, the structure of the lid unit 640 connected to the attach/detach section 50*d* will be described. FIG. 10 is front view of the lid unit 640. FIG. 11 is a rear view of the lid unit 640.

The lid unit 640 covers a portion of the side wall 580Y of the yellow developing unit 54 attached to the attach/detach section 50*d*. More specifically, the lid unit 640 covers the portions other than the handle 590Y provided on the side wall 580Y. As shown in FIG. 10, the lid unit 640 has a developing-unit cover 641, a latch 642, and an operating button 643.

The developing-unit cover 641 has a connecting section 644 connected to the attach/detach section 50*d*, and can be opened and closed taking this connecting section 644 as an axis. The connecting section 644 is connected to the attach/detach section 50*d* via a hinge 57Y. It should be noted that the color of the developing-unit cover 641 is different from the color (yellow) of the side wall 580Y.

Further, the developing-unit cover 641 is provided with a first cut-out section 647 and a second cut-out section 648. The first cut-out section 647 is for preventing the second rib 582Y from interfering with the developing-unit cover 641. The second cut-out section 648 is for preventing the first rib 581Y from interfering with the developing-unit cover 641. The first cut-out section 647 is provided in a position corresponding to the second rib 582Y, and the second cut-out section 648 is provided in a position corresponding to the first rib 581Y. In this way, the first cut-out section 647 and the second cut-out section 648 prevent the first rib 581Y and the second rib 582Y from interfering with the developing-unit cover 641 when the yellow developing unit 54 has been inserted into the attach/detach section 50*d*, thereby allowing the developing-unit cover 641 to close (see FIG. 8). As shown in FIG. 10, the distance X1 between the first cut-out section 647 and the connecting section 644 is larger than the distance X2 between the second cut-out section 648 and the connecting section 644.

It should be noted that when the black developing unit 51 is inserted into the attach/detach section 50*d*, the first cut-out section 647 prevents the first rib 581Y from interfering with the developing-unit cover 641, thereby allowing the developing-unit cover 641 to close (see FIG. 9). On the other hand, if the cyan developing unit 52 or the magenta developing unit 53 is inserted into the attach/detach section 50*d*, the first rib 581C of the cyan developing unit 52 or the first rib 581M of the magenta developing unit 53 will interfere with the developing-unit cover 641 and the developing-unit cover 641 will not close. For this reason, only the black developing unit 51 and the yellow developing unit 54 can be attached to the attach/detach section 50*d*.

Further, the developing-unit cover 641 is provided with a knob 645 for the user etc. to grip when opening and closing the developing-unit cover 641.

The latch 642 is for keeping the developing-unit cover 641 in a closed state. As shown in FIG. 11, the latch 642 is supported on the back side of the developing-unit cover 641. It should be noted that the color of the latch 642 is the same as the color (yellow) of the side wall 580Y.

The latch 642 is provided with an engagement section 642*a* and a cut-out section 642*b*. Engagement of the engagement section 642*a* to the side wall 580Y allows the developing-unit cover 641 to engage with and be fastened to the side wall 580Y at a fastening position (at the engagement section). The latch 642 is restricted from moving by means of the cut-out section 642*b* and a protrusion 641*a* provided on the developing-unit cover 641, and the latch 642 can only slide in the D1 direction. It should be noted that as shown in FIG. 10, the distance Y1 between the fastening position (engagement section) and the first cut-out section 647 is smaller than the distance Y2 between the fastening position (engagement section) and the second cut-out section 648.

The operating button 643 is connected to the latch 642 and is for operating the latch 642. It should be noted that the color of the operating button 643 is different from the color (yellow) of the side wall 580Y. The operating button 643 is partially covered by the knob 645. In this way, the operating button 643 can only move in the D1 direction.

A compression spring (not shown) is provided between the operating button 643 and the knob 645. When a force is applied to the operating button 643, the compression spring is compressed and the operating button 643 slides. Since the operating button 643 is connected to the latch 642, the latch 642 also slides when the operating button 643 slides.

Next, the structure of the lid units 610, 620, and 630 will be described.

As shown in FIG. 8, the lid unit 610 connected to the attach/detach section 50*a* has a developing-unit cover 611, a latch 612, and an operating button 613. The lid unit 620 connected to the attach/detach section 50*b* has a developing-unit cover 621, a latch 622, and an operating button 623. The lid unit 630 connected to the attach/detach section 50*c* has a developing-unit cover 631, a latch 632, and an operating button 633.

The developing-unit cover 611 is provided with a first cut-out section 617 provided in a position corresponding to the first rib 581K. However, the developing-unit cover 611 is not provided with a second cut-out section. The structure of the developing-unit cover 611 is the same as that of the developing-unit cover 641, except that it does not have a second cut-out section.

When the black developing unit 51 is inserted into the attach/detach section 50*a*, the first cut-out section 617 prevents the first rib 581K from interfering with the developing-unit cover 611, thereby allowing the lid unit 610 to close. On the other hand, when the developing unit 52, 53, or 54 is inserted into the attach/detach section 50*a*, the first rib 581C, 581M, or 581Y will interfere with the lid unit 610, and the lid unit 610 will not close. For this reason, only the black developing unit 51 can be attached to the attach/detach section 50*a*.

The developing-unit cover 621 is provided with a first cut-out section 627 provided in a position corresponding to the second rib 582C and a second cut-out section 628 provided in a position corresponding to the first rib 581C. The structure of the developing-unit cover 621 is the same as that of the developing-unit cover 641, except that the position of the second cut-out section 628 with respect to the developing-unit cover 621 is different from the position of the second cut-out section 648 with respect to the developing-unit cover 641.

When the cyan developing unit 52 is inserted into the attach/detach section 50*b*, the first cut-out section 627 and the second cut-out section 628 prevent the second rib 582C and the first rib 581C from interfering with the developing-unit cover 621, thereby allowing the lid unit 620 to close. Further, when the black developing unit 51 is inserted into the attach/detach section 50*b*, the first cut-out section 627 prevents the first rib 581K from interfering with the developing-unit cover 621, thereby allowing the lid unit 620 to close. On the other hand, when the developing unit 53 or 54 is inserted into the attach/detach section 50*b*, the first rib 581M or 581Y will interfere with the lid unit 620, and the lid unit 620 will not close. For this reason, only the black developing unit 51 and the cyan developing unit 52 can be attached to the attach/detach section 50*b*.

The developing-unit cover 631 is provided with a first cut-out section 637 provided in a position corresponding to the second rib 582M and a second cut-out section 638 provided in a position corresponding to the first rib 581M. The structure of the developing-unit cover 631 is the same as that of the developing-unit cover 641, except that the position of the second cut-out section 638 with respect to the developing-unit cover 631 is different from the position of the second cut-out section 648 with respect to the developing-unit cover 641.

When the magenta developing unit 53 is inserted into the attach/detach section 50*c*, the first cut-out section 637 and the second cut-out section 638 prevent the second rib 582M and the first rib 581M from interfering with the developing-unit cover 631, thereby allowing the lid unit 630 to close. Further, when the black developing unit 51 is inserted into the attach/detach section 50*c*, the first cut-out section 637 prevents the first rib 581K from interfering with the developing-unit cover 631, thereby allowing the lid unit 630 to close. On the other hand, when the developing unit 52 or 54 is inserted into the attach/detach section 50*c*, the first rib 581C or 581Y will interfere with the lid unit 630, and the lid unit 630 will not close. For this reason, only the black developing unit 51 and the magenta developing unit 53 can be attached to the attach/detach section 50*c*.

The shapes of latches 612, 622, and 632 are the same as the shape of the latch 642, but their colors are different from the color (yellow) of the latch 642. The latches 612, 622, and 632 are black, cyan, and magenta, respectively. The operating buttons 613, 623, and 633 have the same structure as the operating button 643.

===(1) Attaching the Developing Unit to the Attach/detach Section===

Figure 12:
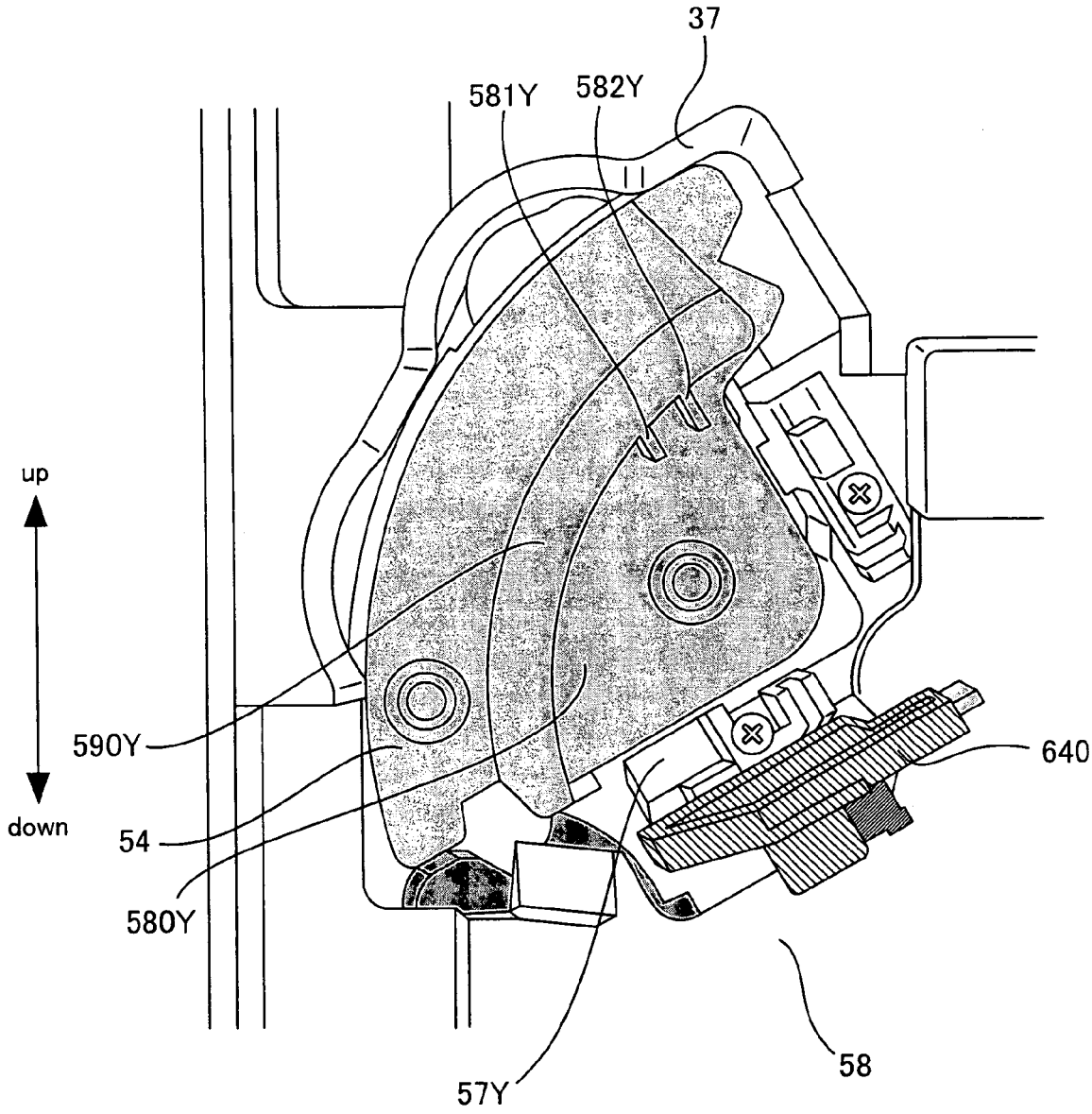
FIG. 12 shows a state in which the lid unit 640 is opened.
Figure 13:
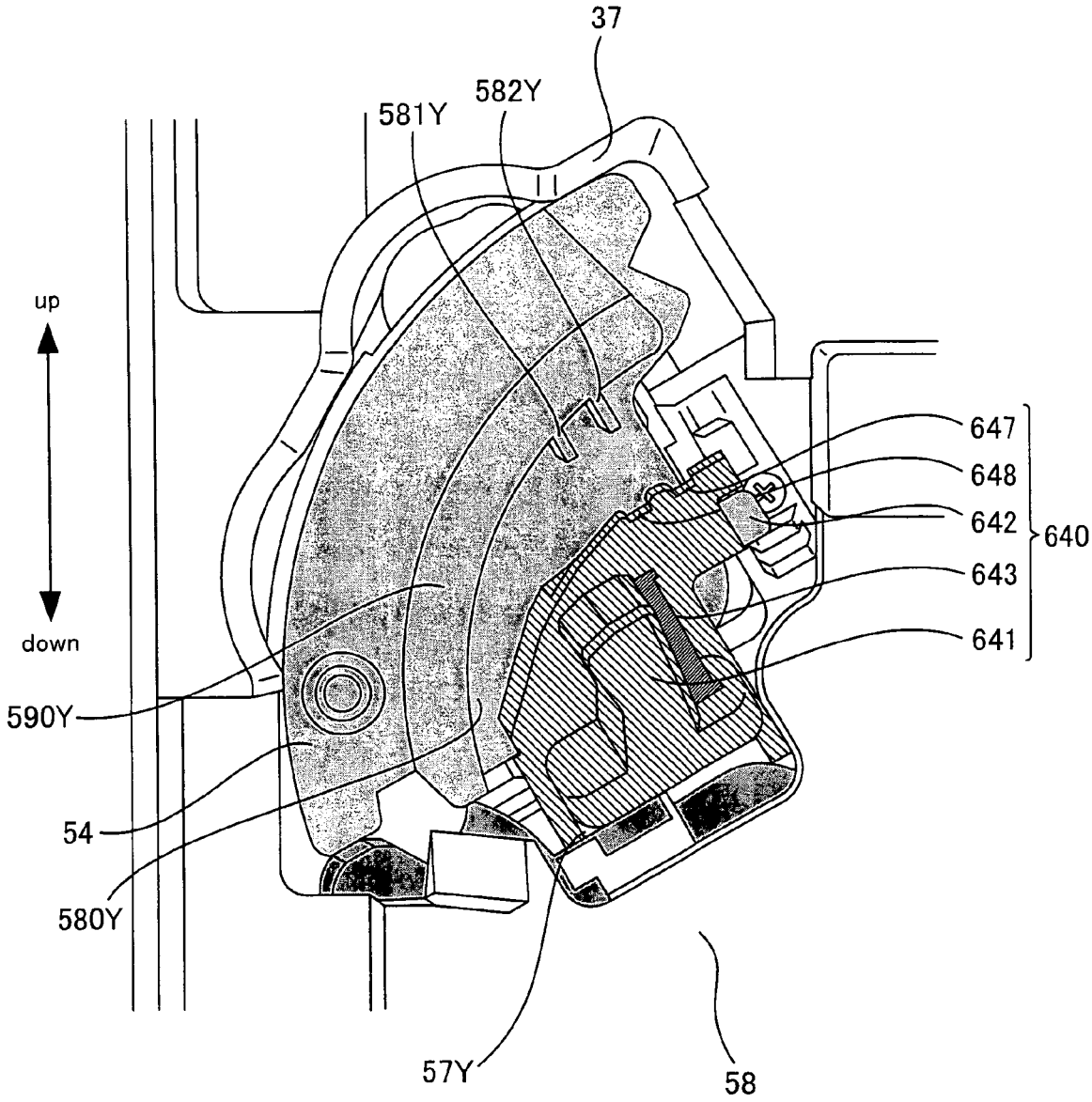
FIG. 13 shows a state where the lid unit 640 is being revolved for closure.
Figure 14:
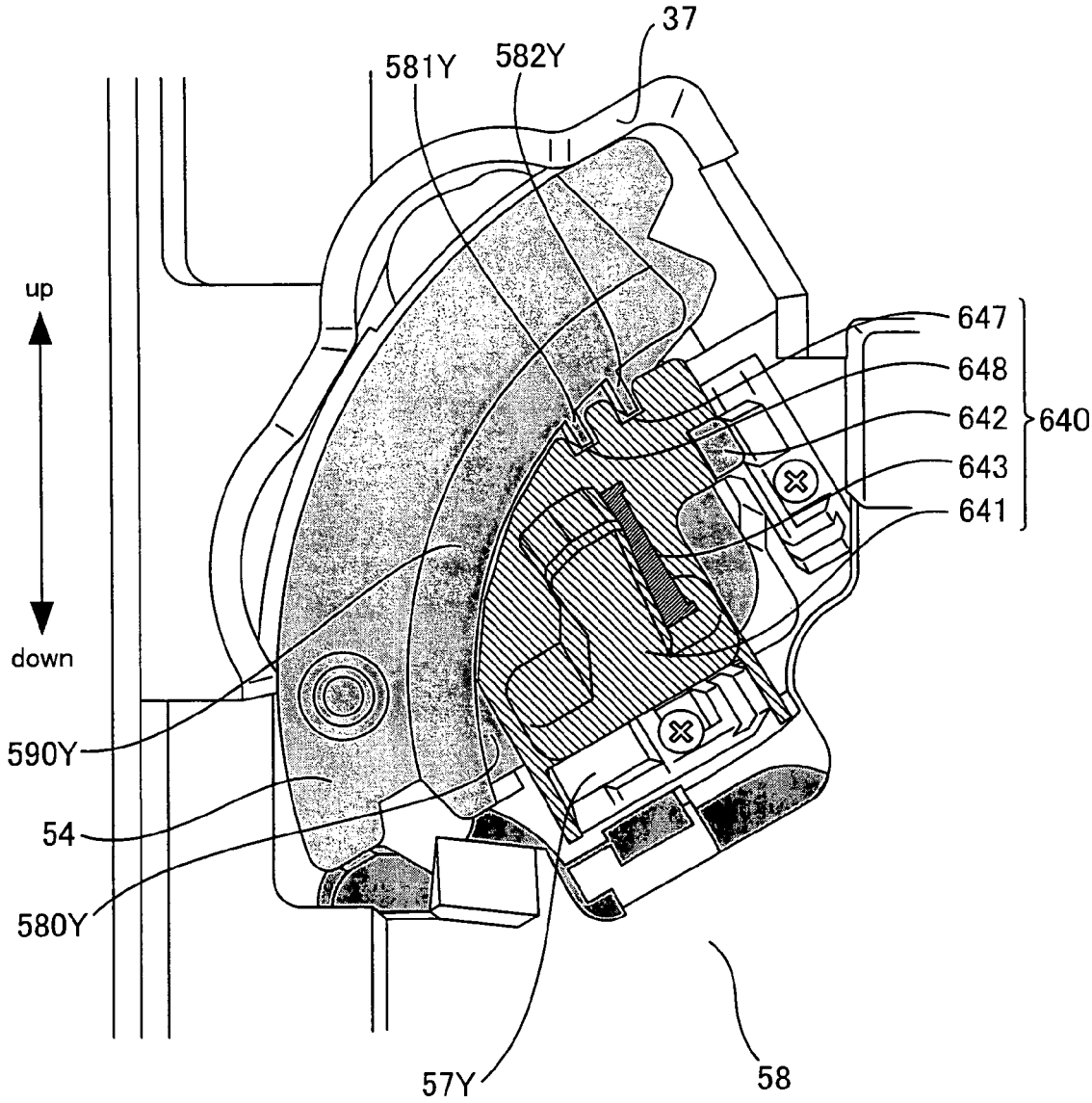
FIG. 14 shows a state in which the lid unit 640 is closed.

The procedure of attaching the developing units to the attach/detach sections is described here. Attachment of the developing units 51, 52, 53, and 54 to their respective attach/detach sections is carried out in the same way, and so below, only the procedure of attaching the yellow developing unit 54 to the attach/detach section 50*d* is described. FIG. 12 shows a state in which the lid unit 640 is opened. FIG. 13 shows a state where the lid unit 640 is being revolved for closure. FIG. 14 shows a state in which the lid unit 640 is closed.

Attachment of the yellow developing unit 54 to the attach/detach section 50*d* is started from the state where the developing-unit holding unit 50 is positioned at the attach/detach position of the yellow developing unit 54. The explanation below is given on the assumption that no developing unit is currently attached to the attach/detach section 50*d*.

First, the user etc. opens the developing-unit cover 641. Then, the user etc. compares the color of the latch 642 and the color of the side wall 580Y, and determines whether the yellow developing unit 54 is a developing unit that can be attached to the attach/detach section 50*d*. Here, since both the color of the latch 642 and the color of the side wall 580Y are yellow, the user etc. determines that the yellow developing unit 54 can be attached to the attach/detach section 50*d*. It should be noted that the black developing unit 51 is attachable to all four attach/detach sections 50*a*, 50*b*, 50*c*, and 50*d*, and so such a determination is not necessary.

Next, the user etc. inserts the yellow developing unit 54 into the attach/detach section 50*d*. The user etc. holds the handle 590Y for example, and inserts the yellow developing unit 54 into the attach/detach section 50*d* through the attach/detach dedicated opening 37, as shown in FIG. 12.

Next, the user etc. turns the developing-unit cover 641 in order to close it. Since the first cut-out section 647 is provided in a position corresponding to the second rib 582Y and the second cut-out section 648 is provided in a position corresponding to the first rib 581Y, neither the first rib 581Y nor the second rib 582Y will interfere with the developing-unit cover 641 when it is being turned. When the developing-unit cover 641 is turned for a predetermined amount, without the first rib 581Y nor the second rib 582Y interfering therewith, the latch 642 engages with the side wall 580Y. Engagement of the latch 642 to the side wall 580Y results in the developing-unit cover 641 engaging with and being fastened to the side wall 580Y and the developing-unit cover 641 being close.

Figure 15:
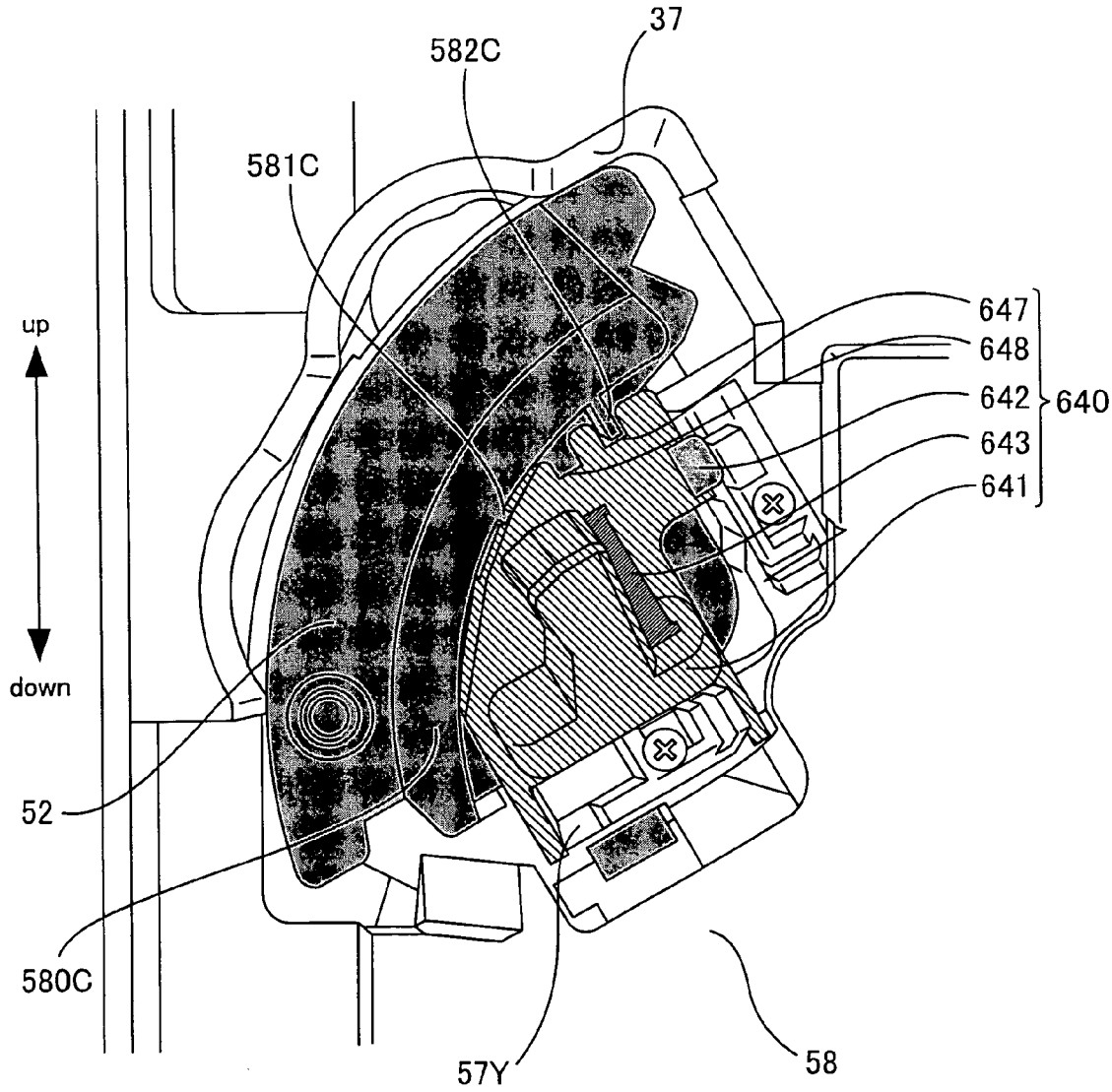
FIG. 15 shows a state where the developing-unit cover 641 does not close when the cyan developing unit 52 is inserted into the attach/detach section 50*d;*

On the other hand, the developing-unit cover 641 will not close when the cyan developing unit 52 or the magenta developing unit 53 is inserted into the attach/detach section 50*d*. For example, as shown in FIG. 15, if the cyan developing unit 52 is inserted into the attach/detach section 50*d*, the developing-unit cover 641 will not close because the position of the second cut-out section 648 is not in a position corresponding to the first rib 581C and thus the first rib 581C interferes with the developing-unit cover 641. It should be noted that FIG. 15 shows a state where the developing-unit cover 641 does not close when the cyan developing unit 52 is inserted into the attach/detach section 50*d*.

===(1) Detaching the Developing Unit===

Next, the procedure of detaching the developing unit attached to the attach/detach section will be described. Detachment of the developing units 51, 52, 53, and 54 is carried out in the same way, and so below, only the procedure of detaching the yellow developing unit 54 attached to the attach/detach section 50*d* is described.

Detachment of the yellow developing unit 54 is started from a state where the developing-unit holding unit 50 is positioned at the attach/detach position of the yellow developing unit 54. The user etc. can see the color (yellow) of the side wall 580Y of the yellow developing unit 54 through the attach/detach dedicated opening 37, and therefore can determine whether the yellow developing unit 54 is a developing unit that is appropriate for detachment.

First, the user etc. slides the operating button 643 by applying a force to the operating button 643 to compress the compression spring. The latch 642 also slides as the operating button 643 is slid. When the latch 642 is slid for a predetermined amount or more, the engagement between the latch 642 and the side wall 580Y of the yellow developing unit 54 is released. In this way, it becomes possible to turn the developing-unit cover 641.

Next, the user etc. holds the knob 645 and turns the developing-unit cover 641 toward him/her. The developing-unit cover 641 starts to open, taking the connecting section 644 as an axis. The user etc. opens the developing-unit cover 641 up to a position where the yellow developing unit 54 can be detached.

Next, the user etc. holds the handle 590Y and pulls the yellow developing unit 54 out toward him/her. By pulling the yellow developing unit 54 out through the attach/detach dedicated opening 37, the user etc. can detach the yellow developing unit 54 from the attach/detach section 50*d*.

===(1) Function of the Lid Unit===

As described above, the printer 10 (an image forming apparatus) has lid units 610, 620, 630, and 640 (a container attachment mechanism) for allowing the black developing unit 51 (a developer container) containing black toner (developer of a certain color) to be attached to any of the four attach/detach sections 50*a*, 50*b*, 50*c*, and 50*d* (a plurality of attach/detach sections), and the cyan developing unit 52, the magenta developing unit 53, and the yellow developing unit 54 to be attached only to the attach/detach sections 50*b*, 50*c*, and 50*d*, respectively. In this way, it becomes possible to achieve a user-friendly printer 10. This is described in detail below.

The printer 10 has conventionally formed color images by letting the black developing unit 51, the cyan developing unit 52, the magenta developing unit 53, and the yellow developing unit 54 be attached to the respective attach/detach sections. Further, from the viewpoint of forming a large number of monochrome images, there are cases in which the printer 10 forms monochrome images by letting a plurality of black developing units 51 be attached to all four of the attach/detach sections 50*a*, 50*b*, 50*c*, and 50*d*.

It should be noted that, from the viewpoint of keeping the color-image quality high, it is preferable to attach the cyan developing unit 52, the magenta developing unit 53, and the yellow developing unit 54 only to a predetermined one of the attach/detach sections. For example, if the magenta developing unit 53 is attached to the attach/detach section 50*b* and not the predetermined attach/detach section 50*c*, and the cyan developing unit 52 is attached to the attach/detach section 50*c* and not the predetermined attach/detach section 50*b*, then there is a possibility that the quality of a halftone image using cyan toner and magenta toner may deteriorate because the order in which the magenta toner image and the cyan toner image are formed on the photoconductor 20 will be changed.

In view of such a situation, there has been a demand for a user-friendly printer 10 that allows, with ease and without giving rise to attachment errors, the black developing unit 51 to be attached to any of the four attach/detach sections 50*a*, 50*b*, 50*c*, and 50*d*, and the cyan developing unit 52, the magenta developing unit 53, and the yellow developing unit 54 to be attached only to a predetermined attach/detach section.

To achieve this, in the present embodiment, as shown in FIG. 8 and FIG. 9, the lid units 610, 620, 630, and 640 are provided, and the developing units 51, 52, 53, and 54 are attached to the attach/detach sections by closure of the lid units 610, 620, 630, and 640.

The lid unit 610 will close when the black developing unit 51 is inserted into the attach/detach section 50*a*. On the other hand, the lid unit 610 will not close when any one of the developing units 52, 53, and 54 is inserted into the attach/detach section 50*a*. Further, the lid unit 620 will close when either the black developing unit 51 or the cyan developing unit 52 is inserted into the attach/detach section 50*b*. On the other hand, the lid unit 620 will not close when the magenta developing unit 53 or the yellow developing unit 54 is inserted into the attach/detach section 50*b*. Further, the lid unit 630 will close when either the black developing unit 51 or the magenta developing unit 53 is inserted into the attach/detach section 50*c*. On the other hand, the lid unit 630 will not close when the cyan developing unit 52 or the yellow developing unit 54 is inserted into the attach/detach section 50*c*. Further, the lid unit 640 will close when either the black developing unit 51 or the yellow developing unit 54 is inserted into the attach/detach section 50*d*. On the other hand, the lid unit 640 will not close when the cyan developing unit 52 or the magenta developing unit 53 is inserted into the attach/detach section 50*d*.

In this way, the present printer 10 allows the black developing unit 51 to be attached to any of the four attach/detach sections 50*a*, 50*b*, 50*c*, and 50*d*, and allows the cyan developing unit 52, the magenta developing unit 53, and the yellow developing unit 54 to be attached only to their respective attach/detach sections 50*b*, 50*c*, and 50*d*.

With this structure, the user etc. can confirm whether the developing units have been attached to the proper attach/detach section by checking whether the lid units 610, 620, 630, and 640 have properly closed or not.

As described above, by providing the above-mentioned lid units 610, 620, 630, and 640, it becomes possible to achieve a user-friendly printer 10 because the user etc. can attach the developing units to the attach/detach sections with ease and without any attachment errors.

===(1) Other Considerations===

In the foregoing embodiment, the container attachment mechanism included a plurality of openable/closable lid units 610, 620, 630, and 640, each of the lid units being connected to a respective one of attach/detach sections 50*a*, 50*b*, 50*c*, and 50*d* and allowing the developing unit to be attached to the attach/detach section by being closed, as shown in FIG. 8 and FIG. 9. Further, the lid units 610, 620, 630, and 640 closed when black developing unit 51 is inserted into any of the four attach/detach sections 50*a*, 50*b*, 50*c*, and 50*d*. On the other hand, the lid unit 620 closed only when the cyan developing unit 52 is inserted into the attach/detach section 50*b*; the lid unit 630 closed only when the magenta developing unit 53 is inserted into the attach/detach section 50*c*; and the lid unit 640 closed only when the yellow developing unit 54 is inserted into the attach/detach section 50*d*.

The structure, however, is not limited to the above. For example, the container attachment mechanism may be the attach/detach sections 50*a*, 50*b*, 50*c*, and 50*d*. In this case, it is necessary to provide the cut-out sections in the attach/detach sections 50*a*, 50*b*, 50*c*, and 50*d*.

However, in the case where the lid units 610, 620, 630, and 640 construct the container attachment mechanism, it is possible to confirm whether the developing unit has been attached to the proper attach/detach section by checking whether the lid unit 640 closes or not, and thus, it is possible to achieve a printer 10 that is even more user friendly. The foregoing embodiment is therefore more preferable.

Further, in the foregoing embodiment, as shown in FIG. 8, each of the developing units 51, 52, 53, and 54 was provided with first ribs 581K, 581C, 581M, and 581Y and second ribs 582C, 582M, and 582Y (projecting section), and the lid units 610, 620, 630, and 640 connected to each of the four attach/detach sections 50*a*, 50*b*, 50*c*, and 50*d* each had first cut-out sections 617, 627, 637, and 647 and second cut-out sections 628, 638, and 648 for preventing the first rib from interfering with that lid unit so that that lid unit will close. The lid unit closed when the black developing unit 51 is inserted into any of the four attach/detach sections 50*a*, 50*b*, 50*c*, and 50*d* due to the first cut-out section preventing the interference with the lid units 610, 620, 630, and 640. On the other hand, the lid unit 620 closed only when the cyan developing unit 52 is inserted into the attach/detach section 50*b* due to the first cut-out section 627 and the second cut-out section 628 preventing interference with the lid unit 620; the lid unit 630 closed only when the magenta developing unit 53 is inserted into the attach/detach section 50*c* due to the first cut-out section 637 and the second cut-out section 638 preventing interference with the lid unit 630; and the lid unit 640 closed only when the yellow developing unit 54 is inserted into the attach/detach section 50*d* due to the first cut-out section 647 and the second cut-out section 648 preventing interference with the lid unit 640.

The structure, however, is not limited to the above. For example, the cut-out sections may be provided in the developing units 51, 52, 53, and 54, and the first ribs may be provided on the lid units 610, 620, 630, and 640.

Further, in the foregoing embodiment, as shown in FIG. 8, the four attach/detach sections 50*a*, 50*b*, 50*c*, and 50*d* included the attach/detach section 50*b* corresponding to the cyan developing unit 52, the attach/detach section 50*c* corresponding to the magenta developing unit 53, and the attach/detach section 50*d* corresponding to the yellow developing unit 54; and the positions of the first ribs 581K, 581C, 581M, and 581Y were different among the developing units 51, 52, 53, and 54. Further, all of the lid units 610, 620, 630, and 640 connected to the attach/detach sections 50*a*, 50*b*, 50*c*, and 50*d* each had first cut-out sections 617, 627, 637, and 647 for preventing the first rib 581K provided on the black developing unit 51 from interfering with that lid unit; and the lid units 620, 630, and 640 connected to the attach/detach sections 50*b*, 50*c*, and 50*d* each had second cut-out sections 628, 638, and 648 for preventing the first ribs 581C, 581M, and 581Y provided on each of the cyan developing unit 52, the magenta developing unit 53, and the yellow developing unit 54 from interfering with that lid unit. The structure, however, is not limited to the above.

However, with the above structure, it is possible to allow the black developing unit 51 to be attached to any of the four attach/detach sections 50*a*, 50*b*, 50*c*, and 50*d* more reliably, and allow the cyan developing unit 52, the magenta developing unit 53, and the yellow developing unit 54 to be attached only to the predetermined attach/detach sections more reliably. The foregoing embodiment is therefore more preferable.

Further, in the present embodiment, as shown in FIG. 8, each of the cyan developing unit 52, the magenta developing unit 53, and the yellow developing unit 54 had a second rib 582C, 582M, 582Y at the same position as the first rib 581K provided on the black developing unit 51. This, however, is not a limitation. For example, the cyan developing unit 52, the magenta developing unit 53, and the yellow developing unit 54 do not have to be provided with a second rib.

However, if the second rib is not provided and the first ribs 581C, 581M, 581Y are arranged at positions close to one another, the developing units may be erroneously attached due to these first ribs not interfering with the lid units as a result of deviations etc. during closure of the lid units 620, 630, and 640. On the other hand, by providing the second ribs 582C, 582M, and 582Y on the cyan developing unit 52, the magenta developing unit 53, and the yellow developing unit 54, the distance between the second rib 582C, 582M, 582Y, which is arranged at the same position, and the first rib 581C, 581M, 581Y, which is arranged at a different position from the others, differs. Therefore, it becomes possible to effectively prevent the developing units from being erroneously attached, even when the lid unit 620, 630, 640 is out of position when closing. The foregoing embodiment is therefore more preferable.

Further, in the foregoing embodiment, as shown in FIG. 10, the lid unit 640 (610, 620, 630) has a connecting section 644 (614, 624, 634) that is connected to the attach/detach section 50*d* (50*a*, 50*b*, 50*c*), and is openable/closable taking the connecting section as an axis; and the distance X1 between the connecting section 644 (624, 634) and the first cut-out section 647 (627, 637) may be larger than the distance X2 between the connecting section 644 (624, 634) and the second cut-out section 648 (628, 638). This, however, is not a limitation. For example, the distance X1 may be smaller than the distance X2.

However, if the developing units 52, 53, and 54 are erroneously inserted to attach/detach sections other than their predetermined attach/detach sections (for example, if the cyan developing unit 52 is erroneously inserted into the attach/detach section 50*d*), then the first rib 581C will interfere with the lid unit 640. If the user tries to close the lid unit 640 in a state where the first rib 581C is interfering with the lid unit 640, a load will be applied to the periphery of the connecting section 644. If this load is large, then the lid unit 640 may break. Therefore, it is preferable to reduce the load applied to the periphery of the connecting section 644 in case of insertion error of the developing units 52, 53, and 54 to the attach/detach sections. By making the distance X1 larger than the distance X2, it becomes possible to reduce the load applied to the periphery of the connecting section 644 in case of insertion error of the developing units 52, 53, and 54 to the attach/detach sections, compared to when the distance X1 is smaller than the distance X2. The foregoing embodiment is therefore more preferable.

Further, in the foregoing embodiment, as shown in FIG. 10, the lid unit 640 (610, 620, 630) engaged with and is fastened to the developing unit 54 (51, 52, 53) at a fastening position when closed; and the distance Y1 between the fastening position and the first cut-out section 647 (627, 637) was smaller than the distance Y2 between the fastening position and the second cut-out section 648 (628, 638). This, however, is not a limitation. For example, the distance Y1 may be larger than the distance Y2.

However, if the developing units 52, 53, and 54 are erroneously inserted to attach/detach sections other than their predetermined attach/detach sections (for example, if the cyan developing unit 52 is erroneously inserted into the attach/detach section 50*d*), then a gap will be created between the engagement section 642*a* of the latch 642 and the side wall 580C when the first rib 581C interferes with the lid unit 640. The size of the gap is larger when the distance Y1 is smaller than the distance Y2, compared to when the distance Y1 is larger than the distance Y2. This is because the lid unit 640 elastically deforms when the first rib 581C interferes with the lid unit 640, and the amount of deformation becomes larger the farther the engagement section 642*a* is from the position of interference. Therefore, it becomes possible to effectively prevent the latch 642 from being erroneously engaged to the side wall 580C in cases where the gap is large, that is, in cases where the distance Y1 is smaller than the distance Y2. The foregoing embodiment is therefore more preferable.

Further, in the foregoing embodiment, the developer containers were the developing units 51, 52, 53, and 54 (developing devices) each provided with a developing roller 510 (developer bearing body) for bearing toner that is used for developing the latent image borne on the photo conductor 20, as shown in FIG. 5. This, however, is not a limitation. For example, the developer container does not have to be provided with a developing roller 510, and may be a cartridge containing toner to be supplied to the developing units 51, 52, 53, and 54.

Detachment from the attach/detach section is performed when the amount of contained toner becomes small and/or when the developing roller 510 has worn out, for example. Therefore, the frequency of attaching the developer container to the attach/detach section is higher for when the developer container is a developing unit 51, 52, 53, 54, compared to cases where the developer container is a cartridge. The foregoing embodiment is therefore more preferable in terms that the effect of the present embodiment, that is, the effect that it is possible to achieve a user-friendly printer 10, can be attained more advantageously.

Furthermore, in the foregoing embodiment, the developer of a certain color was black toner (black developer). This, however, is not a limitation, and for example, the developer of the certain color may be any of the cyan toner, magenta toner, and yellow toner. In such cases, the printer 10 will form monochrome images in that color.

However, the frequency of forming monochrome images using black toner is higher than that of forming monochrome images in color. Therefore, by allowing black developing units 51 containing black toner to be attached to the four attach/detach sections 50*a*, 50*b*, 50*c*, and 50*d*, it becomes possible to form a large number of monochrome images, and thus achieve a printer 10 that is even more user friendly. The foregoing embodiment is therefore more preferable.

Second Embodiment

===(2) Overview of the Developing Unit===

Figure 16:
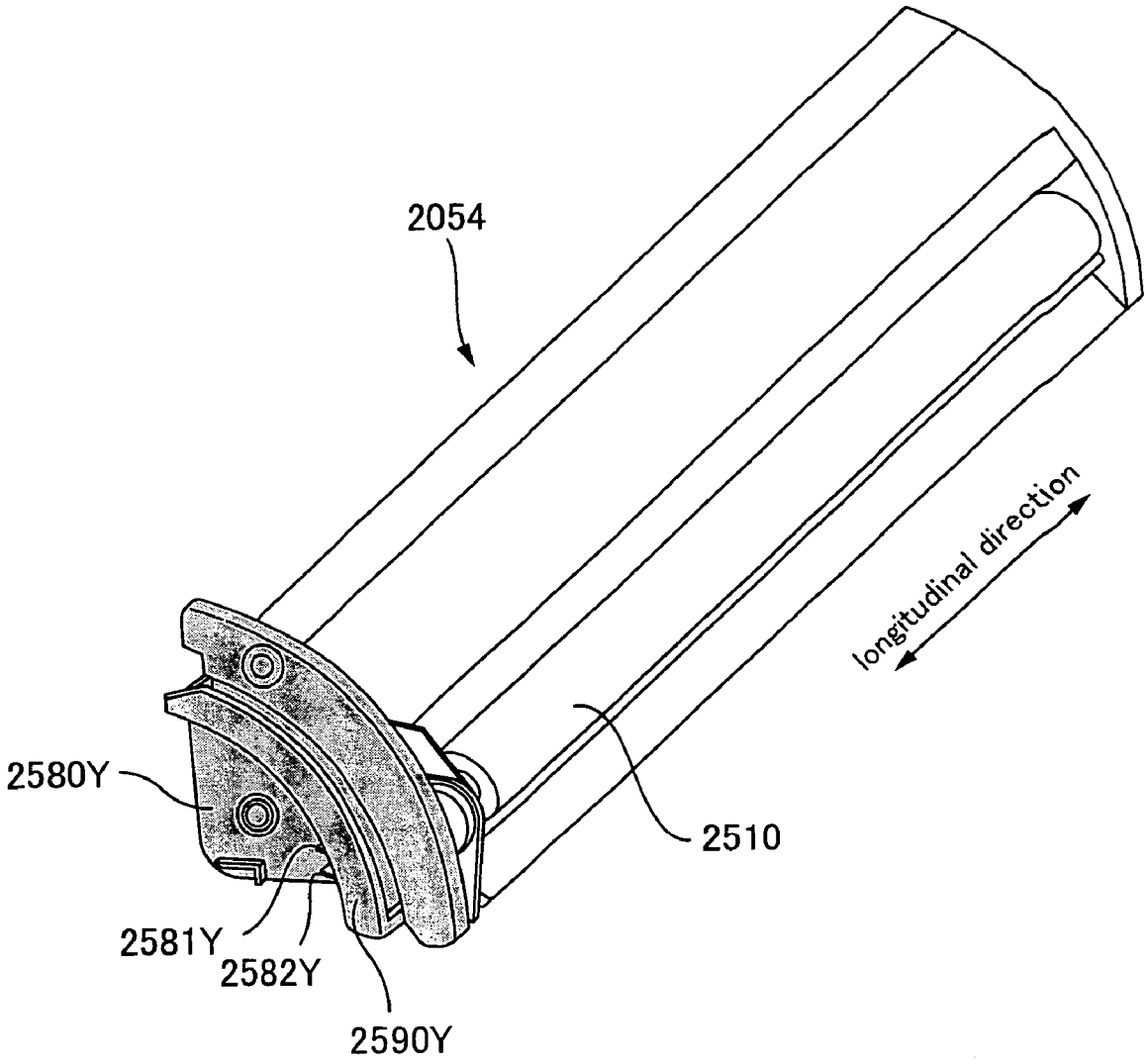
FIG. 16 is a conceptual diagram of a developing unit of a second embodiment.
Figure 17:
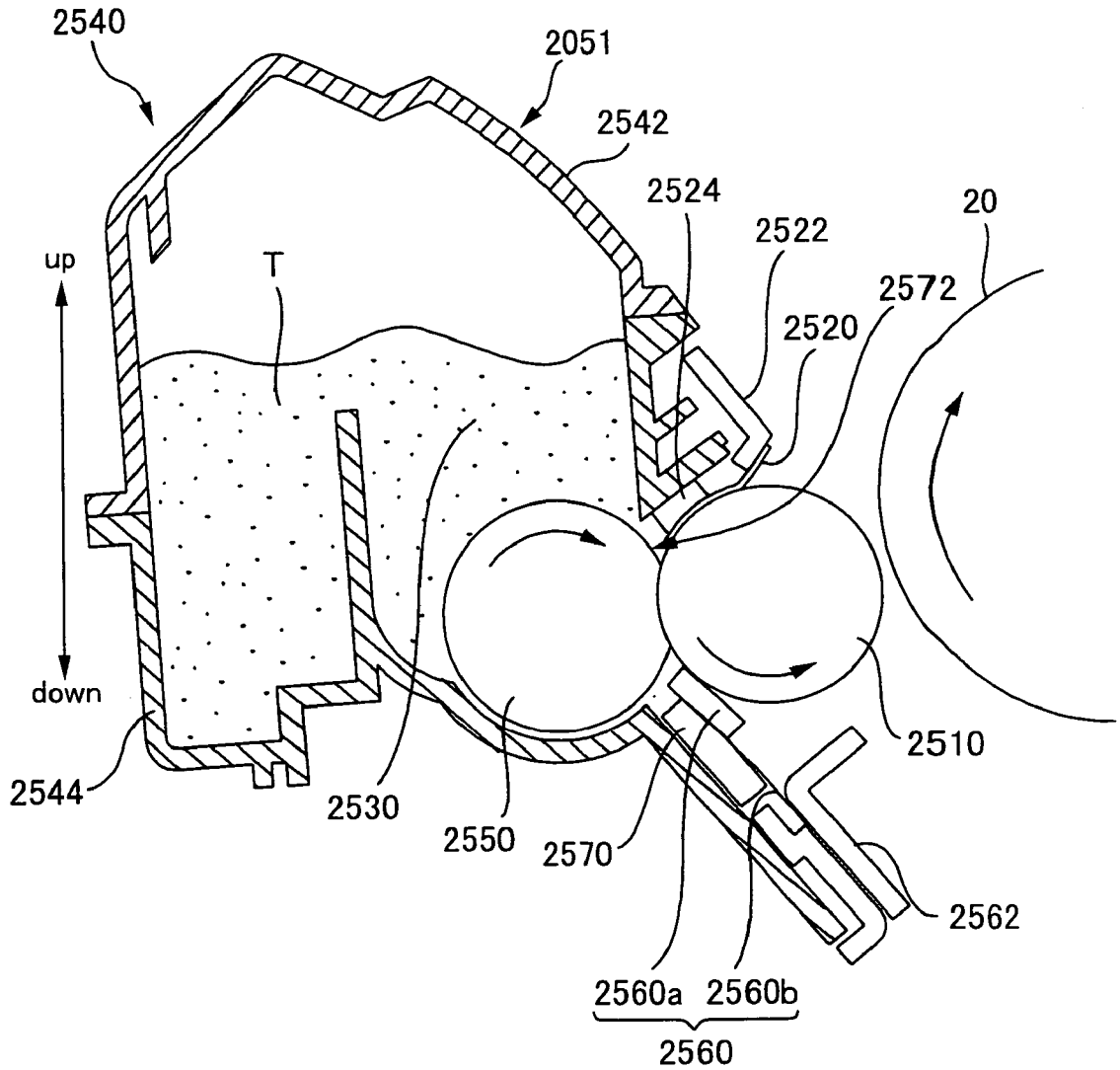
FIG. 17 is a section view showing main structural components of the developing unit.

Next, using FIG. 16 and FIG. 17, an example of a configuration of the developing units will be described. FIG. 16 is a conceptual diagram of a developing unit. FIG. 17 is a section view showing main structural components of the developing unit. Note that the section view shown in FIG. 17 is a cross section of the developing unit taken along a plane perpendicular to the longitudinal direction shown in FIG. 16. Further, in FIG. 17, the arrow indicates the vertical direction as in FIG. 1, and, for example, the yellow developing unit 2054 is shown to be in a state in which it is positioned at the developing position opposing the photoconductor 20.

To the developing-unit holding unit 2050, it is possible to attach: the black developing unit 2051 containing black (K) toner ("developer of a certain color"); the magenta developing unit 2053 containing magenta (M) toner; the cyan developing unit 2052 containing cyan (C) toner; and the yellow developing unit 2054 containing yellow (Y) toner. Here, explanation will be made only on the yellow developing unit 2054.

The yellow developing unit 2054 has, for example, a developing roller 2510 serving as a developer bearing body, a sealing member 2520, a toner containing section 2530, a housing 2540, a toner supplying roller 2550, and a restriction blade 2560.

The developing roller 2510 bears toner T and delivers it to the developing position opposing the photoconductor 20. Further, as shown in FIG. 16, the developing roller 2510 is supported at both ends in its longitudinal direction and is rotatable about its central axis. As shown in FIG. 17, the developing roller 2510 rotates in the opposite direction (counterclockwise in FIG. 17) to the rotating direction of the photoconductor 20 (clockwise in FIG. 17). Further, as shown in FIG. 17, the developing roller 2510 of the yellow developing unit 2054 and the photoconductor 20 oppose against each other with a spacing therebetween. That is, the yellow developing unit 2054 develops the latent image formed on the photoconductor 20 in a non-contacting state. Note that an alternating field is generated between the developing roller 2510 and the photoconductor 20 upon development of the latent image formed on the photoconductor 20.

The sealing member 2520 prevents the toner T in the yellow developing unit 2054 from spilling out therefrom, and also collects the toner T, which is on the developing roller 2510 that has passed the developing position, into the developing unit without scraping it off. The sealing member 2520 is a seal made of, for example, polyethylene film. The sealing member 2520 is pressed against the developing roller 2510 by the elastic force of a seal-urging member 2524 that is made of, for example, Moltoprene and that is provided on the side opposite from the side of the developing roller 2510.

The housing 2540 is formed by welding together a plurality of integrally-molded housing sections. As shown in FIG. 17, the housing 2540 has an opening 2572 opening toward the outside of the housing 2540. The above-mentioned developing roller 2510 is arranged from the outside of the housing 2540 with its peripheral surface facing the opening 2572 in such a state that a part of the roller 2510 is exposed to the outside. The restriction blade 2560, which is described in detail below, is also arranged from the outside of the housing 2540 facing the opening 2572.

Further, the housing 2540 forms a toner containing section 2530 that is capable of containing toner T.

The toner supplying roller 2550 is provided in the toner containing section 2530 described above and supplies the toner T contained in the toner containing section 2530 to the developing roller 2510. The toner supplying roller 2550 is made of, for example, polyurethane foam, and is made to abut against the developing roller 2510 in an elastically deformed state. The toner supplying roller 2550 is arranged at a lower section of the toner containing section 2530. The toner T contained in the toner containing section 2530 is supplied to the developing roller 2510 by the toner supplying roller 2550 at the lower section of the toner containing section 2530. The toner supplying roller 2550 rotates about its central axis in the opposite direction (clockwise in FIG. 17) to the rotating direction of the developing roller 2510 (counterclockwise in FIG. 17). Note that the toner supplying roller 2550 has the function of supplying the toner T contained in the toner containing section 2530 to the developing roller 2510 as well as the function of stripping off, from the developing roller 2510, the toner T remaining on the developing roller 2510 after development.

The restriction blade 2560 restricts the thickness of the layer of the toner T borne by the developing roller 2510 and also gives charge to the toner T borne by the developing roller 2510. This restriction blade 2560 has a rubber section **2560*a* and a rubber-supporting section 2560*b*. The rubber section 2560*a* is made of, for example, silicone rubber or urethane rubber. The rubber-supporting section 2560*b* is a thin plate that is made of, for example, phosphor bronze or stainless steel, and that has a spring-like characteristic. The rubber section 2560*a* is supported by the rubber-supporting section 2560*b*. The rubber-supporting section 2560*b* is attached to the housing 2540 via a pair of blade-supporting metal plates 562 in a state that one end of the rubber-supporting section 2560*b* is pinched between and supported by the blade-supporting metal plates 562. Further, a blade-backing member 2570 made of, for example, Moltoprene is provided on one side of the restriction blade 2560 opposite from the side of the developing roller 2510**.

The rubber section **2560*a* is pressed against the developing roller 2510 by the elastic force caused by the flexure of the rubber-supporting section 2560*b*. Further, the blade-backing member 2570 prevents the toner T from entering in between the rubber-supporting section 2560*b* and the housing 2540, stabilizes the elastic force caused by the flexure of the rubber-supporting section 2560*b*, and also, applies force to the rubber section 2560*a* from the back thereof towards the developing roller 2510 to press the rubber section 2560*a* against the developing roller 2510. In this way, the blade-backing member 2570 makes the rubber section 2560*a* abut against the developing roller 2510** evenly.

In the yellow developing unit 2054 structured as above, the toner supplying roller 2550 supplies the toner T contained in the toner containing section 2530 to the developing roller 2510. With the rotation of the developing roller 2510, the toner T, which has been supplied to the developing roller 2510, reaches the abutting position of the restriction blade 2560; then, as the toner T passes the abutting position, the toner is electrically charged and its layer thickness is restricted. With further rotation of the developing roller 2510, the toner T on the developing roller 2510, whose layer thickness has been restricted, reaches the developing position opposing the photoconductor 20; then, under the alternating field, the toner T is used at the developing position for developing the latent image formed on the photoconductor 20. With further rotation of the developing roller 2510, the toner T on the developing roller 2510, which has passed the developing position, passes the sealing member 2520 and is collected into the developing unit by the sealing member 2520 without being scraped off.

Further, as shown in FIG. 16, a handle 2590Y, a first rib 2581Y, and a second rib 2582Y are provided on a side wall 2580Y of the yellow developing unit 2054.

The side wall 2580Y is colored to have the same color (yellow) as the color of the toner, in order to allow the contained toner to be distinguished. The handle 2590Y is for the user etc. to hold the yellow developing unit 2054 when attaching the yellow developing unit 2054 to the attach/detach section 2050*d* or detaching it therefrom. The role of the first rib 2581Y and the second rib 2582Y will be described further below.

In the foregoing, only the yellow developing unit 2054 was described, but since the structure of the side wall of each of the developing units 2051, 2052, 2053, and 2054 is different, the structure of the side walls 2580K, 2580C, and 2580M of the developing units 2051, 2052, and 2053 will be described below.

Figure 20:
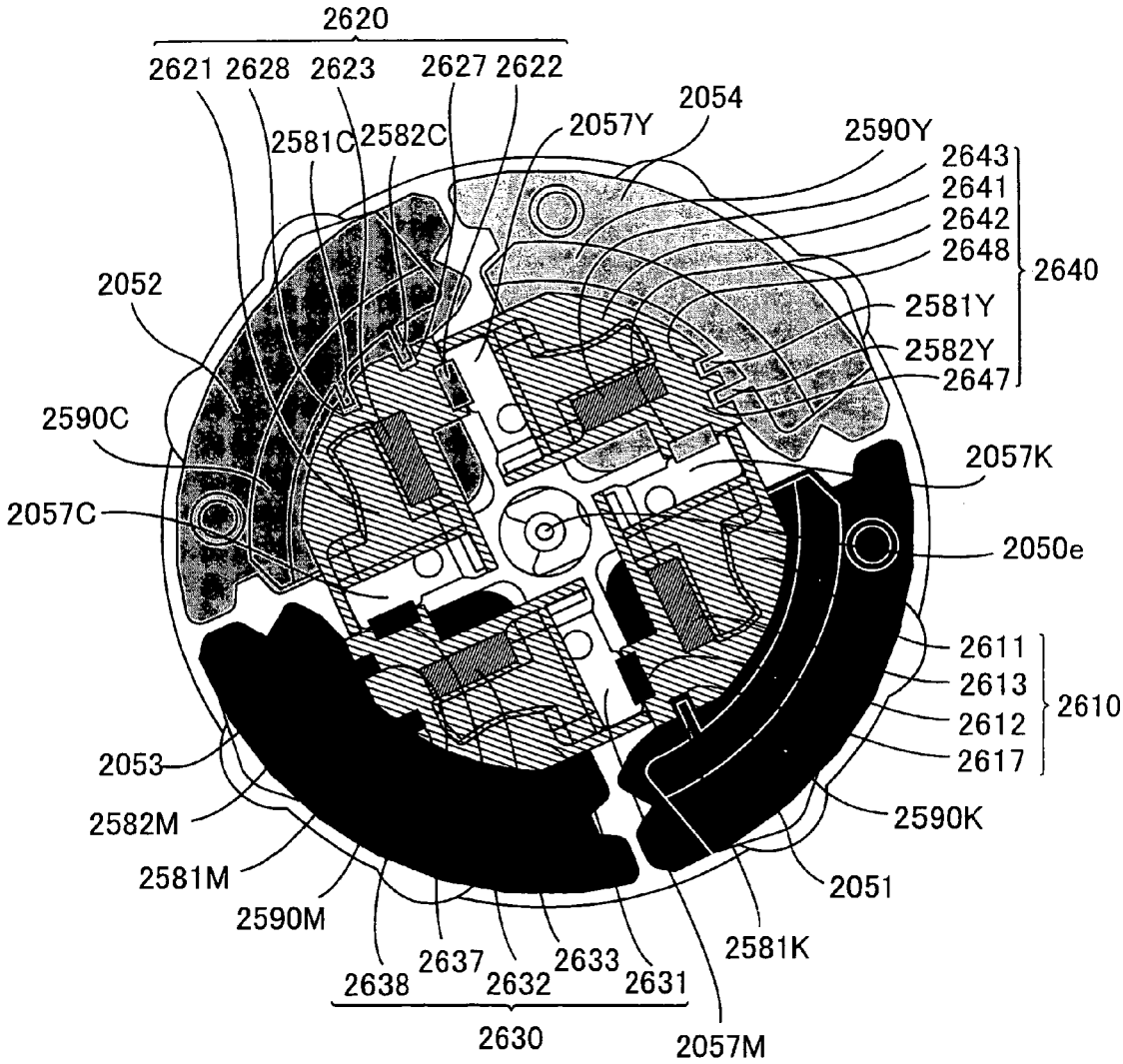
FIG. 20 shows a state in which the developing units 2051, 2052, 2053, and 2054 have respectively been attached to their attach/detach sections.

The side wall 2580K of the black developing unit 2051 is provided with a handle 2590K and a first rib 2581K (see FIG. 20). It should be noted that the side wall 2580K is not provided with a second rib. The side wall 2580C of the cyan developing unit 2052 is provided with a handle 2590C, a first rib 2581C, and a second rib 2582C (see FIG. 20). The side wall 2580M of the magenta developing unit 2053 is provided with a handle 2590M, a first rib 2581M, and a second rib 2582M (see FIG. 20).

The first ribs 2581K, 2581C, 2581M, and 2581Y are provided at positions different from one another. On the other hand, the second ribs 2582C, 2582M, and 2582Y are provided at the same position as the first rib 2581K of the black developing unit 2051. Thus, the distance between the first rib and the second rib differs among the developing units 2052, 2053, and 2054.

It should be noted that the colors of the side walls 2580K, 2580C, 2580M, and 2580Y are different from one another. The color of the side wall 2580K is black, the color of the side wall 2580C is cyan, the color of the side wall 2580M is magenta, and the color of the side wall 2580Y is yellow.

Each developing unit 2051, 2052, 2053, and 2054 is also provided with a storage element, for example, a non-volatile storage memory such as a serial EEPROM (which is also referred to below as a "developing-unit-side memory") 2051*a*, 2052*a*, 2053*a*, and 2054*a* that is for storing various kinds of information about the developing unit, such as color information about the color of the toner contained in each developing unit, toner consumption amount, and the amount of time of rotation of the developing roller 2510.

Developing-unit-side connectors 2051*b*, 2052*b*, 2053*b*, and 2054*b*, which are provided on one end surface of the respective developing units, come into connection, as necessary, with an apparatus-side connector 34, which is provided on the apparatus side (i.e., the printer side), and in this way, the developing-unit-side memories 2051*a*, 2052*a*, 2053*a*, and 2054*a* are electrically connected to the unit controller 102 of the control unit 100 of the apparatus.

===(2) Overview of the Developing-unit Holding Unit===

Next, an overview of the developing-unit holding unit 2050 will be described using FIG. 18A through FIG. 18C. It should be noted that in the present section, an example is described in which four developing units 2051, 2052, 2053, and 2054 are attached to the respective attach/detach sections 2050*a*, 2050*b*, 2050*c*, and 2050*d*, for the sake of convenience. The description below, however, is also applicable to cases in which developing units containing developer of the same color are attached the four attach/detach sections 2050*a*, 2050*b*, 2050*c*, and 2050*d*.

The developing-unit holding unit 2050 has a rotating shaft 2050*e* positioned at the center. A support frame 2055 for holding the developing units is fixed to the rotating shaft 2050*e*. The rotating shaft 2050*e* is provided extending between two frame side plates (not shown) which form a casing of the printer 10, and both ends of the shaft 2050*e* are supported. It should be noted that the axial direction of the rotating shaft 2050*e* intersects with the vertical direction.

The support frame 2055 is provided with the four attach/detach sections 2050*a*, 2050*b*, 2050*c*, and 2050*d*, to which the above-described developing units 2051, 2052, 2053, and 2054 of the four colors are attached in an attachable/detachable manner about the rotating shaft 2050*e*, that are arranged in the circumferential direction at an interval of 90°.

A pulse motor, which is not shown, is connected to the rotating shaft 2050*e*. By driving the pulse motor, it is possible to rotate the support frame 2055 and position the four developing units 2051, 2052, 2053, and 2054 mentioned above at predetermined positions.

Figure 18A:
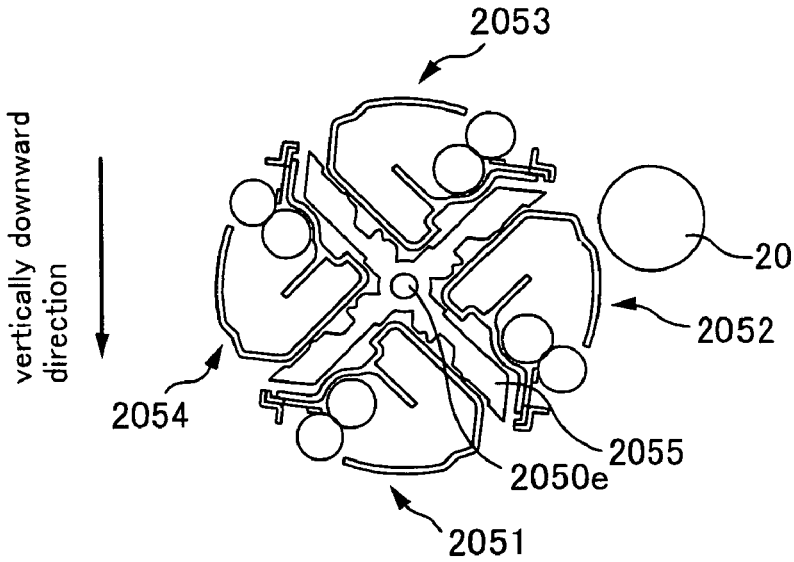
FIG. 18A shows the home position (referred to as "HP position" below) which is the standby position for when the printer is on standby for image formation to be carried out, and which is also the halt position serving as the reference position in the rotating direction of a developing-unit holding unit 2050.
Figure 18B:
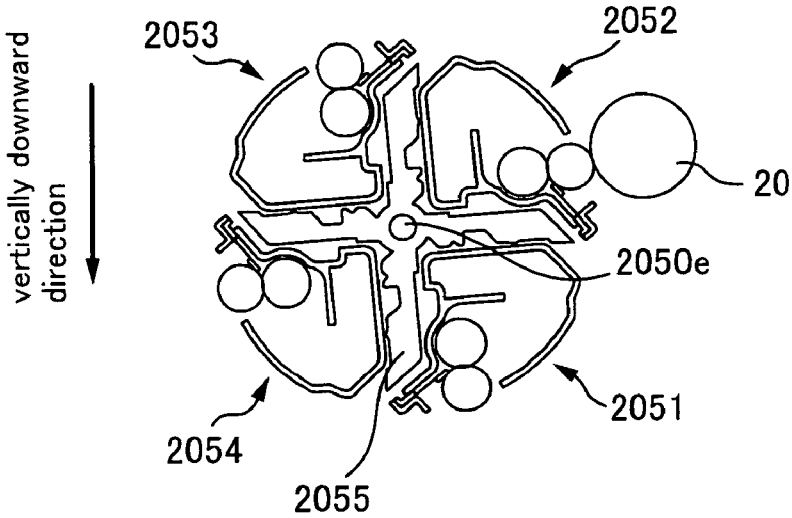
FIG. 18B shows the connector attach/detach position where the developing-unit-side connector 2054*b* of a yellow developing unit 2054, which is attached to the developing-unit holding unit 2050, and the apparatus-side connector 34, which is provided on the apparatus side, come into opposition.
Figure 18C:
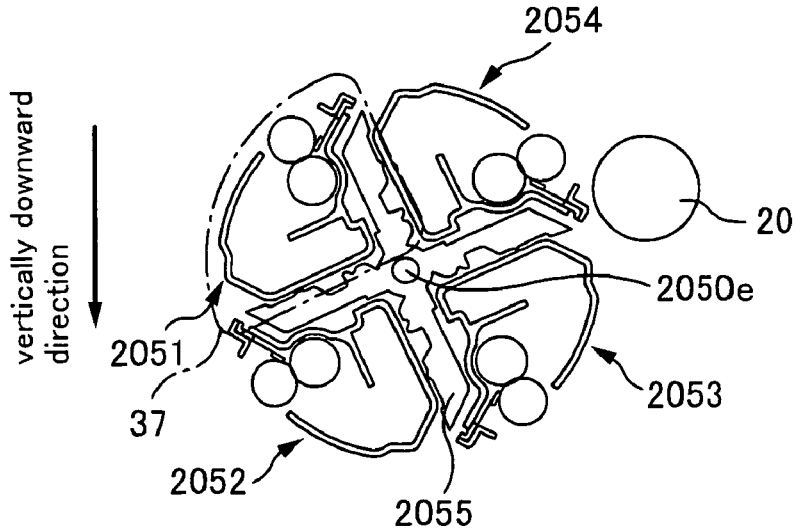
FIG. 18C shows the attach/detach position where the yellow developing unit 2054 is attached and detached.

FIG. 18A through FIG. 18C are diagrams showing three stop positions of the rotating developing-unit holding unit 2050. FIG. 18A shows the home position (referred to as "HP position" below) which is the standby position for when the printer is on standby for image formation to be carried out, and which is also the halt position serving as the reference position in the rotating direction of the developing-unit holding unit 2050. FIG. 18B shows the connector attach/detach position where the developing-unit-side connector 2054*b* of the yellow developing unit 2054, which is attached to the developing-unit holding unit 2050, and the apparatus-side connector 34, which is provided on the apparatus side, come into opposition. FIG. 18C shows the attach/detach position where the yellow developing unit 2054 is attached and detached.

In FIG. 18B and FIG. 18C, the connector attach/detach position and the developing unit attach/detach position are explained with regard to the yellow developing unit 2054, but these positions become the connector attach/detach position and the developing unit attach/detach position for each of the other developing units when the developing-unit holding unit 2050 is rotated at 90° intervals.

First, the HP position shown in FIG. 18A will be described. An HP detector 31 (FIG. 3) for detecting the HP position is provided on the side of one end of the rotating shaft 2050*e* of the developing-unit holding unit 2050. The HP detector 31 is structured of a disk that is for generating signals and that is fixed to one end of the rotating shaft 2050*e*, and an HP sensor that is made up of, for example, a photo interrupter having a light emitting section and a light receiving section. The peripheral section of the disk is arranged such that it is located between the light emitting section and the light receiving section of the HP sensor. When a slit formed in the disk moves up to a detecting position of the HP sensor, the signal that is output from the HP sensor changes from "L" to "H". The device is constructed such that the HP position of the developing-unit holding unit 2050 is detected based on this change in signal level and the number of pulses of the pulse motor, and by taking this HP position as a reference, each of the developing units can be positioned at the developing position etc.

FIG. 18B shows the connector attach/detach position of the yellow developing unit 2054 which is achieved by rotating the pulse motor for a predetermined number of pulses from the above-mentioned HP position. At this connector attach/detach position, the developing-unit-side connector 2054*b* of the yellow developing unit 2054, which is attached to the developing-unit holding unit 2050, and the apparatus-side connector 34, which is provided on the apparatus side, come into opposition, and it becomes possible to connect or separate these connecters.

Figure 19A:
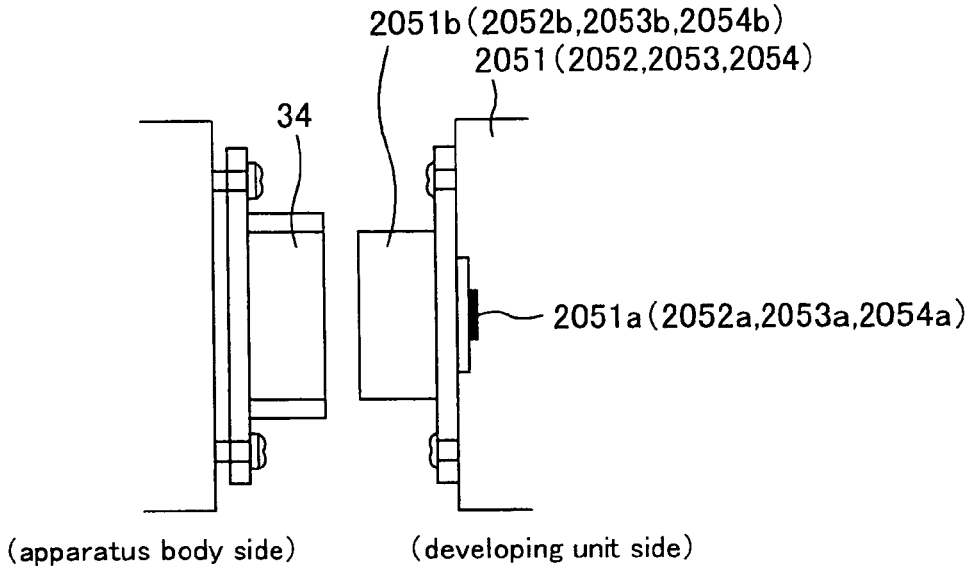
FIG. 19A is a diagram showing a separated position.
Figure 19B:
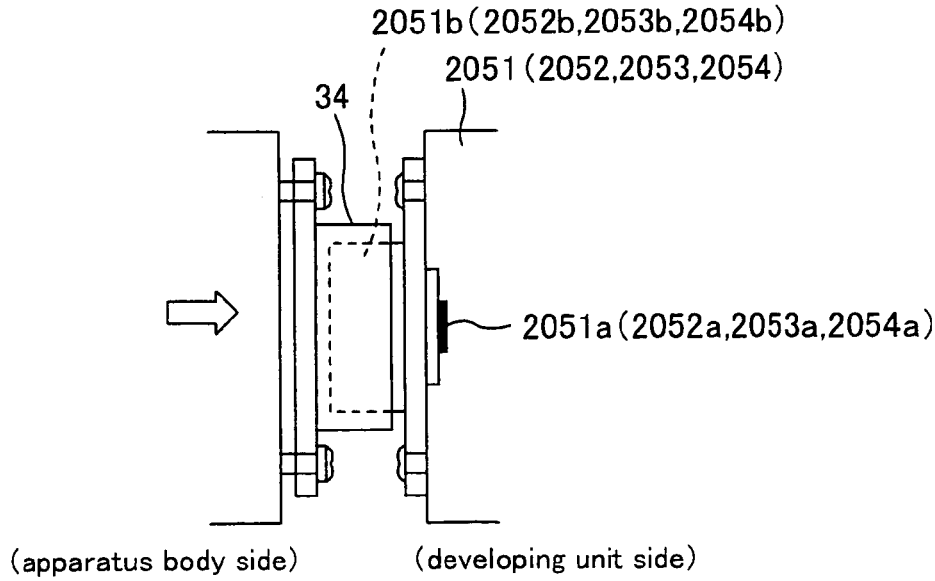
FIG. 19B is a diagram showing an abutting position.

Further explanation is given using FIG. 19A and FIG. 19B. FIG. 19A is a diagram showing a separated position where the apparatus-side connector 34 and the developing-unit-side connector 2054*b* of the yellow developing unit 2054 are separated from each other. FIG. 19B is a diagram showing an abutting position where the apparatus-side connector 34 and the developing-unit-side connector 2054*b* of the yellow developing unit 2054 are in abutment against each other.

FIG. 19A shows a state in which the apparatus-side connector 34 and the developing-unit-side connector 2054*b* of the yellow developing unit 2054 are separated from each other. The apparatus-side connector 34 is structured such that it can move toward, and move away from, the yellow developing unit 2054. When necessary, the apparatus-side connector 34 moves in the direction towards the yellow developing unit 2054 (the direction of the arrow shown in FIG. 19B). In this way, the apparatus-side connector 34 abuts against the developing-unit-side connector 2054*b* of the yellow developing unit 2054 as shown in FIG. 19B. Thus, the developing-unit-side memory 2054*a* attached to the yellow developing unit 2054 is electrically connected to the unit controller 102 of the control unit 100, and communication between the developing-unit-side memory 2054*a* and the apparatus is established.

Conversely, the apparatus-side connector 34 moves, from the state shown in FIG. 19B in which the apparatus-side connector 34 and the developing-unit-side connector 2054*b* of the yellow developing unit 2054 abut against each other, in the direction away from the yellow developing unit 2054 (the direction opposite to the direction of the arrow shown in FIG. 19B). In this way, the apparatus-side connector 34 is separated from the developing-unit-side connector 2054*b* of the yellow developing unit 2054, as shown in FIG. 19A.

It should be noted that the movement of the apparatus-side connector 34 is achieved by, for example, a not-shown mechanism structured of a pulse motor, a plurality of gears connected to the pulse motor, and an eccentric cam connected to the gears. More specifically, by rotating the pulse motor for a predetermined number of pulses, the above-mentioned mechanism moves the apparatus-side connector 34 from the predetermined separated position for a distance that corresponds to the above-mentioned number of pulses to position the apparatus-side connector 34 at the predetermined abutting position on the contrary, by rotating the pulse motor in reverse for a predetermined number of pulses, the above-mentioned mechanism moves the apparatus-side connector 34 from the predetermined abutting position for a distance that corresponds to the above-mentioned number of pulses to position the apparatus-side connector 34 at the predetermined separated position.

Further, the connector attach/detach position for the yellow developing unit 2054 is the developing position for the cyan developing unit 2052 where the developing roller 2510 of the cyan developing unit 2052 and the photoconductor 20 oppose each other. That is, the connector attach/detach position of the developing-unit holding unit 2050 for the yellow developing unit 2054 is the developing position of the developing-unit holding unit 2050 for the cyan developing unit 2052. Further, the position achieved when the pulse motor rotates the developing-unit holding unit 2050 counterclockwise by 90° is the connector attach/detach position for the black developing unit 2051 and the developing position for the yellow developing unit 2054; every time the developing-unit holding unit 2050 is rotated by 90°, the connector attach/detach position and the developing position for each of the developing units are successively achieved.

Figure 21:
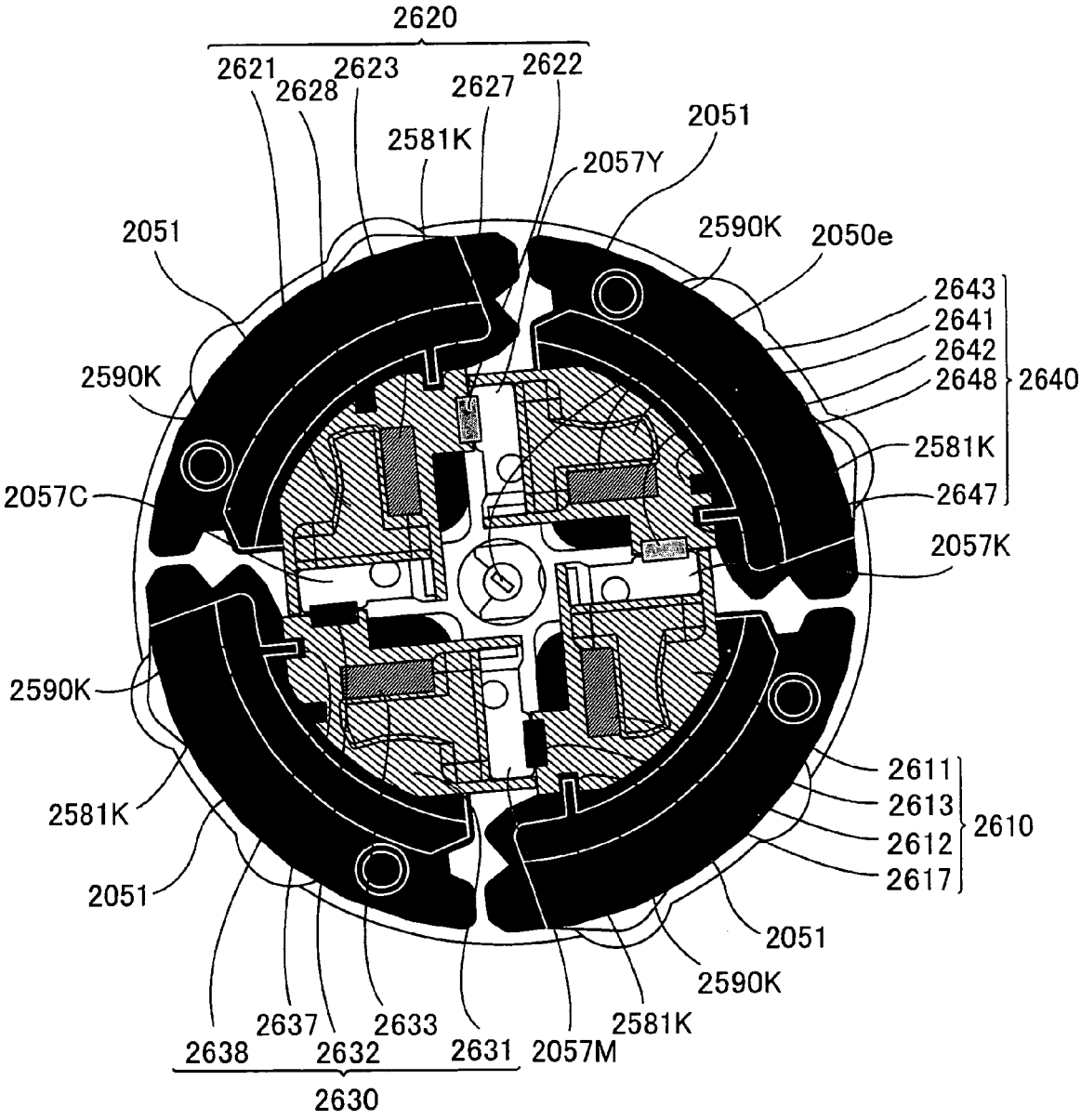
FIG. 21 shows a state in which four black developing units 2051 have been attached to the four attach/detach sections 2050*a*, 2050*b*, 2050*c*, and 2050*d;*

Further, as shown in FIG. 20 and FIG. 21, lid units 2610, 2620, 2630, and 2640 are connected, respectively, to the attach/detach sections 2050*a*, 2050*b*, 2050*c*, and 2050*d*. Each of the lid units 2610, 2620, 2630, and 2640 can be opened and closed; the developing unit is "attached" by being inserted into the corresponding attach/detach section and the lid unit being closed. It should be noted that FIG. 20 shows a state in which the developing units 2051, 2052, 2053, and 2054 have respectively been attached to their attach/detach sections. FIG. 21 shows a state in which four black developing units 2051 have been attached to the four attach/detach sections 2050*a*, 2050*b*, 2050*c*, and 2050*d*.

As shown in FIG. 20, the black developing unit 2051 is attached to the attach/detach section 2050*a* by closure of the lid unit 2610; the cyan developing unit 2052 is attached to the attach/detach section 2050*b* by closure of the lid unit 2620; the magenta developing unit 2053 is attached to the attach/detach section 2050*c* by closure of the lid unit 2630; and the yellow developing unit 2054 is attached to the attach/detach section 2050*d* by closure of the lid unit 2640. On the other hand, as shown in FIG. 21, the black developing units 2051 can be "attached" to the attach/detach sections 2050*b*, 2050*c*, and 2050*d*, because when the black developing units 2051 are inserted into those attach/detach sections 2050*b*, 2050*c*, and 2050*d*, the lid units 2620, 2630, and 2640 can be closed.

It should be noted that the detailed structure of the lid units 2610, 2620, 2630, and 2640 will be given further below.

One of the two frame side plates (i.e., the first side plate 58; see FIG. 24) that support the developing-unit holding unit 2050 and that form the casing of the printer 10 is provided with an attach/detach dedicated opening 37 through which one developing unit can pass and an inner cover (not shown) that openably/closably covers the attach/detach dedicated opening 37. The color of the first side plate 58 is a color that can be easily distinguished from the developing units 2051, 2052, 2053, and 2054, the photoconductor 20, etc., and in the present embodiment, it is light gray. The attach/detach dedicated opening 37 is formed in a position where only a relevant developing unit (here, the yellow developing unit 2054) can be pulled out and detached in the direction of the rotating shaft 2050*e*, as shown in FIG. 18C, when the developing-unit holding unit 2050 is rotated and each developing unit is halted at the developing unit attach/detach position which is set for each developing unit. Further, the attach/detach dedicated opening 37 is formed slightly larger than the outer shape of a developing unit. At the developing unit attach/detach position, not only is it possible to detach the developing unit, but it is also possible to insert a new developing unit through this attach/detach dedicated opening 37 in the direction of the rotating shaft 2050*e* and attach the developing unit to the support frame 2055. While the developing-unit holding unit 2050 is positioned at positions other than the developing unit attach/detach position, the attachment/detachment of that developing unit is restricted by the frame side plates.

It should be noted that a lock mechanism, which is not shown, is provided for certainly positioning and fixing the developing-unit holding unit 2050 at the positions described above.

===(2) Detailed Structure of the Lid Unit===

The detailed structure of the lid unit is described below.

Figure 22:
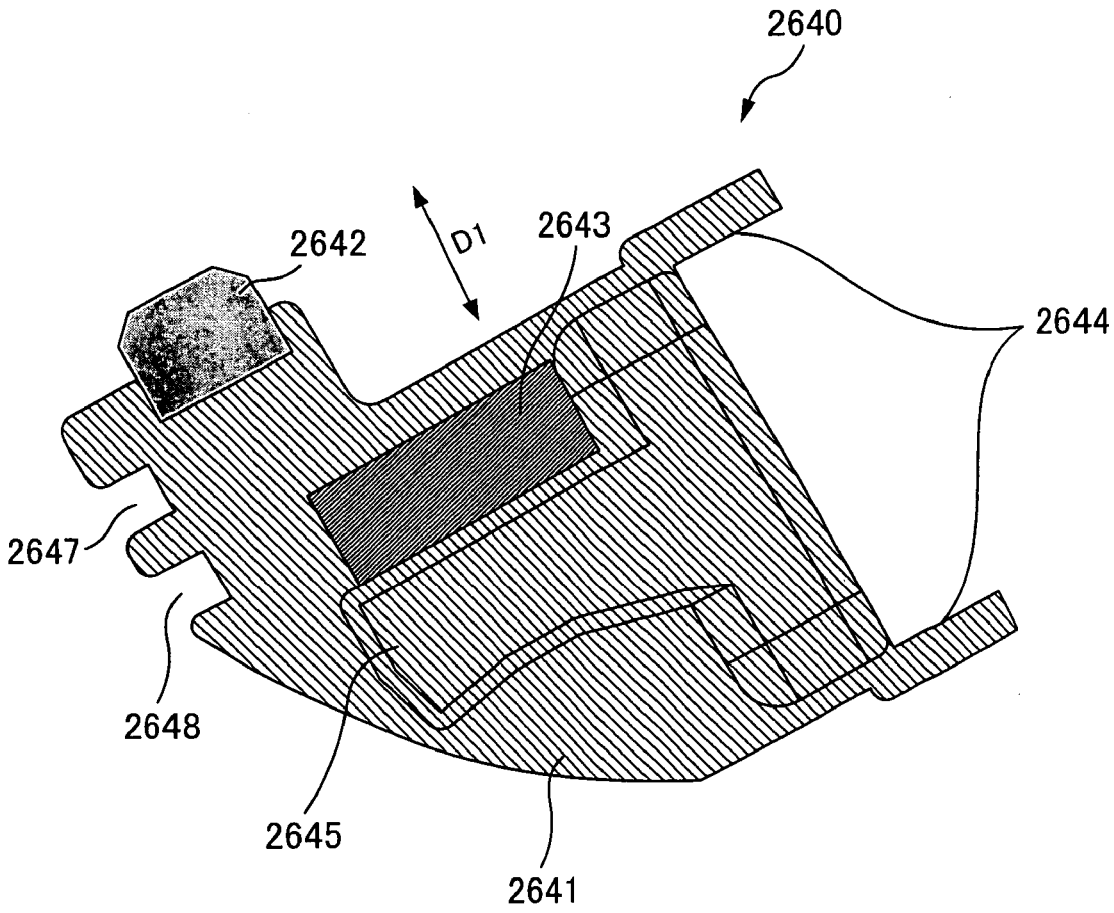
FIG. 22 is front view of a lid unit 2640.
Figure 23:
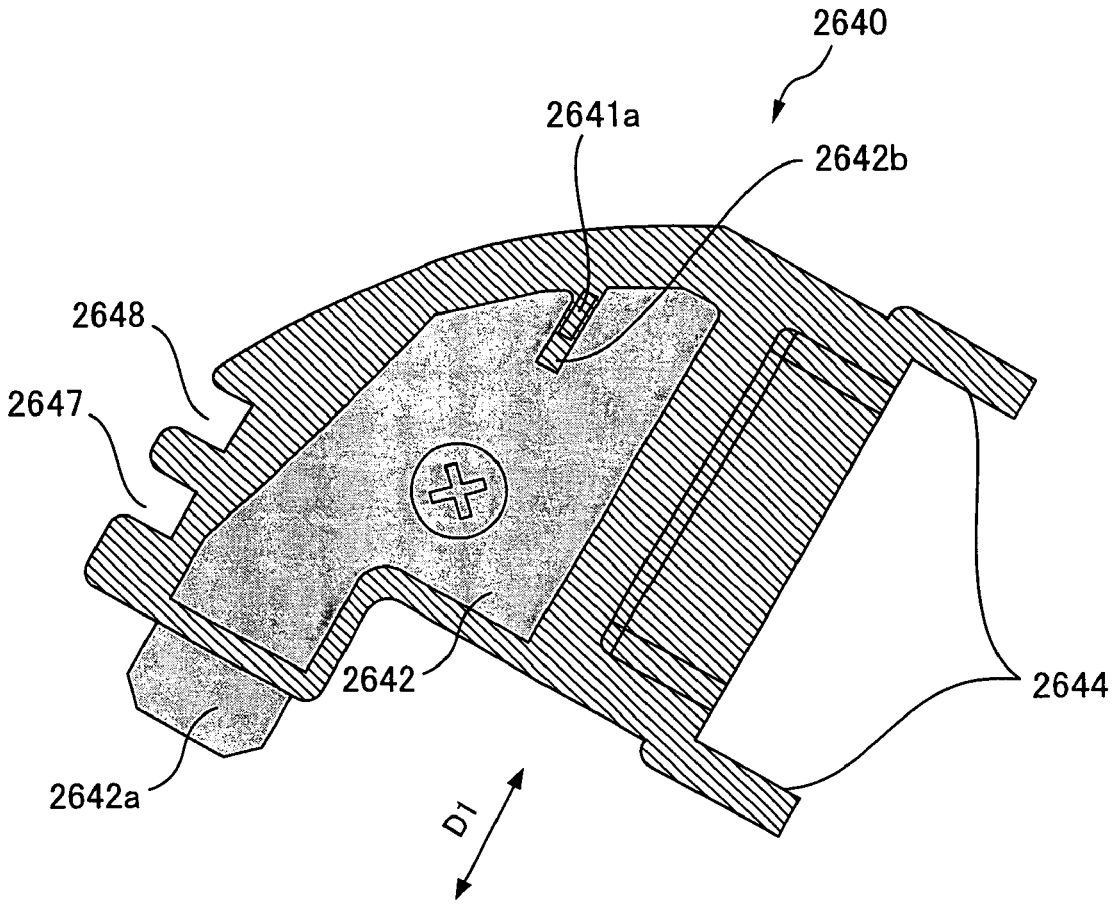
FIG. 23 is a rear view of the lid unit 2640.

First, the structure of the lid unit 2640 connected to the attach/detach section 2050*d* will be described. FIG. 22 is front view of the lid unit 2640. FIG. 23 is a rear view of the lid unit 2640.

The lid unit 2640 covers a portion of the side wall 2580Y of the yellow developing unit 2054 attached to the attach/detach section 2050*d*. More specifically, the lid unit 2640 covers the portions other than the handle 2590Y provided on the side wall 2580Y.

As shown in FIG. 22, the lid unit 2640 has a developing-unit cover 2641 which is an example of a lid member, a latch 2642 which is an example of a holding member, and an operating button 2643 which is an example of an operation member. It should be noted that the latch 2642 is also an example of a "member having the same color as the color of the side wall" described in the claims.

The developing-unit cover 2641 has a connecting section 2644 connected to the attach/detach section 2050*d*, and can be opened and closed taking this connecting section 2644 as an axis. The developing-unit cover 2641 covers the portions other than the handle 2590Y of the side wall 2580Y. The connecting section 2644 is connected to the attach/detach section 2050*d* via a hinge 2057Y. It should be noted that the color of the developing-unit cover 2641 is dark gray, which is different from the color (yellow) of the side wall 2580Y. Therefore, the color (dark gray) of the developing-unit cover 2641 is different from the color (yellow) of the side wall 2580Y at the boundary section between the cover 2641 and the side wall 2580Y. Further, the color of the developing-unit cover 2641 is similar to the color (light gray) of the above-mentioned first side plate 58 (see FIG. 24). As a result, the user etc. can recognize that the developing-unit cover 2641 is a component of the body of the printer 10.

Further, the developing-unit cover 2641 is provided with a first cut-out section 2647 and a second cut-out section 2648. The first cut-out section 2647 is for preventing the second rib 2582Y from interfering with the developing-unit cover 2641. The second cut-out section 2648 is for preventing the first rib 2581Y from interfering with the developing-unit cover 2641. The first cut-out section 2647 is provided in a position corresponding to the second rib 2582Y, and the second cut-out section 2648 is provided in a position corresponding to the first rib 2581Y. In this way, the first cut-out section 2647 and the second cut-out section 2648 prevent the first rib 2581Y and the second rib 2582Y from interfering with the developing-unit cover 2641 when the yellow developing unit 2054 has been inserted into the attach/detach section 2050*d*, thereby allowing the developing-unit cover 2641 to close (see FIG. 20).

It should be noted that when the black developing unit 2051 is inserted into the attach/detach section 2050*d*, the first cut-out section 2647 prevents the first rib 2581Y from interfering with the developing-unit cover 2641, thereby allowing the developing-unit cover 2641 to close (see FIG. 21). On the other hand, if the cyan developing unit 2052 or the magenta developing unit 2053 is inserted into the attach/detach section 2050*d*, the first rib 2581C of the cyan developing unit 2052 or the first rib 2581M of the magenta developing unit 2053 will interfere with the developing-unit cover 2641 and the developing-unit cover 2641 will not close. For this reason, only the black developing unit 2051 and the yellow developing unit 2054 can be attached to the attach/detach section 2050*d*.

Further, the developing-unit cover 2641 is provided with a knob 2645 for the user etc. to grip when opening and closing the developing-unit cover 2641.

The latch 2642 is for keeping the developing-unit cover 2641 in a closed state. As shown in FIG. 23, the latch 2642 is supported on the back side of the developing-unit cover 2641. The color of the latch 2642 is yellow, which is the same as the color (yellow) of the side wall 2580Y.

The latch 2642 is provided with an engagement section 2642*a* and a cut-out section 2642*b*. Engagement of the engagement section 2642*a* to the side wall 2580Y allows the developing-unit cover 2641 to engage with and be fastened to the side wall 2580Y at a fastening position (at the engagement section). The latch 2642 is restricted from moving by means of the cut-out section 2642*b* and a protrusion 2641*a* provided on the developing-unit cover 2641, and the latch 2642 can only slide in the D1 direction.

The operating button 2643 is connected to the latch 2642 and is for operating the latch 2642. The color of the operating button 2643 is blue, which different from the color (yellow) of the side wall 2580Y. It should be noted that the color of the operating button 2643 is not limited to blue, as long as it is a color that can be easily distinguished from the color of the developing-unit cover 2641 (dark gray) and the color of the side plate 58 (light gray).

The operating button 2643 is partially covered by the knob 2645. In this way, the operating button 2643 can only move in the D1 direction. A compression spring (not shown) is provided between the operating button 2643 and the knob 2645. When a force is applied to the operating button 2643, the compression spring is compressed and the operating button 2643 slides. Since the operating button 2643 is connected to the latch 2642, the latch 2642 also slides when the operating button 2643 slides.

Next, the structure of the lid units 2610, 2620, and 2630 will be described. It should be noted that sections that are the same as the lid unit 2640 are omitted from explanation.

As shown in FIG. 20, the lid unit 2610 connected to the attach/detach section 2050*a* has a developing-unit cover 2611, a latch 2612, and an operating button 2613. The lid unit 2620 connected to the attach/detach section 2050*b* has a developing-unit cover 2621, a latch 2622, and an operating button 2623. The lid unit 2630 connected to the attach/detach section 2050*c* has a developing-unit cover 2631, a latch 2632, and an operating button 2633.

The developing-unit cover 2611 is provided with a first cut-out section 2617 provided in a position corresponding to the first rib 2581K. However, the developing-unit cover 2611 is not provided with a second cut-out section. The structure of the developing-unit cover 2611 is the same as that of the developing-unit cover 2641, except that it does not have a second cut-out section.

When the black developing unit 2051 is inserted into the attach/detach section 2050*a*, the first cut-out section 2617 prevents the first rib 2581K from interfering with the developing-unit cover 2611, thereby allowing the lid unit 2610 to close. On the other hand, when the developing unit 2052, 2053, or 2054 is inserted into the attach/detach section 2050*a*, the first rib 2581C, 2581M, or 2581Y will interfere with the lid unit 2610, and the lid unit 2610 will not close. For this reason, only the black developing unit 2051 can be attached to the attach/detach section 2050*a*.

The developing-unit cover 2621 is provided with a first cut-out section 2627 provided in a position corresponding to the second rib 2582C and a second cut-out section 2628 provided in a position corresponding to the first rib 2581C. The structure of the developing-unit cover 2621 is the same as that of the developing-unit cover 2641, except that the position of the second cut-out section 2628 with respect to the developing-unit cover 2621 is different from the position of the second cut-out section 2648 with respect to the developing-unit cover 2641.

When the cyan developing unit 2052 is inserted into the attach/detach section 2050*b*, the first cut-out section 2627 and the second cut-out section 2628 prevent the second rib 2582C and the first rib 2581C from interfering with the developing-unit cover 2621, thereby allowing the lid unit 2620 to close. Further, when the black developing unit 2051 is inserted into the attach/detach section 2050*b*, the first cut-out section 2627 prevents the first rib 2581K from interfering with the developing-unit cover 2621, thereby allowing the lid unit 2620 to close. On the other hand, when the developing unit 2053 or 2054 is inserted into the attach/detach section 2050*b*, the first rib 2581M or 2581Y will interfere with the lid unit 2620, and the lid unit 2620 will not close. For this reason, only the black developing unit 2051 and the cyan developing unit 2052 can be attached to the attach/detach section 2050*b*.

The developing-unit cover 2631 is provided with a first cut-out section 2637 provided in a position corresponding to the second rib 2582M and a second cut-out section 2638 provided in a position corresponding to the first rib 2581M. The structure of the developing-unit cover 2631 is the same as that of the developing-unit cover 2641, except that the position of the second cut-out section 2638 with respect to the developing-unit cover 2631 is different from the position of the second cut-out section 2648 with respect to the developing-unit cover 2641.

When the magenta developing unit 2053 is inserted into the attach/detach section 2050*c*, the first cut-out section 2637 and the second cut-out section 2638 prevent the second rib 2582M and the first rib 2581M from interfering with the developing-unit cover 2631, thereby allowing the lid unit 2630 to close. Further, when the black developing unit 2051 is inserted into the attach/detach section 2050*c*, the first cut-out section 2637 prevents the first rib 2581K from interfering with the developing-unit cover 2631, thereby allowing the lid unit 2630 to close. On the other hand, when the developing unit 2052 or 2054 is inserted into the attach/detach section 2050*c*, the first rib 2581C or 2581Y will interfere with the lid unit 2630, and the lid unit 2630 will not close. For this reason, only the black developing unit 2051 and the magenta developing unit 2053 can be attached to the attach/detach section 2050*c*.

The shapes of latches 2612, 2622, and 2632 are the same as the shape of the latch 2642, but their colors are different from the color (yellow) of the latch 2642. The latches 2612, 2622, and 2632 are black, cyan, and magenta, respectively. The operating buttons 2613, 2623, and 2633 have the same structure as the operating button 2643.

===(2) Detaching the Developing Unit===

Figure 24:
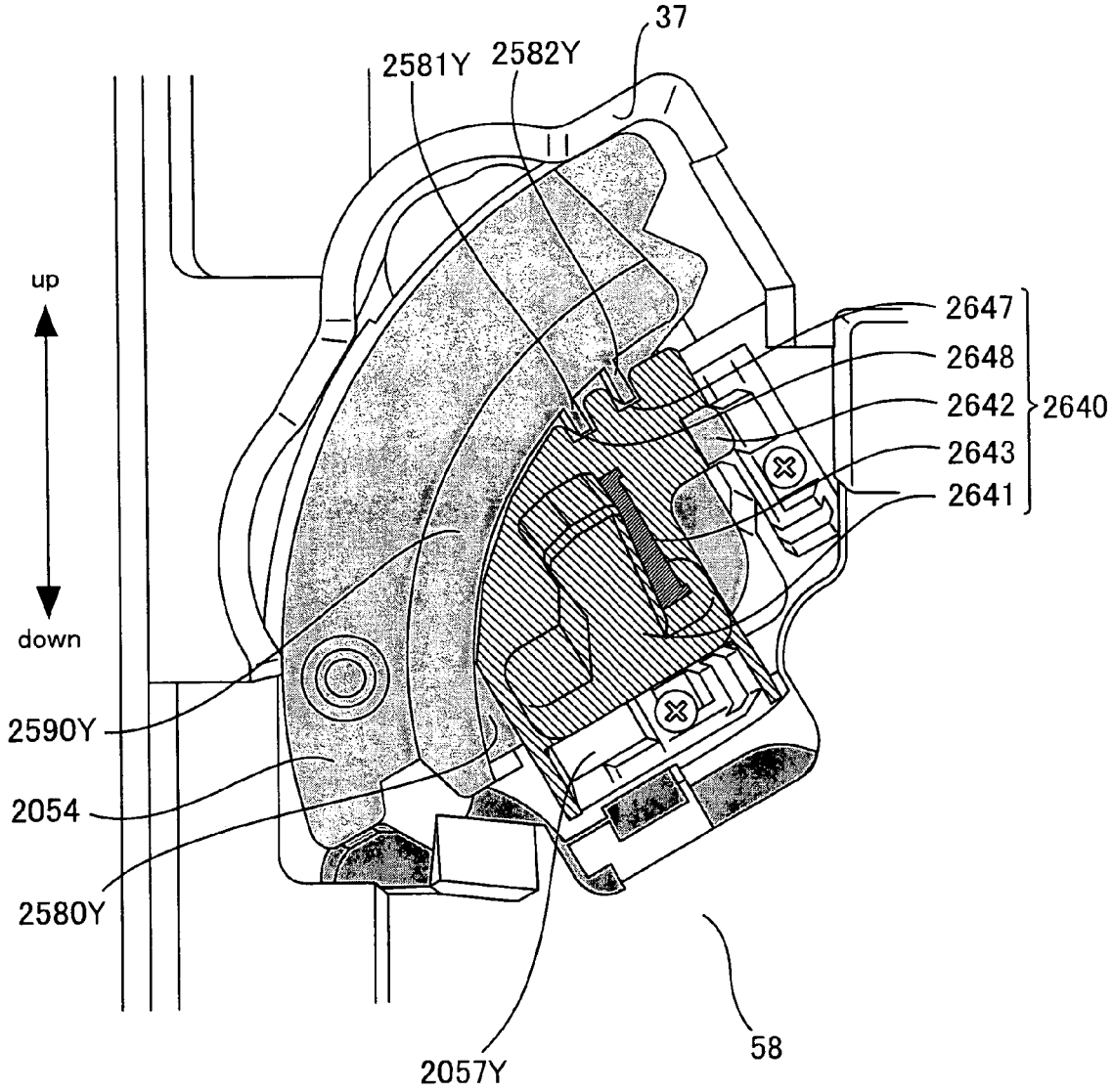
FIG. 24 shows a state in which the lid unit 2640 is closed.
Figure 25:
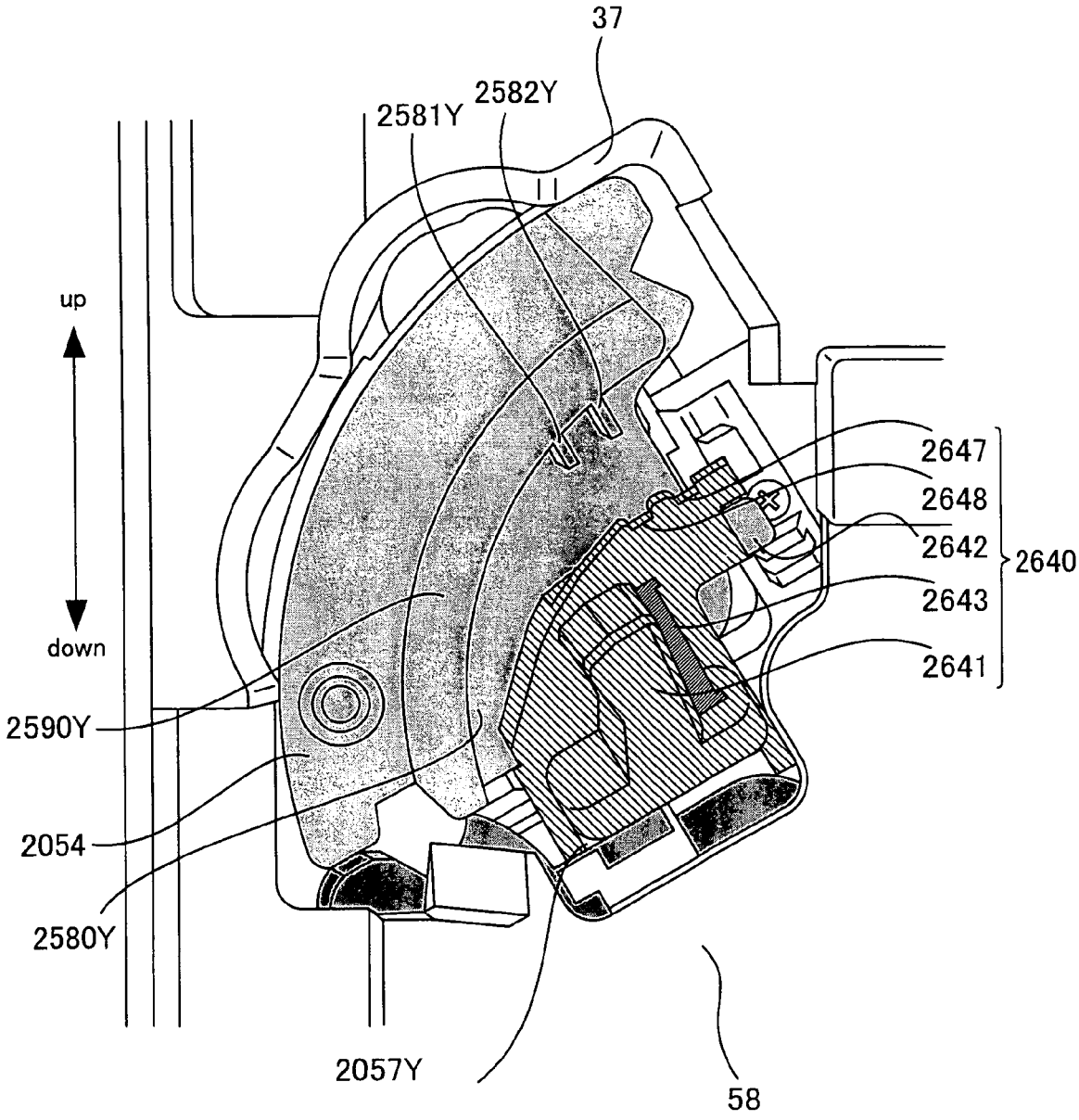
FIG. 25 shows a state where the lid unit 2640 is being revolved.
Figure 26:
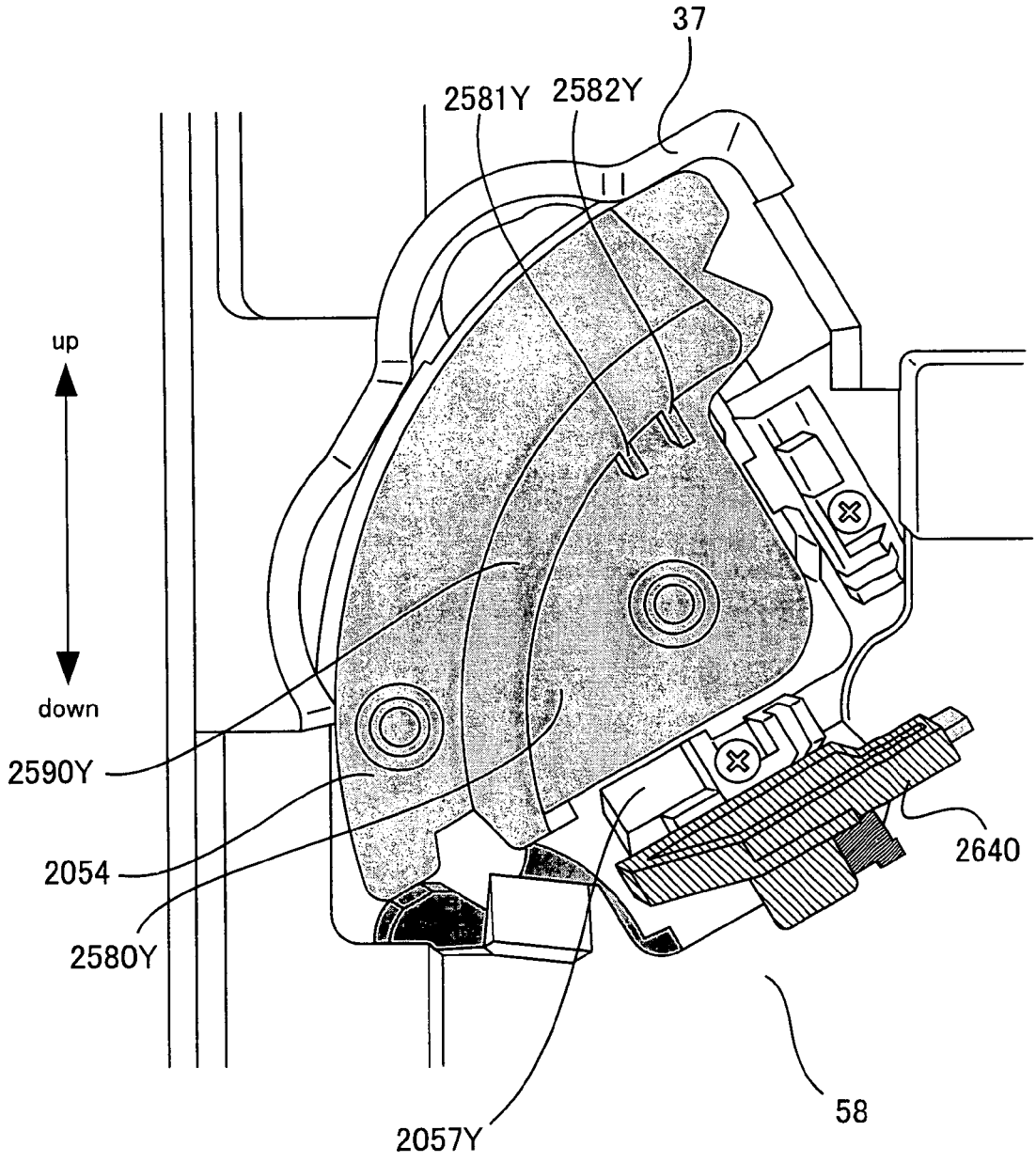
FIG. 26 shows a state in which the lid unit 2640 is opened.

Next, the procedure of detaching the developing unit attached to the attach/detach section will be described with reference to FIG. 24 through FIG. 26. FIG. 24 shows a state in which the lid unit 2640 is closed. FIG. 25 shows a state where the lid unit 2640 is being revolved. FIG. 26 shows a state in which the lid unit 2640 is opened.

Detachment of the developing units 2051, 2052, 2053, and 2054 is carried out in the same way, and so below, only the procedure of detaching the yellow developing unit 2054 attached to the attach/detach section 2050*d* is described.

As shown in FIG. 24, detachment of the yellow developing unit 2054 is started from a state where the developing-unit holding unit 2050 is positioned at the attach/detach position of the yellow developing unit 2054. The user etc. can see the color (yellow) of the side wall 2580Y of the yellow developing unit 2054 through the attach/detach dedicated opening 37, and therefore can determine whether the yellow developing unit 2054 is a developing unit that is appropriate for detachment.

First, the user etc. slides the operating button 2643 by applying a force to the operating button 2643 to compress the compression spring. The latch 2642 also slides as the operating button 2643 is slid. When the latch 2642 is slid for a predetermined amount or more, the engagement between the latch 2642 and the side wall 2580Y of the yellow developing unit 2054 is released. In this way, it becomes possible to turn the developing-unit cover 2641.

Next, the user etc. holds the knob 2645 and turns the developing-unit cover 2641 toward him/her. As shown in FIG. 25, the developing-unit cover 2641 starts to open, taking the connecting section 2644 as an axis. The user etc. opens the developing-unit cover 2641 up to a position where the yellow developing unit 2054 can be detached, as shown in FIG. 26.

Next, the user etc. holds the handle 2590Y and pulls the yellow developing unit 2054 out toward him/her. By pulling the yellow developing unit 2054 out through the attach/detach dedicated opening 37, the user etc. can detach the yellow developing unit 2054 from the attach/detach section 2050*d*.

===(2) Attaching the Developing Unit===

The procedure of attaching the developing units to the attach/detach sections is described here.

Attachment of the developing units 2051, 2052, 2053, and 2054 is carried out in the same way, and so below, only the procedure of attaching the yellow developing unit 2054 to the attach/detach section 2050*d* is described.

Attachment of the yellow developing unit 2054 to the attach/detach section 2050*d* is started from the state where the developing-unit holding unit 2050 is positioned at the attach/detach position of the yellow developing unit 2054. The explanation below is given on the assumption that no developing unit is currently attached to the attach/detach section 2050*d*.

First, the user etc. opens the developing-unit cover 2641. Then, the user etc. compares the color of the latch 2642 and the color of the side wall 2580Y, and determines whether the yellow developing unit 2054 is a developing unit that can be attached to the attach/detach section 2050*d*. Here, since both the color of the latch 2642 and the color of the side wall 2580Y are yellow, the user etc. determines that the yellow developing unit 2054 can be attached to the attach/detach section 2050*d*. It should be noted that the black developing unit 2051 is attachable to all four attach/detach sections 2050*a*, 2050*b*, 2050*c*, and 2050*d*, and so such a determination is not necessary.

Next, the user etc. inserts the yellow developing unit 2054 into the attach/detach section 2050*d*. The user etc. holds the handle 2590Y for example, and inserts the yellow developing unit 2054 into the attach/detach section 2050*d* through the attach/detach dedicated opening 37.

Next, the user etc. turns the developing-unit cover 2641 in order to close it. Since the first cut-out section 2647 is provided in a position corresponding to the second rib 2582Y and the second cut-out section 2648 is provided in a position corresponding to the first rib 2581Y, neither the first rib 2581Y nor the second rib 2582Y will interfere with the developing-unit cover 2641 when it is being turned. When the developing-unit cover 2641 is turned for a predetermined amount, without the first rib 2581Y nor the second rib 2582Y interfering therewith, the latch 2642 engages with the side wall 2580Y. Engagement of the latch 2642 to the side wall 2580Y results in the developing-unit cover 2641 engaging with and being fastened to the side wall 2580Y and the developing-unit cover 2641 being close.

Figure 27:
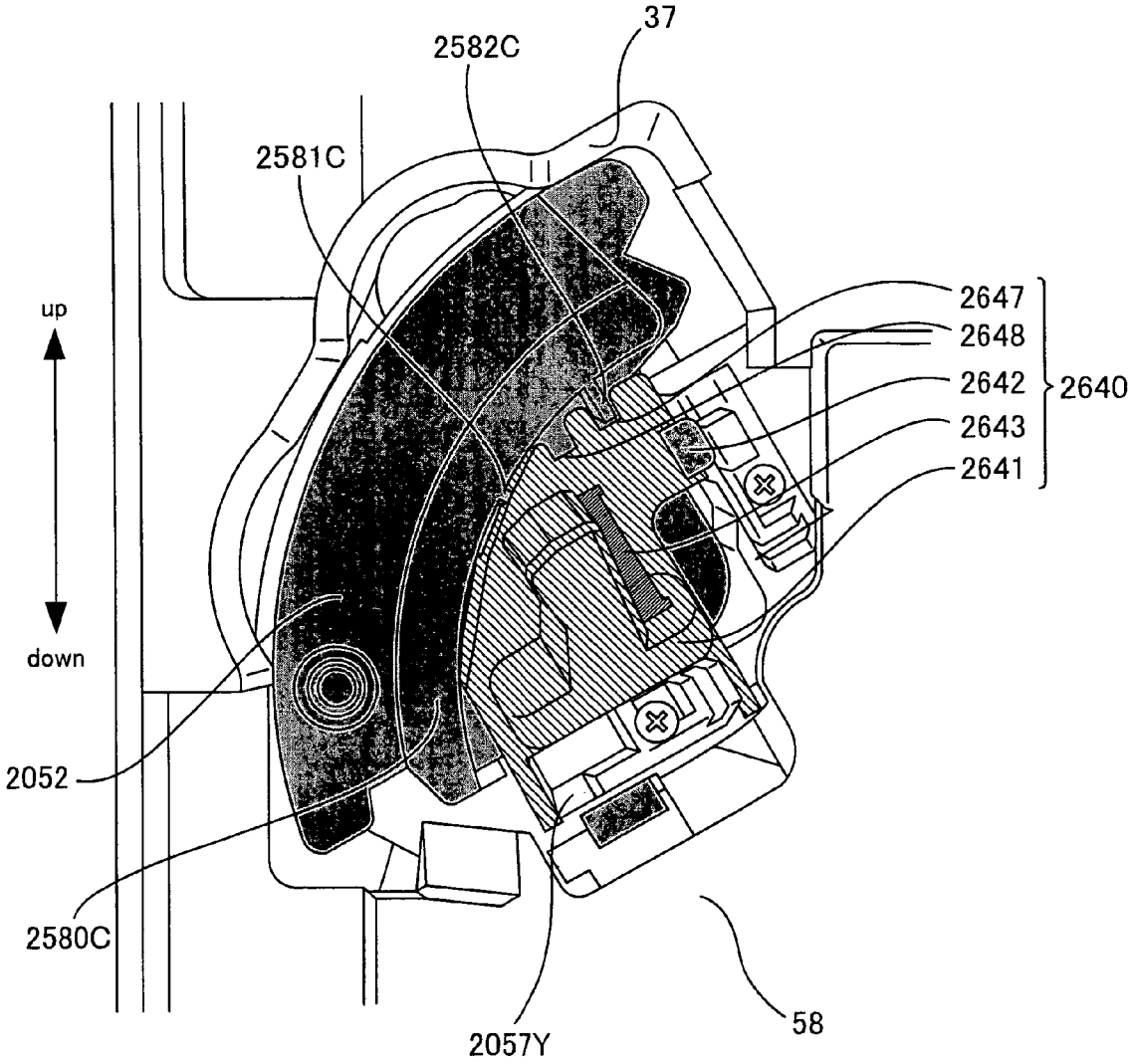
FIG. 27 shows a state where the developing-unit cover 2641 does not close when the cyan developing unit 2052 is inserted into the attach/detach section 2050*d;*

On the other hand, the developing-unit cover 2641 will not close when the cyan developing unit 2052 or the magenta developing unit 2053 is inserted into the attach/detach section 2050*d*. For example, as shown in FIG. 27, if the cyan developing unit 2052 is inserted into the attach/detach section 2050*d*, the developing-unit cover 2641 will not close because the position of the second cut-out section 2648 is not in a position corresponding to the first rib 2581C and thus the first rib 2581C interferes with the developing-unit cover 2641. It should be noted that FIG. 27 shows a state where the developing-unit cover 2641 does not close when the cyan developing unit 2052 is inserted into the attach/detach section 2050*d*.

===(2) Function of the Lid Unit===

As described above, the color of each of the lid units 2610, 2620, 2630, and 2640 provided on the printer 10 (an image forming apparatus) is different from the color of each of the developing units 2051, 2052, 2053, and 2054 (developer containers) at a boundary section between the lid unit and the developing unit. With this structure, it becomes possible to achieve a printer 10 that allows a developing unit to be properly detached from an attach/detach section. This is described in detail below.

In a printer 10 having a photoconductor 20 (an image bearing body), attach/detach sections 2050*a*, 2050*b*, 2050*c*, and 2050*d*, and lid units 2610, 2620, 2630, and 2640, there are cases in which the developing units 2051, 2052, 2053, and 2054 are colored to have the same color as that of the toner contained in each of them, from the viewpoint of letting a user etc. distinguish the color of the toner contained in the developing units 2051, 2052, 2053, and 2054. For example, there are cases in which the side wall 2580Y of a developing unit 2054 containing yellow toner is colored to have the same color (yellow) as the toner color. Further, there are cases in which the front face of each of the lid units 2610, 2620, 2630, and 2640 is colored from the viewpoint of allowing a proper developing unit to be attached to the attach/detach sections 2050*a*, 2050*b*, 2050*c*, and 2050*d*.

In such cases, if the color of the lid unit 2640 (2610, 2620, 2630) is the same as that of the developing unit 2054 (2051, 2052, 2053) at a boundary section between the lid unit and the developing unit, then there is a possibility that the user etc. may incorrectly recognize the lid unit as a part of the developing unit and may try to detach the developing unit in a state where the lid unit is still covering a portion of the developing unit. This may cause damages in the lid unit when trying to detach the developing unit from the attach/detach section.

This is explained in more detail. Here, it is assumed that the color of the developing-unit cover 2641 of the lid unit 2640 is yellow and is the same as the color of the side wall 2580Y of the developing unit 2054 (yellow). In this case, the color of the developing-unit cover 2641 is the same as that of the side wall 2580Y at the boundary section between the sidewall 2580Y and the cover 2641. Since the developing-unit cover 2641 is covering a portion of the side wall 2580Y, that is, the portions other than the handle 2590Y, if the color of the developing-unit cover 2641 and the color of the side wall 2580Y are the same, then the user etc. may incorrectly recognize the developing-unit cover 2641 as a part of the side wall 2580Y, and may try to detach the developing unit 2054 in a state where the developing-unit cover 2641 is still closed. As described above, in a state where the developing-unit cover 2641 is closed, the engagement of the latch 2642 with respect to the developing unit 2054 is not yet released. Therefore, if the developing unit 2054 is detached without releasing the engagement of the latch 2642, then the lid unit 2640, that is, either one of the developing-unit cover 2641, the latch 2642, and the operating button 2643, may break.

In view of the above, in the present embodiment, the color of the lid unit 2640 (2610, 2620, 2630) is made to be different from the color of the developing unit 2054 (2051, 2052, 2053) at a boundary section between the lid unit and the developing unit, as shown in FIG. 20. In this way, the user etc. can distinguish the developing unit and the lid unit.

This is described in more detail using the yellow developing unit 2054 and the lid unit 2640. As described above, the developing-unit cover 2641 covers a portion of the side wall 2580Y of the yellow developing unit 2054, and the boundary section is a part of the developing-unit cover 2641. In this way, the color of the developing-unit cover 2641 (dark gray) is different from the color of the side wall 2580Y (yellow) at a boundary section with respect to the side wall 2580Y, and the user etc. can distinguish the developing-unit cover 2641 from the side wall 2580Y. Therefore, the user etc. will open the developing-unit cover 2641, that is, release the engagement of the latch 2642 with respect to the side wall 2580Y, and then detach the developing unit 2054. As a result, it is possible to suitably prevent the yellow developing unit 2054 from being detached in a state where a portion thereof is still covered by the developing-unit cover 2641, and therefore, it is possible to prevent damages of the lid unit, that is, the developing-unit cover 2641, the latch 2642, and the operating button 2643, when detaching the yellow developing unit 2054 from the attach/detach section 2050*d*.

As described above, by providing the lid units 2610, 2620, 2630, and 2640 according to the present embodiment, the user etc. can distinguish the lid unit and the developing unit. Therefore, it is possible to prevent the developing unit from being detached from an attach/detach section in a state where it is still covered by the lid unit, and thus, it becomes possible to achieve a printer 10 that allows a developing unit to be properly detached from an attach/detach section.

===(2) Other Considerations===

In the foregoing embodiment, as shown in FIG. 20, the lid unit 2640 (2610, 2620, 2630) covered a portion of the side wall 2580Y (2580K, 2580M, 2580C) of the developing unit 2054 (2051, 2052, 2053) attached to the attach/detach section 2050*d* (2050*a*, 2050*b*, 2050*c*), and the color of the lid unit was different from the color of the side wall (yellow for the side wall 2580Y) at a boundary section between the lid unit and the side wall. This, however, is not a limitation. For example, the lid unit 2640 (2610, 2620, 2630) may cover a portion other than the side wall 2580Y (2580K, 2580M, 2580C).

Further, in the foregoing embodiment, as shown in FIG. 16, the side wall 2580Y (2580K, 2580M, 2580C) was provided with a handle 2590Y (2590K, 2590M, 2590C); and the portion of the side wall covered by the lid unit 2640(2610, 2620, 2630) was a portion other than the handle. This, however, is not a limitation. For example, the lid unit 2640 (2610, 2620, 2630) may cover the handle 2590Y (2590K, 2590M, 2590C).

If the handle 2590Y is covered by the lid unit 2640, the user etc. will think that it is necessary to open the lid unit 2640 in order to detach the developing unit 2054. On the other hand, if the handle 2590Y is not covered by the lid unit 2640, then the user etc. may incorrectly recognize that the developing unit 2054 can be detached even when the lid unit 2640 is closed. In such cases, the possibility of the lid unit 2640 being damaged becomes high. Therefore, the effect of the present embodiment, that is, the effect that it is possible to achieve a printer 10 that allows a developing unit to be properly detached from an attach/detach section, can be attained more advantageously in cases where the portion of the side wall 2580Y covered by the lid unit 2640 is a portion other than the handle 2590Y. The foregoing embodiment is therefore more preferable.

Further, in the foregoing embodiment, as shown in FIG. 22, the lid unit 2640 (2610, 2620, 2630) had a developing-unit cover 2641 (2611, 2621, 2631) that covers the portion of the side wall 2580Y (2580K, 2580M, 2580C), the developing-unit cover having a connecting section 2644 (2614, 2624, 2634) that is connected to the attach/detach section 2050*d* (2050*a*, 2050*b*, 2050*c*) and being openable/closable taking the connecting section as an axis. Further, the boundary section was a portion of the developing-unit cover 2641 (2611, 2621, 2631); and the color (dark gray) of the developing-unit cover was different from the color (yellow for the side wall 2580Y) of the side wall 2580Y (2580K, 2580M, 2580C). This, however, is not a limitation. For example, the color of the boundary section of the developing-unit cover 2641 (2611, 2621, 2631) may be dark gray, and the color of the portions other than the boundary section may be the same color as the side wall 2580Y (2580K, 2580M, 2580C).

However, when the color of the entire developing-unit cover 2641 (dark gray) is different from the color of the side wall 2580Y (yellow), it is easy to distinguish the developing-unit cover 2641 from the side wall 2580Y, compared to when the color of only the boundary section of the developing-unit cover 2641 is different from the color of the side wall 2580Y. Therefore, in cases where the color of the developing-unit cover 2641 is different from the color of the side wall 2580Y, it becomes possible to prevent the developing unit 2054 from being detached in a state where a portion of the side wall 2580Y is still covered by the lid unit 2640.

Further, in the foregoing embodiment, as described in FIG. 23, a member (latch 2642 (2612, 2622, 2632)) having the same color as the color of the side wall 2580Y (2580K, 2580M, 2580C) was supported on the back side of the developing-unit cover 2641 (2611, 2621, 2631). This, however, is not a limitation. For example, the color of the latch 2642 (2612, 2622, 2632) may be different from the color of the side wall 2580Y (2580K, 2580M, 2580C).

However, when a latch 2642 having the same color as the color (yellow) of the side wall 2580Y is supported on the back side of the developing-unit cover 2641, the user etc. can see the color (yellow) of the latch 2642 when the developing-unit cover 2641 is opened. Therefore, it becomes possible to let the user etc. know the appropriate yellow developing unit 2054 that should be attached to the attach/detach section 2050*d*. The foregoing embodiment is therefore more preferable.

Further, in the foregoing embodiment, as shown in FIG. 22 and FIG. 23, the lid unit 2640 (2610, 2620, 2630) had the latch 2642 (2612, 2622, 2632) (holding member) for holding the developing-unit cover 2641 (2611, 2621, 2631) in a closed state; and the latch was the member having the same color as the color of the side wall 2580Y (2580K, 2580M, 2580C). This, however, is not a limitation. For example, the member having the same color as the color of the side wall 2580Y (2580K, 2580M, 2580C) may be a sticker member pasted to the back side of the developing-unit cover 2641 (2611, 2621, 2631).

However, when the latch 2642 is the member having the same color as the color (yellow) of the side wall 2580Y, it becomes possible to let the user etc. know that the yellow developing unit 2054 should be attached to the attach/detach section 2050*d* by the color (yellow) of the latch 2642 without providing a sticker member, and therefore, it becomes possible to achieve a printer 10 that is convenient for the user etc. The foregoing embodiment is therefore more preferable.

Further, in the foregoing embodiment, as shown in FIG. 22 and FIG. 23, the lid unit 2640 (2610, 2620, 2630) has an operating button 2643 (2613, 2623, 2633) (operation member) that is connected to the latch 2642 (2612, 2622, 2632) for operating the holding member. This, however, is not a limitation. For example, the lid unit 2640 (2610, 2620, 2630) does not have to be provided with an operating button 2643 (2613, 2623, 2633).

However, when an operating button 2643 is provided, the operating button 2643 needs to be operated to release the engagement of the latch 2642 to the side wall 2580Y in order to detach the yellow developing unit 2054 from the attach/detach section 2050*d*. If the user etc. tries to detach the yellow developing unit 2054 in a state where the side wall 2580Y is still covered by the lid unit 2640, then the latch 2642 and/or the operating button 2643 may break. Therefore, the effect of the present embodiment, that is, the effect that it is possible to achieve a printer 10 that allows a developing unit to be properly detached from an attach/detach section, can be attained more advantageously in cases where an operating button 2643 is provided. The foregoing embodiment is therefore more preferable.

Further, in the foregoing embodiment, as shown in FIG. 20, the color of the operating button 2643 (2613, 2623, 2633) was different from the color of the side wall 2580Y (2580K, 2580M, 2580C). This, however, is not a limitation. For example, the color of the operating button 2643 (2613, 2623, 2633) may be the same as the color of the side wall 2580Y (2580K, 2580M, 2580C).

However, when the color (blue) of the operating button 2643 is different from the color (yellow) of the side wall 2580Y, the user etc. can distinguish the operating button 2643 from the side wall 2580Y. Therefore, it becomes possible to prevent, more effectively, the developing unit 2054 from being detached in a state where a portion of the side wall 2580Y is still covered by the lid unit 2640. The foregoing embodiment is therefore more preferable.

Further, in the foregoing embodiment, as shown in FIG. 20, there were four (a plurality of) attach/detach sections. This, however, is not a limitation. For example, the number of attach/detach sections may be one.

However, when the number of attach/detach sections is four (attach/detach sections 2050*a*, 2050*b*, 2050*c*, and 2050*d*), the frequency at which the developing unit 2054 (2051, 2052, 2053) is detached in a state where it is covered by the lid unit 2640 (2610, 2620, 2630) increases compared to when there is only one attach/detach section, and therefore, the possibility that the lid unit etc. will break also becomes high. Therefore, the effect of the present embodiment, that is, the effect that it is possible to achieve a printer 10 that allows a developing unit to be properly detached from an attach/detach section, can be attained more advantageously in cases where there are a plurality of attach/detach sections. The foregoing embodiment is therefore more preferable.

Further, in the foregoing embodiment, the developer containers were the developing units 2051, 2052, 2053, and 2054 (developing devices) each provided with a developing roller 2510 (developer bearing body) for bearing toner that is used for developing the latent image borne on the photoconductor 20, as shown in FIG. 16. This, however, is not a limitation. For example, the developer container does not have to be provided with a developing roller 2510, and may be a toner cartridge containing toner to be supplied to the developing units 2051, 2052, 2053, and 2054.

The developing unit 2051, 2052, 2053, 2054 is detached from the attach/detach section when the amount of contained toner becomes small and/or when the developing roller 2510 has worn out, for example. Therefore, the frequency of detaching the developer container is higher for when the developer container is a developing unit 2051, 2052, 2053, 2054, compared to cases where the developer container is a toner cartridge, and thus the possibility that the lid unit 2640 (2610, 2620, 2630) may break also increases. Therefore, in cases where the developer container is a developing unit, the effect of the present embodiment, that is, the effect that it is possible to achieve a printer 10 that allows a developing unit to be properly detached from an attach/detach section, can be attained more advantageously. The foregoing embodiment is therefore more preferable.

Third Embodiment

===(3) Overview of the Developing Unit===

Figure 28:
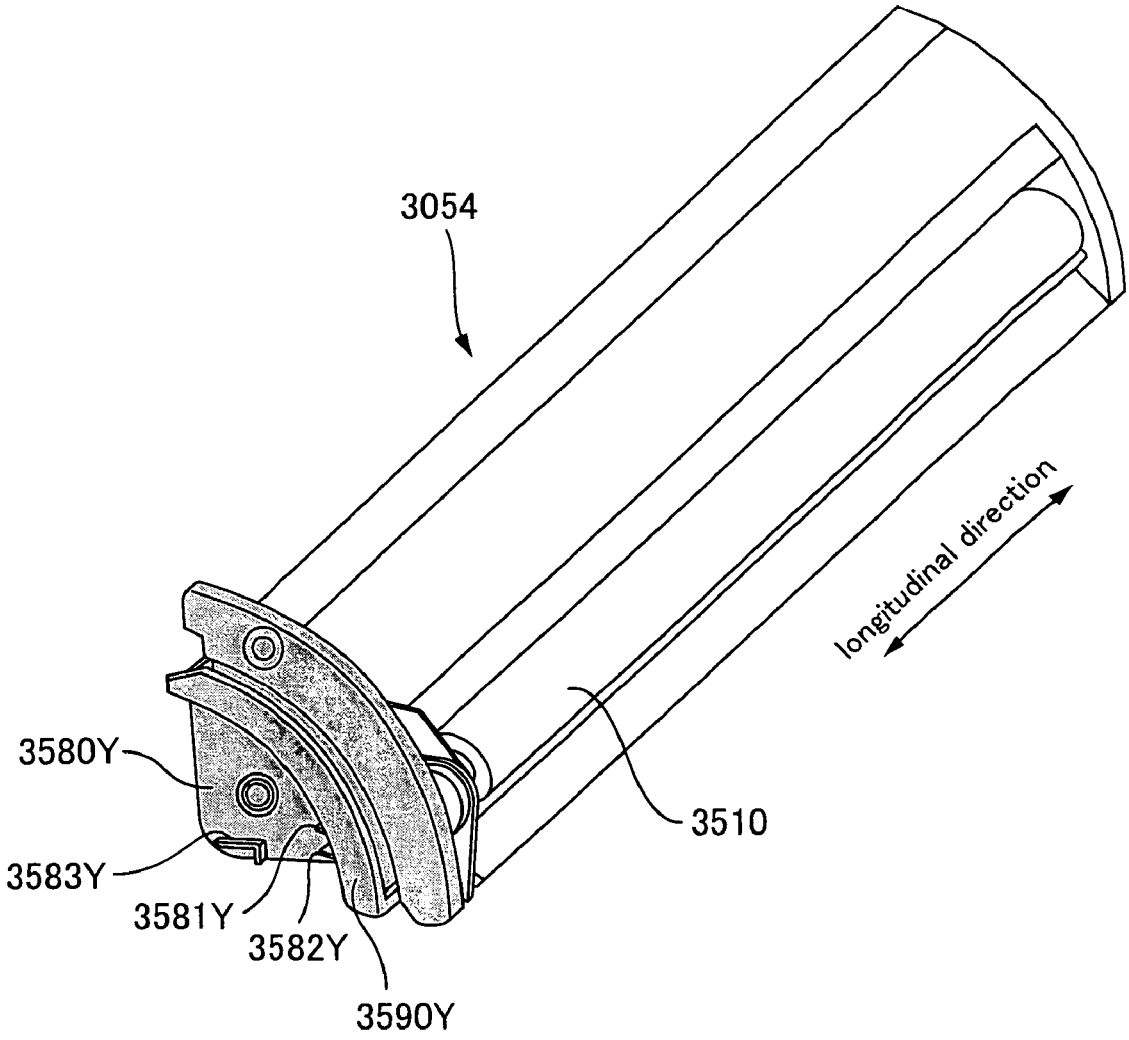
FIG. 28 is a conceptual diagram of a developing unit of a third embodiment.
Figure 29:
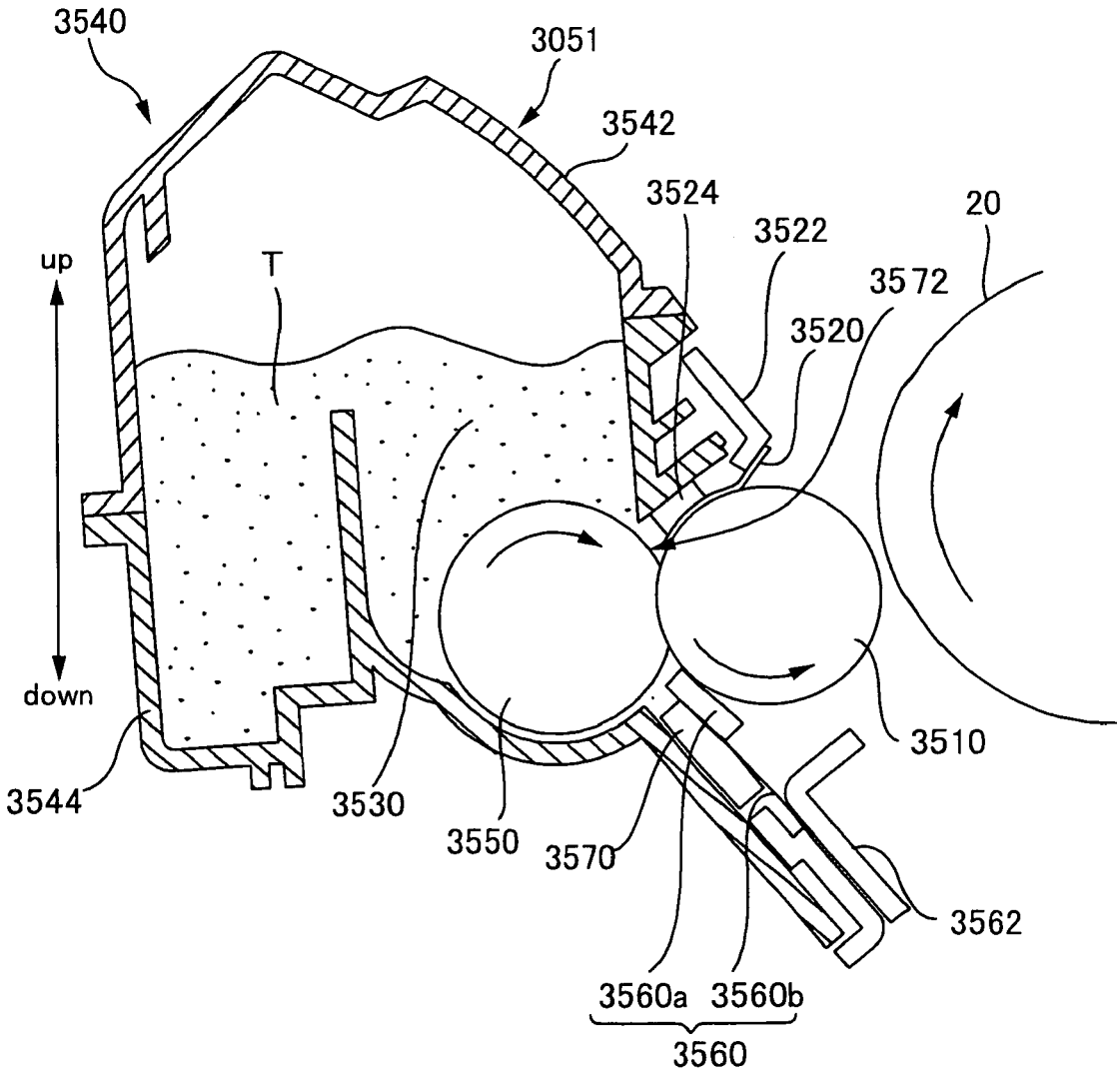
FIG. 29 is a section view showing main structural components of the developing unit.

Next, using FIG. 28 and FIG. 29, an example of a configuration of the developing units will be described. FIG. 28 is a conceptual diagram of a developing unit. FIG. 29 is a section view showing main structural components of the developing unit. Note that the section view shown in FIG. 29 is a cross section of the developing unit taken along a plane perpendicular to the longitudinal direction shown in FIG. 28. Further, in FIG. 29, the arrow indicates the vertical direction as in FIG. 1, and, for example, the yellow developing unit 3054 is shown to be in a state in which it is positioned at the developing position opposing the photoconductor 20.

To the developing-unit holding unit 3050, it is possible to attach: the black developing unit 3051 containing black (K) toner; the magenta developing unit 3053 containing magenta (M) toner; the cyan developing unit 3052 containing cyan (C) toner; and the yellow developing unit 3054 containing yellow (Y) toner. Here, explanation will be made only on the yellow developing unit 3054.

The yellow developing unit 3054 has, for example, a developing roller 3510 serving as a developer bearing body, a sealing member 3520, a toner containing section 3530, a housing 3540, a toner supplying roller 3550, and a restriction blade 3560.

The developing roller 3510 bears toner T and delivers it to the developing position opposing the photoconductor 20. Further, as shown in FIG. 28, the developing roller 3510 is supported at both ends in its longitudinal direction and is rotatable about its central axis. As shown in FIG. 29, the developing roller 3510 rotates in the opposite direction (counterclockwise in FIG. 29) to the rotating direction of the photoconductor 20 (clockwise in FIG. 29). Further, as shown in FIG. 29, the developing roller 3510 of the yellow developing unit 3054 and the photoconductor 20 oppose against each other with a spacing therebetween. That is, the yellow developing unit 3054 develops the latent image formed on the photoconductor 20 in a non-contacting state. Note that an alternating field is generated between the developing roller 3510 and the photoconductor 20 upon development of the latent image formed on the photoconductor 20.

The sealing member 3520 prevents the toner T in the yellow developing unit 3054 from spilling out therefrom, and also collects the toner T, which is on the developing roller 3510 that has passed the developing position, into the developing unit without scraping it off. The sealing member 3520 is a seal made of, for example, polyethylene film. The sealing member 3520 is pressed against the developing roller 3510 by the elastic force of a seal-urging member 3524 that is made of, for example, Moltoprene and that is provided on the side opposite from the side of the developing roller 3510.

The housing 3540 is formed by welding together a plurality of integrally-molded housing sections. As shown in FIG. 29, the housing 3540 has an opening 3572 opening toward the outside of the housing 3540. The above-mentioned developing roller 3510 is arranged from the outside of the housing 3540 with its peripheral surface facing the opening 3572 in such a state that a part of the roller 3510 is exposed to the outside. The restriction blade 3560, which is described in detail below, is also arranged from the outside of the housing 3540 facing the opening 3572.

Further, the housing 3540 forms a toner containing section 3530 that is capable of containing toner T.

The toner supplying roller 3550 is provided in the toner containing section 3530 described above and supplies the toner T contained in the toner containing section 3530 to the developing roller 3510. The toner supplying roller 3550 is made of, for example, polyurethane foam, and is made to abut against the developing roller 3510 in an elastically deformed state. The toner supplying roller 3550 is arranged at a lower section of the toner containing section 3530. The toner T contained in the toner containing section 3530 is supplied to the developing roller 3510 by the toner supplying roller 3550 at the lower section of the toner containing section 3530. The toner supplying roller 3550 rotates about its central axis in the opposite direction (clockwise in FIG. 29) to the rotating direction of the developing roller 3510 (counterclockwise in FIG. 29). Note that the toner supplying roller 3550 has the function of supplying the toner T contained in the toner containing section 3530 to the developing roller 3510 as well as the function of stripping off, from the developing roller 3510, the toner T remaining on the developing roller 3510 after development.

The restriction blade 3560 restricts the thickness of the layer of the toner T borne by the developing roller 3510 and also gives charge to the toner T borne by the developing roller 3510. This restriction blade 3560 has a rubber section **3560*a* and a rubber-supporting section 3560*b*. The rubber section 3560*a* is made of, for example, silicone rubber or urethane rubber. The rubber-supporting section 3560*b* is a thin plate that is made of, for example, phosphor bronze or stainless steel, and that has a spring-like characteristic. The rubber section 3560*a* is supported by the rubber-supporting section 3560*b*. The rubber-supporting section 3560*b* is attached to the housing 3540 via a pair of blade-supporting metal plates 3562 in a state that one end of the rubber-supporting section 3560*b* is pinched between and supported by the blade-supporting metal plates 3562. Further, a blade-backing member 3570 made of, for example, Moltoprene is provided on one side of the restriction blade 3560 opposite from the side of the developing roller 3510**.

The rubber section **3560*a* is pressed against the developing roller 3510 by the elastic force caused by the flexure of the rubber-supporting section 3560*b*. Further, the blade-backing member 3570 prevents the toner T from entering in between the rubber-supporting section 3560*b* and the housing 3540, stabilizes the elastic force caused by the flexure of the rubber-supporting section 3560*b*, and also, applies force to the rubber section 3560*a* from the back thereof towards the developing roller 3510 to press the rubber section 3560*a* against the developing roller 3510. In this way, the blade-backing member 3570 makes the rubber section 3560*a* abut against the developing roller 3510** evenly.

In the yellow developing unit 3054 structured as above, the toner supplying roller 3550 supplies the toner T contained in the toner containing section 3530 to the developing roller 3510. With the rotation of the developing roller 3510, the toner T, which has been supplied to the developing roller 3510, reaches the abutting position of the restriction blade 3560; then, as the toner T passes the abutting position, the toner is electrically charged and its layer thickness is restricted. With further rotation of the developing roller 3510, the toner T on the developing roller 3510, whose layer thickness has been restricted, reaches the developing position opposing the photoconductor 20; then, under the alternating field, the toner T is used at the developing position for developing the latent image formed on the photoconductor 20. With further rotation of the developing roller 3510, the toner T on the developing roller 3510, which has passed the developing position, passes the sealing member 3520 and is collected into the developing unit by the sealing member 3520 without being scraped off.

Further, as shown in FIG. 28, a handle 3590Y, and a first rib 3581Y, a second rib 3582Y, and a third rib 3583Y, which serve as shaped information sections, are provided on one of the wall sections (hereinafter referred to as "side wall") 3580Y on the ends in the longitudinal direction of the yellow developing unit 3054.

The handle 3590Y is for the user etc. to hold the yellow developing unit 3054 when attaching the yellow developing unit 3054 to the attach/detach section 3050*d* or detaching it therefrom. It should be noted that when the yellow developing unit 3054 has been attached to the attach/detach section 3050*d*, a portion of the side wall 3580Y, that is, a portion on the side of the rotating shaft 3050*e* with respect to the handle 3590Y, is covered by a later-described lid unit 3640 which serves as a lid body.

The first rib 3581Y, the second rib 3582Y, and the third rib 3583Y are formed differently in terms of their positions etc. in accordance with the type of developing unit, such as the color or the characteristics of the toner contained therein. In other words, the first rib 3581Y, the second rib 3582Y, and the third rib 3583Y are provided as shaped information sections for indicating information about the developing unit using an outer shape of the developing unit. For example, the third rib 3583Y provided on a side closer to the rotating shaft 3050*e* when the developing unit is attached to the attach/detach section of the developing-unit holding unit 3050 indicates the destination such as the country of use; on the other hand, the first rib 3581Y and the second rib 3582Y which are provided on a side farther from the rotating shaft 3050*e* indicate the toner color, for example. That is, if the type of developing unit differs, then the first rib 3581Y, the second rib 3582Y, and the third rib 3583Y will differ in terms of where they are formed, their shape, their length, etc., and are therefore formed such that they differ among each of the developing units 3051, 3052, 3053, and 3054.

Figure 31:
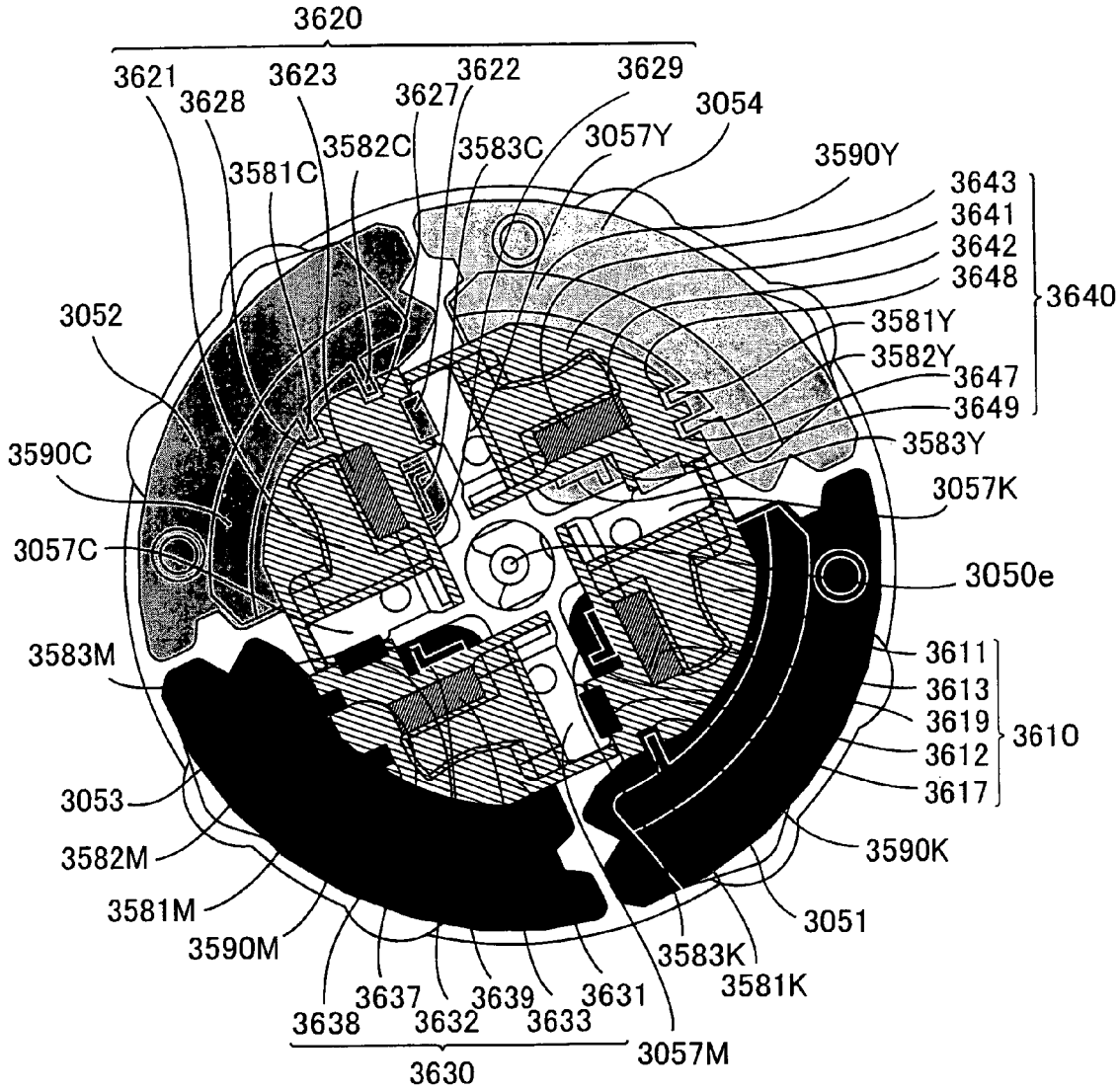
FIG. 31 shows a state in which the developing units 3051, 3052, 3053, and 3054 have respectively been attached to their attach/detach sections.

The side wall 3580K of the black developing unit 3051 of the present embodiment is provided with a handle 3590K and a first rib 3581K which serves as a projecting section, but does not have a second rib (see FIG. 31). The side wall 3580C of the cyan developing unit 3052 is provided with a handle 3590C, a first rib 3581C which serves as a projecting section, and a second rib 3582C which serves as a second projecting section (see FIG. 31). The side wall 3580M of the magenta developing unit 3053 is provided with a handle 3590M, a first rib 3581M which serves as a projecting section, and a second rib 3582M which serves as a second projecting section (see FIG. 31). The first ribs 3581K, 3581C, 3581M, and 3581Y are provided at positions different from one another. On the other hand, the second ribs 3582C, 3582M, and 3582Y are provided at the same position as the first rib 3581K of the black developing unit 3051.

Further, in the present embodiment, the third ribs 3583C, 3583M, 3583Y, and 3583K indicate information about the destination. That is, the position and/or shape of the third ribs 3583C, 3583M, 3583Y, and 3583K will differ among developing units bound for different destinations, but for developing units that are to be attached to the same single printer 10, the third ribs 3583C, 3583M, 3583Y, and 3583K of the same shape will be provided at the same position because the destination of those developing units is the same. Therefore, the third ribs 3583C, 3583M, 3583Y, and 3583K of the developing units of the present embodiment have the same shape and are formed at the same position.

The function of the first rib 3581Y, the second rib 3582Y, and the third rib 3583Y will be described in detail further below along with later-described lid units 3610, 3620, 3630, and 3640, because they engage with the lid units 3610, 3620, 3630, and 3640 when attached to the attach/detach sections.

===(3) Overview of the Developing-unit Holding Unit===

Next, an overview of the developing-unit holding unit 3050 will be described using FIG. 30A through FIG. 30C. It should be noted that in the present section, an example is described in which four developing units 3051, 3052, 3053, and 3054 are attached to the respective attach/detach sections 3050*a*, 3050*b*, 3050*c*, and 3050*d*, for the sake of convenience. The description below, however, is also applicable to cases in which developing units containing developer of the same color are attached the four attach/detach sections 3050*a*, 3050*b*, 3050*c*, and 3050*d*.

The developing-unit holding unit 3050 has a rotating shaft 3050*e* positioned at the center. A support frame 3055 for holding the developing units is fixed to the rotating shaft 3050*e*. The rotating shaft 3050*e* is provided extending between two frame side plates (not shown) which form a casing of the printer 10, and both ends of the shaft 3050*e* are supported. It should be noted that the axial direction of the rotating shaft 3050*e* intersects with the vertical direction.

The support frame 3055 is provided with the four attach/detach sections 3050*a*, 3050*b*, 3050*c*, and 3050*d*, to which the above-described developing units 3051, 3052, 3053, and 3054 of the four colors are attached in an attachable/detachable manner about the rotating shaft 3050*e*, that are arranged in the circumferential direction at an interval of 90°.

A pulse motor, which is not shown, is connected to the rotating shaft 3050*e*. By driving the pulse motor, it is possible to rotate the support frame 3055 and position the four developing units 3051, 3052, 3053, and 3054 mentioned above at predetermined positions.

Figure 30A:
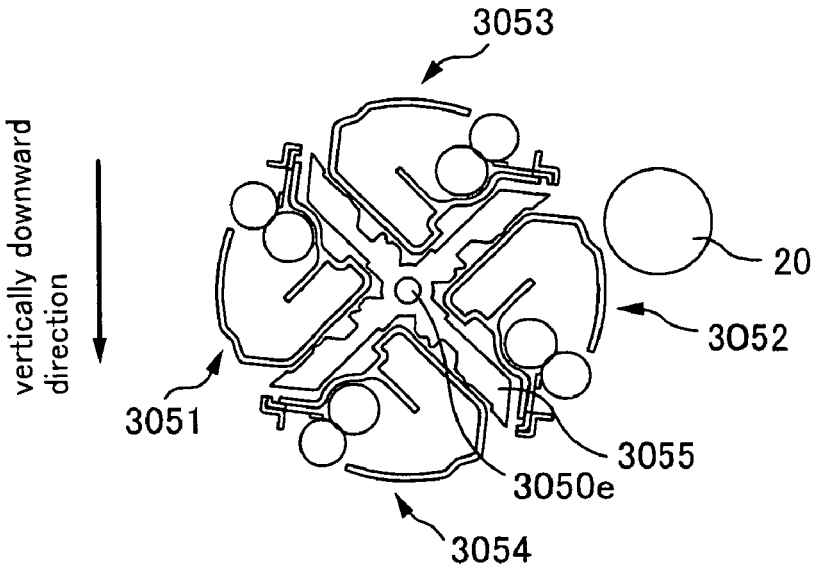
FIG. 30A shows the home position which is the standby position for when the printer is on standby for image formation to be carried out, and which is also the halt position serving as the reference position in the rotating direction of a developing-unit holding unit 3050.
Figure 30B:
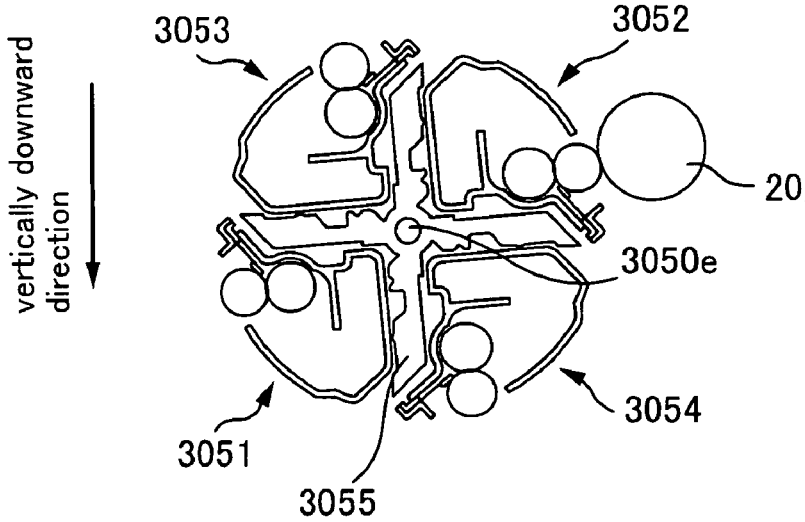
FIG. 30B shows the developing position of a cyan developing unit.
Figure 30C:
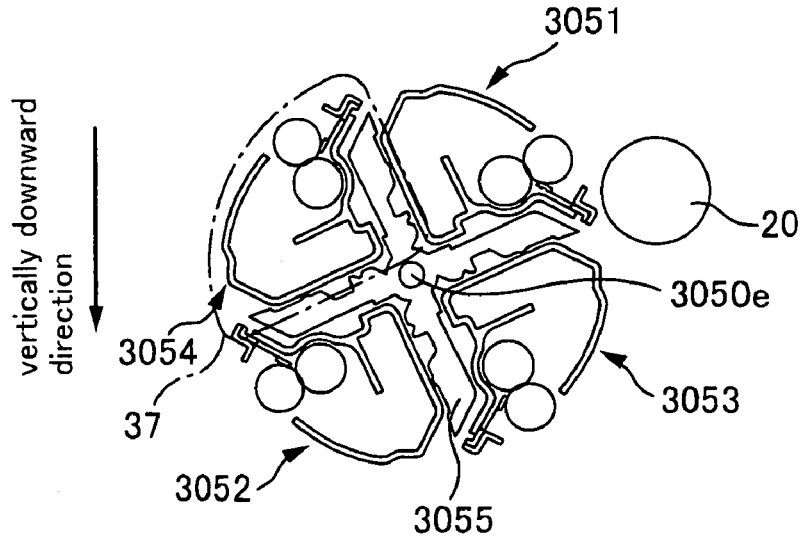
FIG. 30C shows the attach/detach position where a yellow developing unit 3054 is attached and detached.

FIG. 30A through FIG. 30C are diagrams showing three stop positions of the rotating developing-unit holding unit 3050. FIG. 30A shows the home position (referred to as "HP position" below) which is the standby position for when the printer is on standby for image formation to be carried out, and which is also the halt position serving as the reference position in the rotating direction of the developing-unit holding unit 3050. FIG. 30B shows the developing position of the cyan developing unit. FIG. 30C shows the attach/detach position where the yellow developing unit 3054 is attached and detached.

In FIG. 30B, the developing position is explained with regard to the cyan developing unit 3052, but this position becomes the developing position for each of the other developing units when the developing-unit holding unit 3050 is rotated at 90° intervals. Further, in FIG. 30C, the developing unit attach/detach position is explained with regard to the yellow developing unit 3054, but this position becomes the developing unit attach/detach position for each of the other developing units when the developing-unit holding unit 3050 is rotated at 90° intervals.

First, the HP position shown in FIG. 30A will be described. An HP detector 31 (FIG. 3) for detecting the HP position is provided on the side of one end of the rotating shaft 3050*e* of the developing-unit holding unit 3050. The HP detector 31 is structured of a disk that is for generating signals and that is fixed to one end of the rotating shaft 3050*e*, and an HP sensor that is made up of, for example, a photointerrupter having a light emitting section and a light receiving section. The peripheral section of the disk is arranged such that it is located between the light emitting section and the light receiving section of the HP sensor. When a slit formed in the disk moves up to a detecting position of the HP sensor, the signal that is output from the HP sensor changes from "L" to "H". The device is constructed such that the HP position of the developing-unit holding unit 3050 is detected based on this change in signal level and the number of pulses of the pulse motor, and by taking this HP position as a reference, each of the developing units can be positioned at the developing position etc.

FIG. 30B shows the developing position of the cyan developing unit 3052 which is achieved by rotating the pulse motor for a predetermined number of pulses from the above-mentioned HP position. At this developing position, the developing roller 3510 of the cyan developing unit 3052 and the photoconductor 20 come into opposition, so that development can be performed using the cyan toner.

One of the two frame side plates that support the developing-unit holding unit 3050 and that form the casing of the printer 10 is provided with an attach/detach dedicated opening 37 through which one developing unit can pass and an inner cover (not shown) that openably/closably covers the attach/detach dedicated opening 37. The attach/detach dedicated opening 37 is formed in a position where only a relevant developing unit (here, the yellow developing unit 3054) can be pulled out and detached in the direction of the rotating shaft 3050*e*, as shown in FIG. 30C, when the developing-unit holding unit 3050 is rotated and each developing unit is halted at the developing unit attach/detach position which is set for each developing unit. Further, the attach/detach dedicated opening 37 is formed slightly larger than the outer shape of a developing unit. At the developing unit attach/detach position, not only is it possible to detach the developing unit, but it is also possible to insert a new developing unit through this attach/detach dedicated opening 37 in the direction of the rotating shaft 3050*e* and attach the developing unit to the support frame 3055. While the developing-unit holding unit 3050 is positioned at positions other than the developing unit attach/detach position, the attachment/detachment of that developing unit is restricted by the frame side plates.

It should be noted that a lock mechanism, which is not shown, is provided for certainly positioning and fixing the developing-unit holding unit 3050 at the positions described above.

Figure 32:
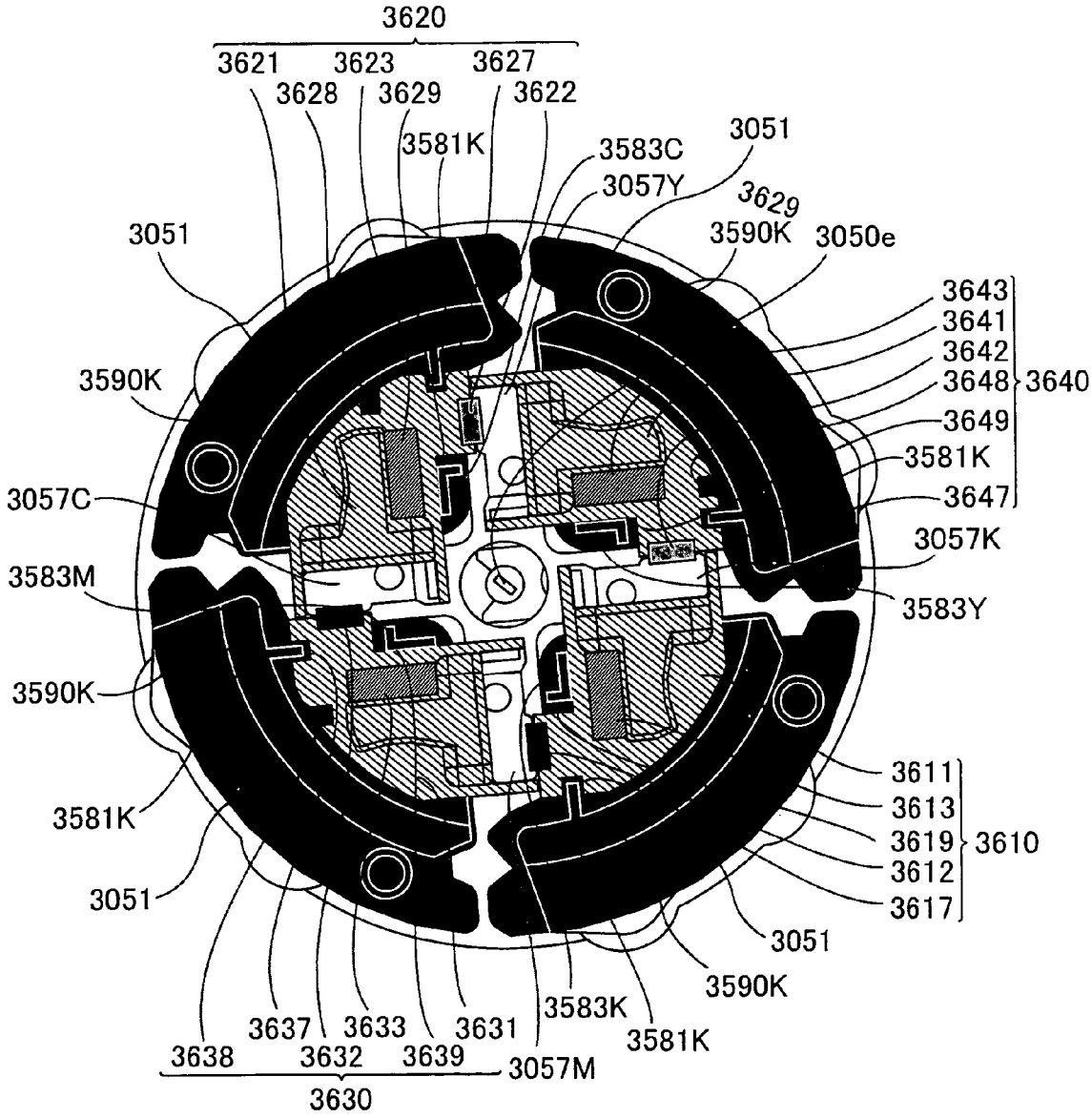
FIG. 32 shows a state in which four black developing units 3051 have been attached to the four attach/detach sections 3050*a*, 3050*b*, 3050*c*, and 3050*d;*

FIG. 31 shows a state in which the developing units 3051, 3052, 3053, and 3054 have respectively been attached to their attach/detach sections. FIG. 32 shows a state in which four black developing units 3051 have been attached to the four attach/detach sections 3050*a*, 3050*b*, 3050*c*, and 3050*d*.

As shown in FIG. 31, each of the developing units become usable when: the black developing unit 3051 is attached to the attach/detach section 3050*a* and the lid unit 3610 is closed; the cyan developing unit 3052 is certainly attached to the attach/detach section 3050*b* and the lid unit 3620 is closed; the magenta developing unit 3053 is attached to the attach/detach section 3050*c* and the lid unit 3630 is closed; and the yellow developing unit 3054 is attached to the attach/detach section 3050*d* and the lid unit 3640 is closed. On the other hand, as shown in FIG. 32, the black developing units 3051 can be attached to the attach/detach sections 3050*b*, 3050*c*, and 3050*d* and become usable, because when the black developing units 3051 are inserted into those attach/detach sections 3050*b*, 3050*c*, and 3050*d*, the lid units 3620, 3630, and 3640 can be closed.

Further, as shown in FIG. 31 and FIG. 32, the attach/detach section 3050*a* has connected thereto the lid unit 3610 for the attach/detach section 3050*a*; the attach/detach section 3050*b* has connected thereto the lid unit 3620 for the attach/detach section 3050*b*; the attach/detach section 3050*c* has connected thereto the lid unit 3630 for the attach/detach section 3050*c*; and the attach/detach section 3050*d* has connected thereto the lid unit 3640 for the attach/detach section 3050*d*. Each of the lid units 3610, 3620, 3630, and 3640 can be opened and closed separately, and each developing unit becomes usable when the developing unit is inserted into the attach/detach section and the corresponding one of the lid units 3610, 3620, 3630, and 3640 is closed. Here, the lid units 3610, 3620, 3630, and 3640 are provided corresponding to the respective developing units, which are to be attached to the attach/detach sections 3050*a*, 3050*b*, 3050*c*, and 3050*d* to which those lid units 3610, 3620, 3630, and 3640 are respectively connected. The lid units are structured such that they can be closed when a developing unit 3051, 3052, 3053, or 3054 that should be attached is attached, and such that they cannot be closed when a developing unit that should not be attached is attached.

===(3) Detailed Structure of the Lid Unit===

The detailed structure of the lid unit is described below.

Figure 33:
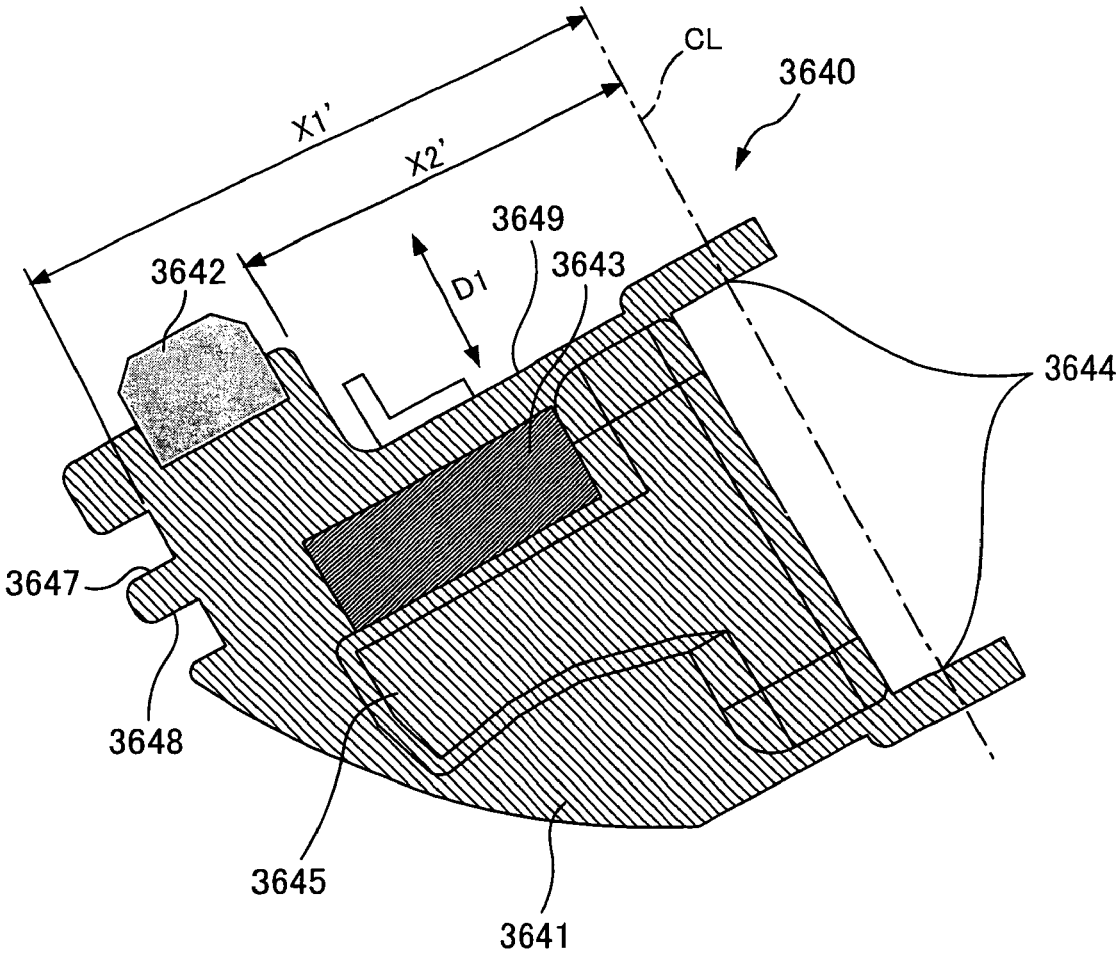
FIG. 33 is diagram of a lid unit 3640 viewed from the outside (front) of the printer 10.
Figure 34:
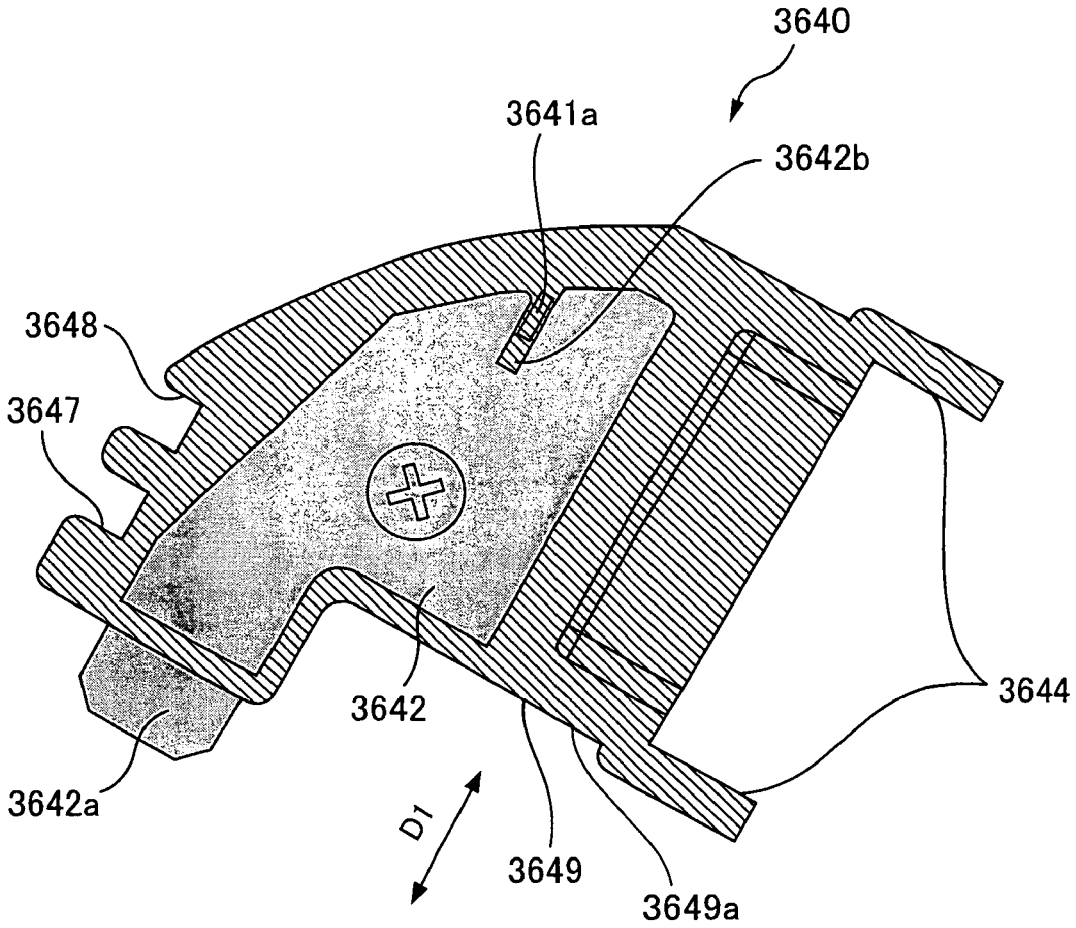
FIG. 34 is a rear view of the lid unit 3640.

First, the structure of the lid unit 3640 connected to the attach/detach section 3050*d* will be described. FIG. 33 is diagram of the lid unit 3640 viewed from the outside of the printer 10 (from the front). FIG. 34 is a rear view of the lid unit 3640.

The lid unit 3640 covers a portion of the side wall 3580Y of the yellow developing unit 3054 attached to the attach/detach section 3050*d*. More specifically, the lid unit 3640 covers almost the whole area on the side of the rotating shaft 3050*e* with respect to the handle 3590Y provided on the side wall 3580Y. As shown in FIG. 33, the lid unit 3640 has a developing-unit cover 3641, a latch 3642, and an operating button 3643.

The developing-unit cover 3641 has two connecting sections 3644 connected to the attach/detach section 3050*d* and spaced apart from one another. The two connecting sections 3644 are supported by the attach/detach section 3050*d*, and the lid unit 3640 is structured to be turnable about a turn axis CL that passes these two connecting sections 3644. That is, lid unit 3640 is connected to the attach/detach section 3050*d* via a hinge 3057Y that is structured of the connecting sections 3644 and a member of the attach/detach section 3050*d* that supports them. It should be noted that the color of the developing-unit cover 3641 is different from the color (yellow) of the side wall 3580Y.

Further, the developing-unit cover 3641 is provided with a first cut-out section 3647, a second cut-out section 3648, and a third cut-out section 3649, which serve as an engaging section. The first cut-out section 3647 is for preventing the second rib 3582Y from interfering with the developing-unit cover 3641. The second cut-out section 3648 is for preventing the first rib 3581Y from interfering with the developing-unit cover 3641. The third cut-out section 3649 is for preventing the third rib 3583Y from interfering with the developing-unit cover 3641. That is, the first cut-out section 3647 is provided in a position corresponding to the second rib 3582Y, the second cut-out section 3648 is provided in a position corresponding to the first rib 3581Y, and the third cut-out section 3649 is provided in a position corresponding to the third rib 3583Y. In this way, the first cut-out section 3647, the second cut-out section 3648, and the third cut-out section 3649 prevent the first rib 3581Y, the second rib 3582Y, and the third rib 3583Y from interfering with the developing-unit cover 3641 when the yellow developing unit 3054, which is the developing unit that should be attached to the attach/detach section 3050*d*, has been inserted into the attach/detach section 3050*d*, thereby allowing the developing-unit cover 3641 to close (see FIG. 31).

Figure 35:
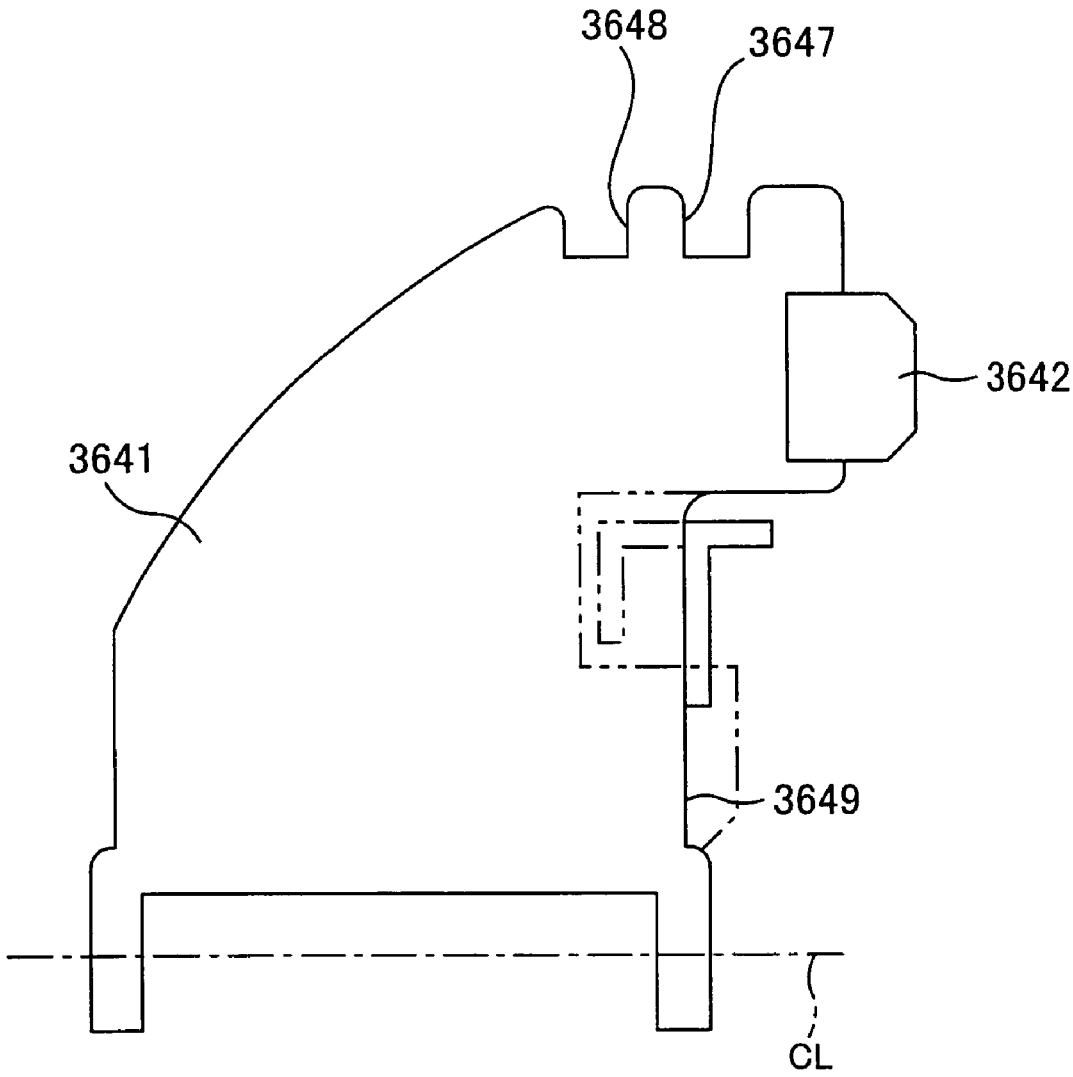
FIG. 35 is a diagram showing a model for describing an example of a way of distinguishing the destination information using the third rib.

More specifically, information indicative of the color of the toner contained in the developing unit can be distinguished by the engagement of the first rib 3581Y and the second rib 3582Y, and the first cut-out section 3647 and the second cut-out section 3648, which are arranged in positions corresponding respectively to the first rib 3581Y and the second rib 3582Y provided in accordance with the color of the toner contained in the developing unit. On the other hand, information about the destination of the developing unit and the toner is distinguishable by the engagement of the third rib 3583Y and the third cut-out section 3649, which is arranged in correspondence with the third rib 3583Y provided in accordance with the destination. The method of distinguishing the information indicative of the destination using the third rib 3583Y and the third cut-out section 3649 is achieved, for example, as below. FIG. 35 is a diagram showing a model for describing an example of how to distinguish the destination information using the third rib. Here, description is made based on an example in which the above-described third rib indicates "Japan" as the destination and in which such a third rib is distinguished from a developing unit provided with information indicating "Europe" as another destination.

For example, a third rib of a developing unit containing toner whose destination is "Europe" (shown by the long-and-short dashed line) is formed in a position more inward of the lid unit 3640 (shown by the solid line) compared to the above-described third rib of the developing unit containing toner whose destination is "Japan" (shown by the solid line). In this way, if a developing unit destined for Europe is attached to the attach/detach section 3050*d* of a printer 10 destined for Japan, the lid unit 3640 cannot be closed. On the other hand, a third cut-out section of a lid unit connected to an attach/detach section 3050*d* of a printer 10 destined for Europe (shown by the long-and-short dashed line) is cut-in further inward compared to the third cut-out section of the lid unit 3640 connected to the attach/detach section 3050*d* of the printer 10 destined for Japan (shown by the solid line). In this way, if a developing unit destined for Europe is attached to the attach/detach section 3050*d* of a printer 10 destined for Europe, the lid unit can close the attach/detach section. However, merely cutting the third cut-out section further inward will allow a developing unit destined for Japan to be attached to the attach/detach section 3050*d* of a printer 10 destined for Europe. In view of this, the length, in a direction intersecting with the turn axis CL, of the third rib of a developing unit destined for Europe (shown by the long-and-short dashed line) is formed shorter than the third rib 3583Y destined for Japan. Further, the width, in the direction intersecting with the turn axis CL, of the third cut-out section formed in the lid unit of a printer destined for Europe is made narrower than the length of the third rib 3583Y of a developing unit destined for Japan. In this way, it is possible to prevent a developing unit destined for Japan to be inadvertently attached to a printer destined for Europe.

Further, as shown in FIG. 33, the first cut-out section 3647 and the second cut-out section 3648 are provided on a side farther from the turn axis CL, which is where the lid unit 3640 turns, and the third cut-out section 3649 is provided on a side closer to the turn axis CL. That is, the distance X1' between the connecting sections 3644 and the first cut-out section 3647 or the second cut-out section 3648 is set larger than the distance X2' between the connecting sections 3644 and the third cut-out section 3649.

Figure 36:
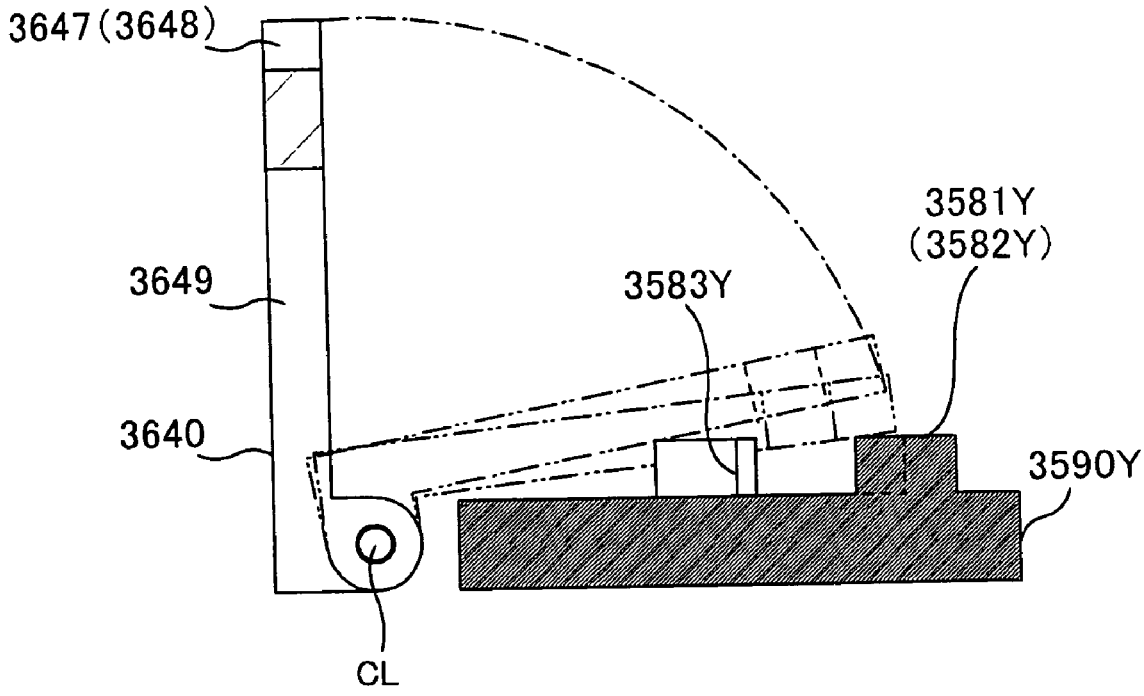
FIG. 36 is a diagram illustrating the path of the turning lid unit.

FIG. 36 is a diagram illustrating the path of the turning lid unit.

The first rib 3581Y, the second rib 3582Y, and the third rib 3583Y provided on the yellow developing unit 3054 of the present embodiment are all formed having the same height. Therefore, when the yellow developing unit 3054 is attached and the lid unit 3640, which was opened to open-up the attach/detach section 3050*d*, is to be closed, the third rib 3583Y which is provided on the side closer to the turn axis CL first starts to engage with the third cut-out section 3649. Then, as the lid unit 3640 is turned, its behavior is restricted due to the edge 3649*a* of the third cut-out section 3649 being guided by the third rib 3583Y, and then, the first cut-out section 3647 and the second cut-out section 3648 start engaging with the first rib 3581Y and the second rib 3582Y. That is, the timing at which the third cut-out section 3649 provided on the side closer to the turn axis CL engages with the rib on the yellow developing unit 3054 is different from the timing at which the first cut-out section 3647 and the second cut-out section 3648 provided on the side farther from the turn axis CL engage with the ribs on the yellow developing unit 3054. The first cut-out section 3647, the second cut-out section 3648, the first rib 3581Y, and the second rib 3582Y, which are positioned on the side farther from the turn axis CL, may become difficult to engage due to a wobble or twist caused by the clearance at the connecting section between the lid unit 3640 and the attach/detach section 3050*d*. By allowing the third cut-out section 3649 and the third rib 3583Y, which are positioned on the side closer to the turn axis CL, to engage first, it becomes possible to assure a stable behavior of the lid unit 3640. Particularly, the first rib 3581Y and the second rib 3582Y are arranged on a line extending from the third rib 3583Y in the direction intersecting with the turn axis CL. Therefore, even if there is twisting in the lid unit 3640 due to a wobble etc. of the turn axis CL, the behavior of the lid unit 640 is restricted after the third cut-out section 3649 and the third rib 3583Y engage, and thus the positional deviation of the first cut-out section 3647 and the second cut-out section 3648 becomes small. As a result, the first rib 3581Y and the second cut-out section 3648, as well as the second rib 3582Y and the first cut-out section 3647, can be made to easily engage with one another. Since it is possible to prevent the lid unit 640 from getting closed without the first rib 3581Y and the second cut-out section 3648, as well as the second rib 3582Y and the first cut-out section 3647, engaging with one another due to twisting in the lid unit 3640, it becomes possible to certainly prevent attachment errors of the developing unit.

In the printer 10 of the present embodiment, the black developing unit 3051 can be attached to any of the attach/detach sections 3050*a*, 3050*b*, 3050*c*, and 3050*d*, and so even when the black developing unit 3051 is inserted into the attach/detach section 3050*d*, the first cut-out section 3647 prevents the first rib 3581K from interfering with the developing-unit cover 3641, thereby allowing the developing-unit cover 3641 to close (see FIG. 32). On the other hand, if the cyan developing unit 3052 or the magenta developing unit 3053 is inserted into the attach/detach section 3050*d*, the first rib 3581C of the cyan developing unit 3052 or the first rib 3581M of the magenta developing unit 3053 will interfere with the developing-unit cover 3641 and the developing-unit cover 3641 will not close. For this reason, only the black developing unit 3051 and the yellow developing unit 3054 can be attached to the attach/detach section 3050*d*.

Further, the developing-unit cover 3641 is provided with a knob 3645 for the user etc. to grip when opening and closing the developing-unit cover 3641.

The latch 3642 is for keeping the developing-unit cover 3641 in a closed state. As shown in FIG. 34, the latch 3642 is supported on the back side of the developing-unit cover 3641. It should be noted that the color of the latch 3642 is the same as the color (yellow) of the side wall 3580Y of the developing unit.

The latch 3642 is provided with a fastening section 3642*a* and a cut-out section 3642*b*. Engagement of the fastening section 3642*a* to the side wall 3580Y allows the developing-unit cover 3641 to engage with and be fastened to the sidewall 3580Y at a fastening position (at the fastening section). The latch 3642 is restricted from moving by means of the cut-out section 3642*b* and a protrusion 3641*a* provided on the developing-unit cover 3641, and the latch 3642 can only slide in the D1 direction.

The operating button 3643 is connected to the latch 3642 and is for operating the latch 3642. It should be noted that the color of the operating button 3643 is different from the color (yellow) of the side wall 3580Y. The operating button 3643 is partially covered by the knob 3645. In this way, the operating button 3643 can only move in the D1 direction.

A compression spring (not shown) is provided between the operating button 3643 and the knob 3645. When a force is applied to the operating button 3643, the compression spring is compressed and the operating button 3643 slides. Since the operating button 3643 is connected to the latch 3642, the latch 3642 also slides when the operating button 3643 slides.

Next, the structure of the lid units 3610, 3620, and 3630 will be described.

As shown in FIG. 33, the lid unit 3610 connected to the attach/detach section 3050*a* has a developing-unit cover 3611, a latch 3612, and an operating button 3613. The lid unit 3620 connected to the attach/detach section 3050*b* has a developing-unit cover 3621, a latch 3622, and an operating button 3623. The lid unit 3630 connected to the attach/detach section 3050*c* has a developing-unit cover 3631, a latch 3632, and an operating button 3633.

The developing-unit cover 3611 is provided with a first cut-out section 3617 provided in a position corresponding to the first rib 3581K. However, the developing-unit cover 3611 is not provided with a second cut-out section. The structure of the developing-unit cover 3611 is the same as that of the developing-unit cover 3641, except that it does not have a second cut-out section.

When the black developing unit 3051 is inserted into the attach/detach section 3050*a*, the first cut-out section 3617 prevents the first rib 3581K from interfering with the developing-unit cover 3611, thereby allowing the lid unit 3610 to close. On the other hand, when the developing unit 3052, 3053, or 3054 is inserted into the attach/detach section 3050*a*, the first rib 3581C, 3581M, or 3581Y will interfere with the lid unit 3610, and the lid unit 3610 will not close. For this reason, only the black developing unit 3051 can be attached to the attach/detach section 3050*a*.

The developing-unit cover 3621 is provided with a first cut-out section 3627 provided in a position corresponding to the second rib 3582C and a second cut-out section 3628 provided in a position corresponding to the first rib 3581C. The structure of the developing-unit cover 3621 is the same as that of the developing-unit cover 3641, except that the position of the second cut-out section 3628 with respect to the developing-unit cover 3621 is different from the position of the second cut-out section 3648 with respect to the developing-unit cover 3641.

When the cyan developing unit 3052 is inserted into the attach/detach section 3050*b*, the first cut-out section 3627 and the second cut-out section 3628 prevent the second rib 3582C and the first rib 3581C from interfering with the developing-unit cover 3621, thereby allowing the lid unit 3620 to close. Further, when the black developing unit 3051 is inserted into the attach/detach section 3050*b*, the first cut-out section 3627 prevents the first rib 3581K from interfering with the developing-unit cover 3621, thereby allowing the lid unit 3620 to close. On the other hand, when the developing unit 3053 or 3054 is inserted into the attach/detach section 3050*b*, the first rib 3581M or 3581Y will interfere with the lid unit 3620, and the lid unit 3620 will not close. For this reason, only the black developing unit 3051 and the cyan developing unit 3052 can be attached to the attach/detach section 3050*b*.

The developing-unit cover 3631 is provided with a first cut-out section 3637 provided in a position corresponding to the second rib 3582M and a second cut-out section 3638 provided in a position corresponding to the first rib 3581M. The structure of the developing-unit cover 3631 is the same as that of the developing-unit cover 3641, except that the position of the second cut-out section 3638 with respect to the developing-unit cover 3631 is different from the position of the second cut-out section 3648 with respect to the developing-unit cover 3641.

When the magenta developing unit 3053 is inserted into the attach/detach section 3050*c*, the first cut-out section 3637 and the second cut-out section 3638 prevent the second rib 3582M and the first rib 3581M from interfering with the developing-unit cover 3631, thereby allowing the lid unit 3630 to close. Further, when the black developing unit 3051 is inserted into the attach/detach section 3050*c*, the first cut-out section 3637 prevents the first rib 3581K from interfering with the developing-unit cover 3631, thereby allowing the lid unit 3630 to close. On the other hand, when the developing unit 3052 or 3054 is inserted into the attach/detach section 3050*c*, the first rib 3581C or 3581Y will interfere with the lid unit 3630, and the lid unit 3630 will not close. For this reason, only the black developing unit 3051 and the magenta developing unit 3053 can be attached to the attach/detach section 3050*c*.

The shapes of latches 3612, 3622, and 3632 are the same as the shape of the latch 3642, but their colors are different from the color (yellow) of the latch 3642. The latches 3612, 3622, and 3632 are black, cyan, and magenta, respectively. The operating buttons 3613, 3623, and 3633 have the same structure as the operating button 3643.

===(3) Attaching the Developing Unit to the Attach/detach Section===

Figure 37:
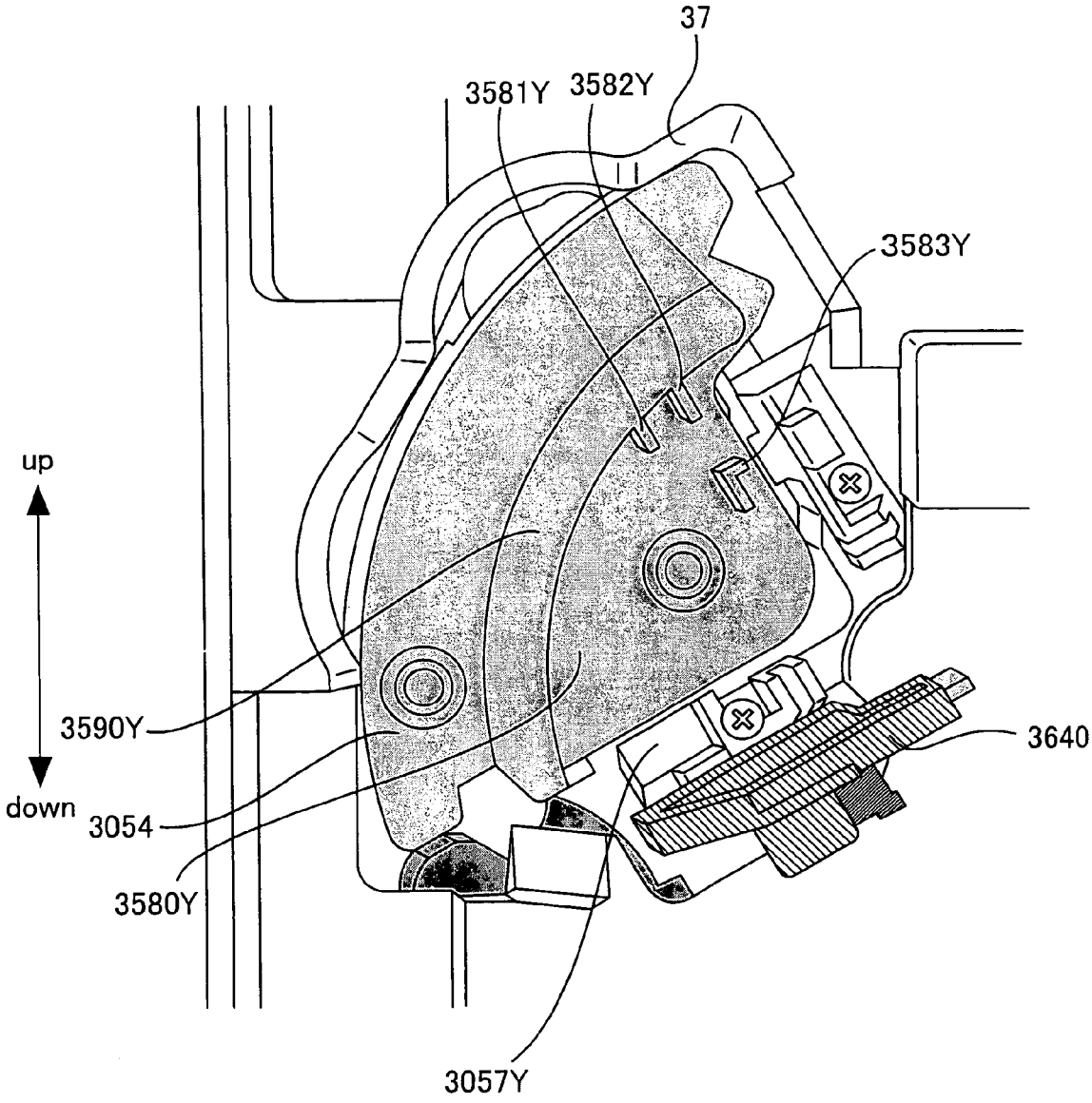
FIG. 37 shows a state in which the lid unit 3640 is opened.
Figure 38:
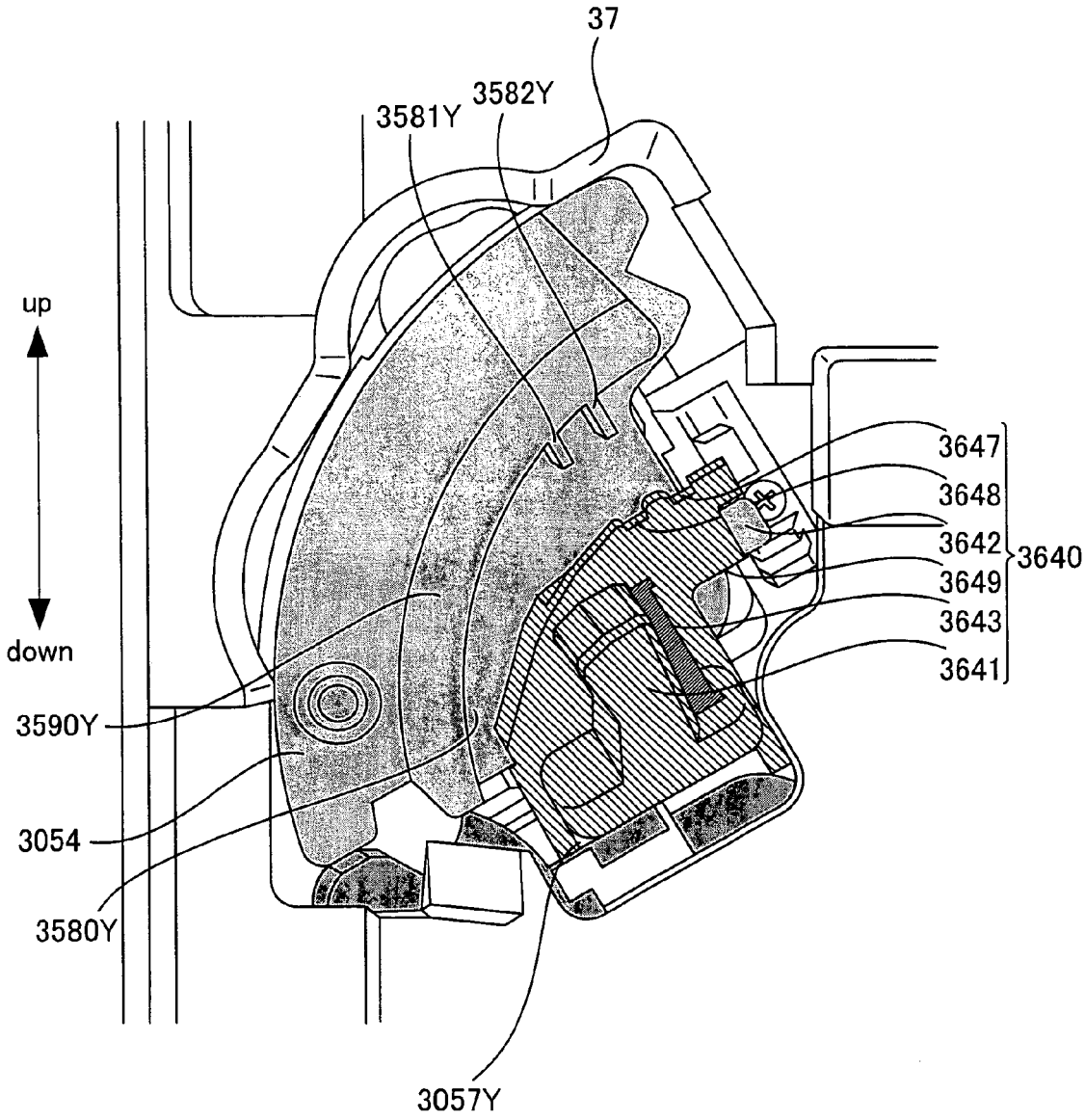
FIG. 38 shows a state where the lid unit 3640 is being turned for closure.
Figure 39:
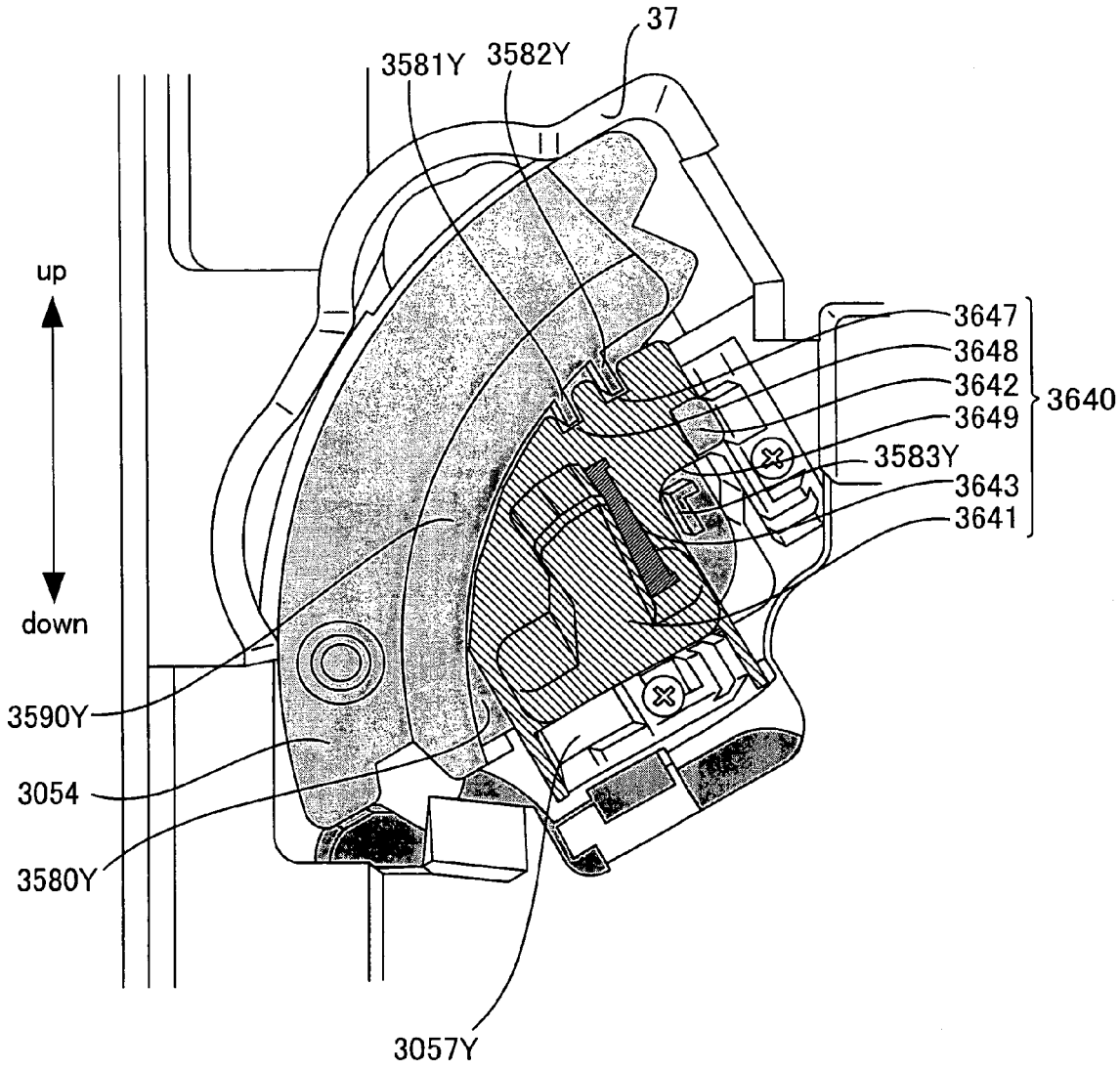
FIG. 39 shows a state in which the lid unit 3640 is closed.

The procedure of attaching the developing units to the attach/detach sections is described here. Attachment of the developing units 3051, 3052, 3053, and 3054 to their respective attach/detach sections is carried out in the same way, and so below, only the procedure of attaching the yellow developing unit 3054 to the attach/detach section 3050*d* is described. FIG. 37 shows a state in which the yellow developing unit 3054 is attached and the lid unit 3640 is opened. FIG. 38 shows a state where the lid unit 3640 is being turned for closure. FIG. 39 shows a state in which the lid unit 3640 is closed.

Attachment of the yellow developing unit 3054 to the attach/detach section 3050*d* is started from the state where the developing-unit holding unit 3050 is positioned at the attach/detach position of the yellow developing unit 3054. The explanation below is given on the assumption that no developing unit is currently attached to the attach/detach section 3050*d*.

First, the user etc. opens the developing-unit cover 3641. Then, the user etc. compares the color of the latch 3642 and the color of the side wall 3580Y, and determines whether the yellow developing unit 3054 is a developing unit that can be attached to the attach/detach section 3050*d*. Here, since both the color of the latch 3642 and the color of the side wall 3580Y are yellow, the user etc. determines that the yellow developing unit 3054 can be attached to the attach/detach section 3050*d*. It should be noted that the black developing unit 3051 is attachable to all four attach/detach sections 3050*a*, 3050*b*, 3050*c*, and 3050*d*, and so such a determination is not necessary.

Next, the user etc. inserts the yellow developing unit 3054 into the attach/detach section 3050*d*. The user etc. holds the handle 3590Y for example, and inserts the yellow developing unit 3054 into the attach/detach section 3050*d* through the attach/detach dedicated opening 37, as shown in FIG. 37.

Next, the user etc. turns the developing-unit cover 3641 in order to close it. At this time, the third cut-out section and the third rib first start engaging. Then, as the lid unit keeps turning, the third cut-out section is guided by the third rib and the lid unit moves while being restricted in behavior, and then the first cut-out section and the second rib, as well as the second cut-out section and the first rib, start engaging with one another. Since the first cut-out section 3647 is provided in a position corresponding to the second rib 3582Y, the second cut-out section 3648 is provided in a position corresponding to the first rib 3581Y, and the third cut-out section 3649 is provided in a position corresponding to the third rib 3583Y, none of the first rib 3581Y, the second rib 3582Y, nor the third rib 3583Y will interfere with the developing-unit cover 3641 when it is being turned. When the developing-unit cover 3641 is turned for a predetermined amount, without the first rib 3581Y, the second rib 3582Y, nor the third rib 3583Y interfering therewith, the latch 3642 engages with the side wall 3580Y. Engagement of the latch 3642 to the side wall 3580Y results in the developing-unit cover 3641 engaging with and being fastened to the side wall 3580Y and the developing-unit cover 3641 being close.

Figure 40:
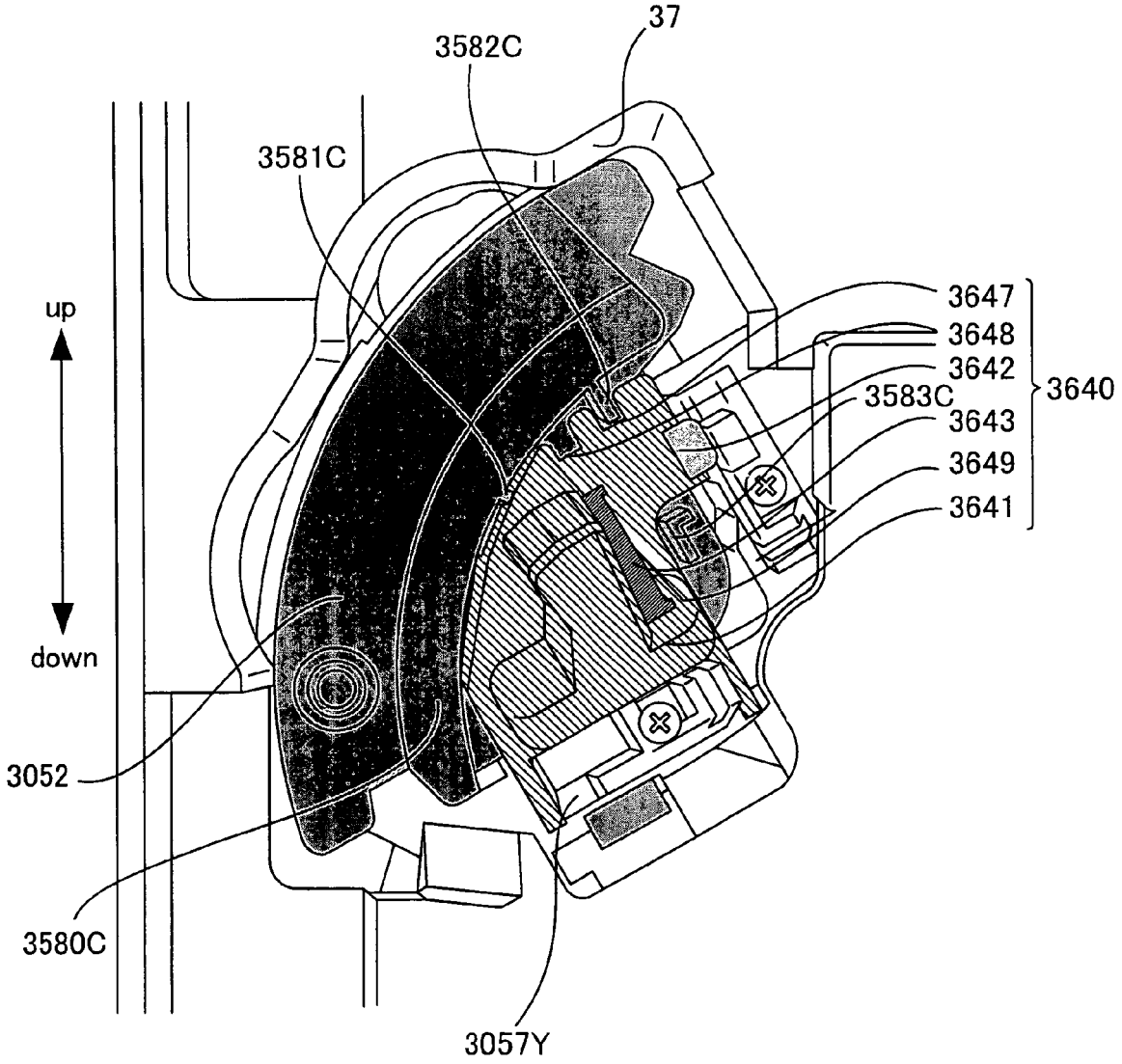
FIG. 40 shows a state where the developing-unit cover 3641 does not close when the cyan developing unit 3052 is inserted into the attach/detach section 3050*d;*

On the other hand, the developing-unit cover 3641 will not close when the cyan developing unit 3052 or the magenta developing unit 3053 is inserted into the attach/detach section 3050*d*. For example, as shown in FIG. 40, if the cyan developing unit 3052 is inserted into the attach/detach section 3050*d*, the developing-unit cover 3641 will not close because the position of the second cut-out section 3648 is not in a position corresponding to the first rib 3581C and thus the first rib 3581C interferes with the developing-unit cover 3641. It should be noted that FIG. 40 shows a state where the developing-unit cover 3641 does not close when the cyan developing unit 3052 is inserted into the attach/detach section 3050*d*.

===(3) Detaching the Developing Unit===

Next, the procedure of detaching the developing unit attached to the attach/detach section will be described. Detachment of the developing units 3051, 3052, 3053, and 3054 is carried out in the same way, and so below, only the procedure of detaching the yellow developing unit 3054 attached to the attach/detach section 3050*d* is described.

Detachment of the yellow developing unit 3054 is started from a state where the developing-unit holding unit 3050 is positioned at the attach/detach position of the yellow developing unit 3054. The user etc. can see the color (yellow) of the side wall 3580Y of the yellow developing unit 3054 through the attach/detach dedicated opening 37, and therefore can determine whether the yellow developing unit 3054 is a developing unit that is appropriate for detachment.

First, the user etc. slides the operating button 3643 by applying a force to the operating button 3643 to compress the compression spring. The latch 3642 also slides as the operating button 3643 is slid. When the latch 3642 is slid for a predetermined amount or more, the engagement between the latch 3642 and the side wall 3580Y of the yellow developing unit 3054 is released. In this way, it becomes possible to turn the developing-unit cover 3641.

Next, the user etc. holds the knob 3645 and turns the developing-unit cover 3641 toward him/her. The developing-unit cover 3641 starts to open, taking the connecting section 3644 as an axis. The user etc. opens the developing-unit cover 3641 up to a position where the yellow developing unit 3054 can be detached.

Next, the user etc. holds the handle 3590Y and pulls the yellow developing unit 3054 out toward him/her. By pulling the yellow developing unit 3054 out through the attach/detach dedicated opening 37, the user etc. can detach the yellow developing unit 3054 from the attach/detach section 3050*d*.

===(3) Other Considerations===

In the foregoing embodiment, an example in which the printer has a plurality of attach/detach sections was described. However, it is possible to configure the printer such that a single lid unit is provided on a single attach/detach section and is closable when a developing unit that should be attached is inserted into that attach/detach section.

Further, in the foregoing embodiment, as shown in FIG. 31, the developing units 3051, 3052, 3053, and 3054 were respectively provided with first ribs 3581K, 3581C, 3581M, and 3581Y, second ribs (projecting sections) 3582C, 3582M, and 3582Y, and third ribs 3583K, 3583C, 3583M, and 3583Y. Further, the lid units 3610, 3620, 3630, and 3640 connected respectively to the four attach/detach sections 3050*a*, 3050*b*, 3050*c*, and 3050*d* were respectively provided with a second cut-out section corresponding to the position of the first rib, a first cut-out section corresponding to the position of the second rib, and a third cut-out section corresponding to the position of the third rib, so that the lid unit can close. However, it is possible to provide the cut-out section or a recessed section on the developing unit side, and provide the rib on the lid unit side.

Further, the foregoing embodiment described an example in which the color of the developer is distinguished using the first and second ribs provided on the side farther from the turn axis of the lid unit, and the destination is distinguished using the third rib provided on the closer side. However, the destination may be distinguished using a rib provided on the farther side, and the color of the developer may be distinguished using a rib provided on the closer side. Further, the information to be distinguished is not limited to color and destination, and it may be characteristics of the contained developer or constituents of the developer, for example. Further, in the foregoing embodiment, an example was described in which the first and second ribs provided on the side farther from the turn axis of the lid unit and the third rib provided on the closer side indicated information different from one another. However, the first and second ribs provided on the side farther from the turn axis and the third rib provided on the closer side may be used to indicate a single piece of information, such as various information about the developer having different characteristics.

The foregoing embodiment described an example of the shape and arrangement of ribs and cut-out sections for exclusively distinguishing the developing unit so that only the developing unit that should be attached can be attached to the attach/detach section. However, the shape and arrangement of the ribs and cut-out sections are not limited to those of the foregoing embodiment.

Figure 41:
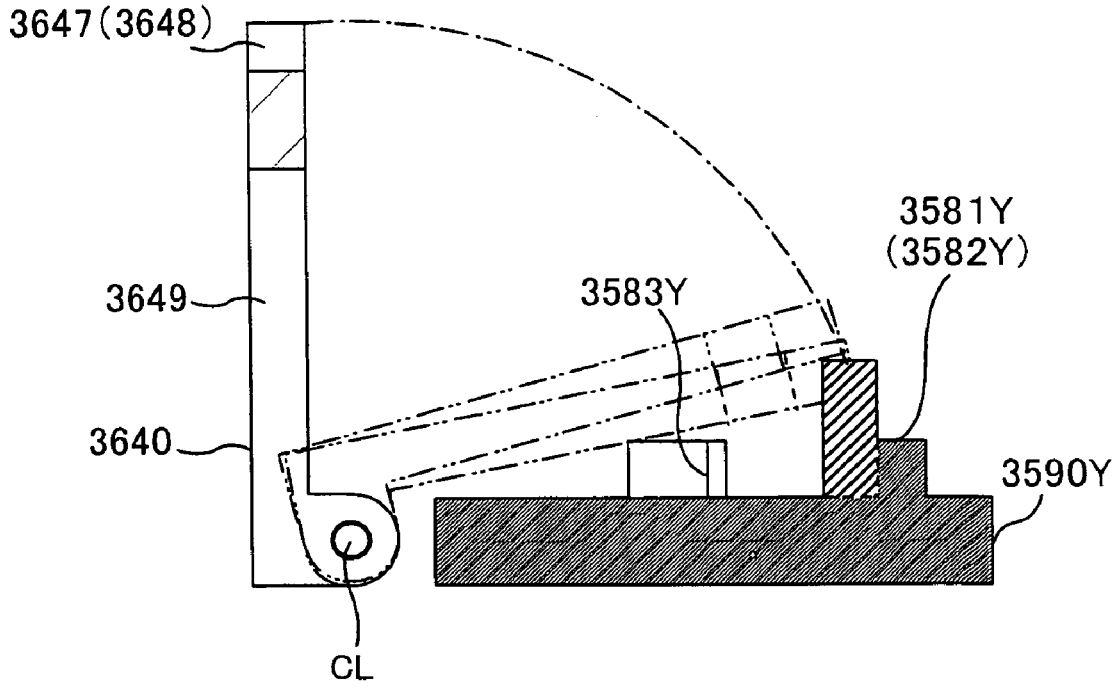
FIG. 41 shows a modified example of the first and second ribs.

Further, the foregoing embodiment described an example in which the third rib provided on the side closer to the turn axis of the lid unit and the first and second ribs provided on the farther side are all formed to have the same height, and the third rib and the third cut-out section engage first when the lid unit is turned. This, however, is not a limitation. FIG. 41 shows a modified example of the first and second ribs. As shown in FIG. 41, the first and second ribs provided on the farther side of the lid unit may be formed higher than the third rib, and the first and second ribs and the cut-out sections of the lid unit may first engage when the lid unit is turned so that the behavior of the lid unit is restricted by the first and second ribs. However, since the first and second ribs are positioned on the farther side from the turn axis, the positions of the cut-out sections provided in the lid unit tend to deviate. Therefore, the foregoing embodiment, in which the third rib positioned on the side closer to the relatively-stable turn axis engages the cut-out section first, is more preferable.

Further, in the foregoing embodiment, the developer containers were the developing units 3051, 3052, 3053, and 3054 (developing devices) each provided with a developing roller 3510 (developer bearing body) for bearing toner that is used for developing the latent image borne on the photoconductor 20, as shown in FIG. 29. This, however, is not a limitation. For example, the developer container does not have to be provided with a developing roller 3510, and may be a cartridge containing toner to be supplied to the developing units 3051, 3052, 3053, and 3054.

Detachment from the attach/detach section is performed when the amount of contained toner becomes small and/or when the developing roller 3510 has worn out, for example. Therefore, the frequency of attaching the developer container to the attach/detach section is higher for when the developer container is a developing unit 3051, 3052, 3053, 3054, compared to cases where the developer container is a cartridge. The foregoing embodiment is therefore more preferable in terms that the effect of the present embodiment, that is, the effect that it is possible to achieve a user-friendly printer 10, can be attained more advantageously.

Furthermore, in the foregoing embodiment, the developer of a certain color was black toner (black developer). This, however, is not a limitation, and for example, the developer of the certain color may be any of the cyan toner, magenta toner, and yellow toner. In such cases, the printer 10 will form monochrome images in that color.

However, the frequency of forming monochrome images using black toner is higher than that of forming monochrome images in color. Therefore, by allowing black developing units 3051 containing black toner to be attached to the four attach/detach sections 3050*a*, 3050*b*, 3050*c*, and 3050*d*, it becomes possible to form a large number of monochrome images, and thus achieve a printer 10 that is even more user friendly. The foregoing embodiment is therefore more preferable.

Other Embodiments

In the foregoing, an image forming apparatus etc. according to the present invention was described according to the above-described embodiments thereof. However, the foregoing embodiments of the invention are for the purpose of facilitating understanding of the present invention and are not to be interpreted as limiting the present invention. The present invention can be altered and improved without departing from the gist thereof, and needless to say, the present invention includes its equivalents.

In the foregoing embodiments, an image forming apparatus provided with a rotary-type developing device was described as an example. This, however, is not a limitation, and the present invention is applicable to, for example, image forming apparatuses provided with tandem-type developing devices.

In the foregoing embodiments, the photoconductor, which is the image bearing body, was explained as having a structure in which a photoconductive layer is provided on the outer circumferential surface of a cylindrical, conductive base. This, however, is not a limitation, and the photoconductor can be, for example, a so-called photoconductive belt structured by providing a photoconductive layer on a surface of a belt-like conductive base.

In the foregoing embodiments, it was explained that the black developing units 51 are attached to all four of the attach/detach sections 50*a*, 50*b*, 50*c*, and 50*d* (2050*a*, 2050*b*, 2050*c*, and 2050*d*; 3050*a*, 3050*b*, 3050*c*, and 3050*d*) when the printer 10 is used as a monochrome printer as shown in FIG. 2. This, however, is not a limitation, and for example, the black developing units 51 may be attached only to the attach/detach sections 50*a* and 50*b* (2050*a* and 2050*b*; 3050*a* and 3050*b*) when using the printer 10 as a monochrome printer.

Configuration of Image Forming System Etc.

Next, an embodiment of an image forming system, which serve as an example of an embodiment of the present invention, is described with reference to the drawings.

Figure 42:
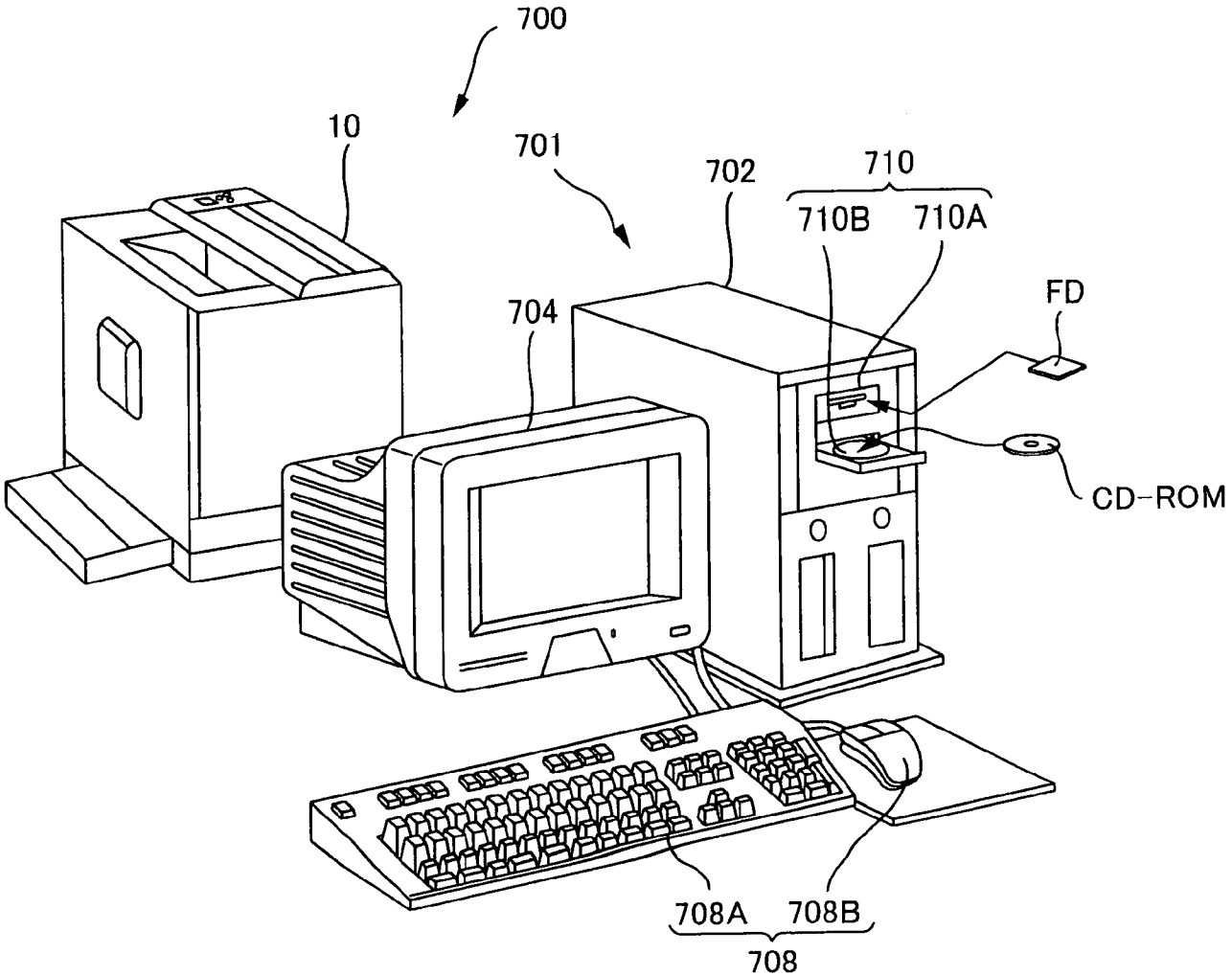
FIG. 42 is an explanatory drawing showing an external structure of an image forming system.

FIG. 42 is an explanatory drawing showing an external structure of an image forming system. The image forming system 1000 comprises a computer 702, a display device 704, a printer 10, an input device 708, and a reading device 710.

In this embodiment, the computer 702 is accommodated in a mini-tower type housing, but this is not a limitation. A CRT (cathode ray tube), a plasma display, or a liquid crystal display device, for example, is generally used as the display device 704, but this is not a limitation. The printer described above is used as the printer 10. In this embodiment, a keyboard 708A and a mouse 708B are used as the input device 708, but this is not a limitation. In this embodiment, a flexible disk drive device 710A and a CD-ROM drive device 710B are used as the reading device 710, but the reading device is not limited to these, and it may also be other devices such as a MO (magneto optical) disk drive device and a DVD (digital versatile disk).

Figure 43:
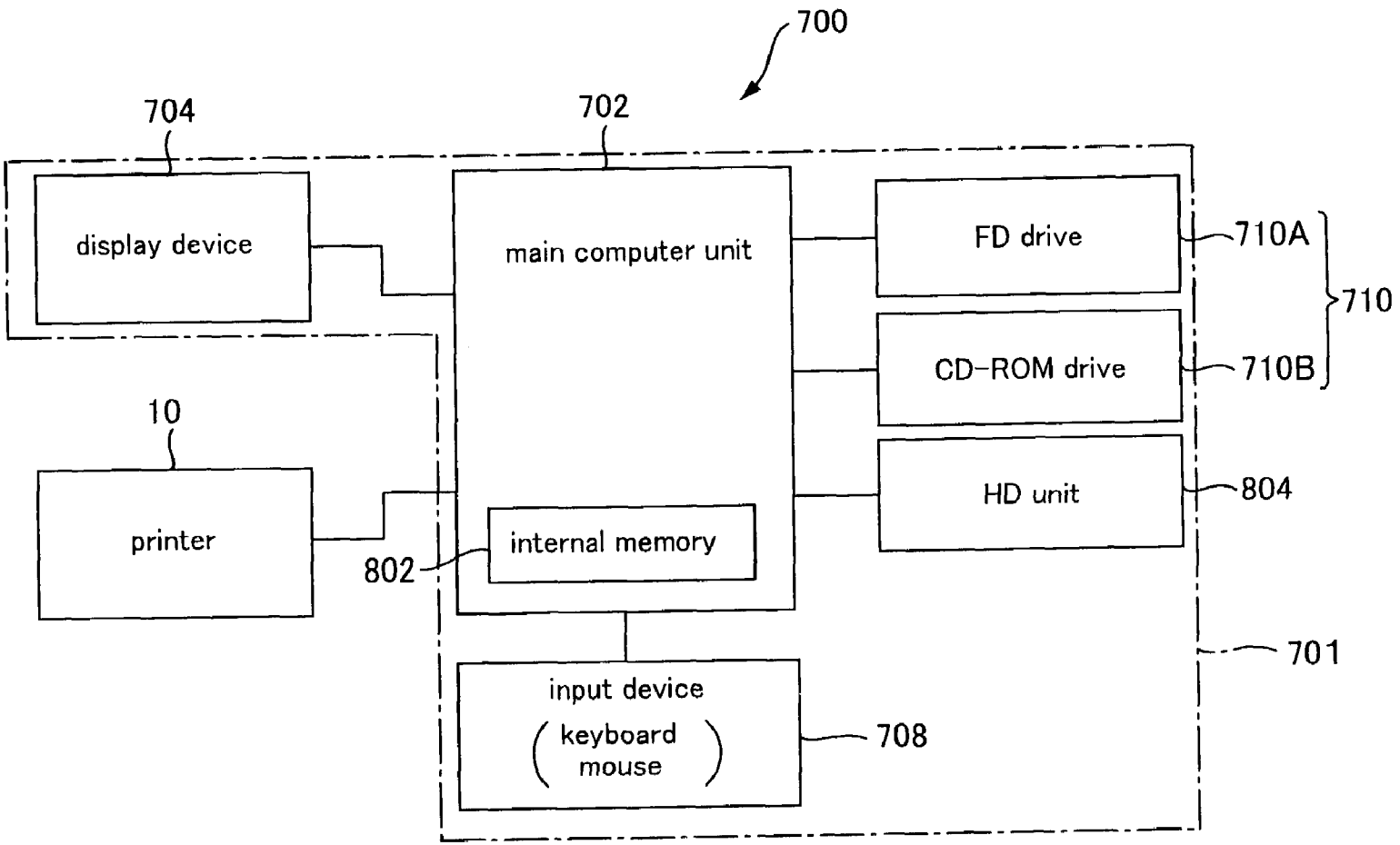
FIG. 43 is a block diagram showing a configuration of the image forming system shown in FIG. 42.

FIG. 43 is a block diagram showing a configuration of the image forming system shown in FIG. 42. Further provided are an internal memory 802, such as a RAM inside the housing accommodating the computer 702, and an external memory such as a hard disk drive unit 804.

It should be noted that in the above description, an example in which the image forming system is structured by connecting the printer 10 to the computer 702, the display device 704, the input device 708, and the reading device 710 was described, but this is not a limitation. For example, the image forming system can be made of the computer 702 and the printer 10, or the image forming system does not have to comprise any one of the display device 704, the input device 708, and the reading device 710.

Further, for example, the printer 10 can have some of the functions or mechanisms of the computer 702, the display device 704, the input device 708, and the reading device 710. As an example, the printer 10 may be configured so as to have an image processing section for carrying out image processing, a displaying section for carrying out various types of displays, and a recording media attach/detach section to and from which recording media storing image data captured by a digital camera or the like are inserted and taken out.

As an overall system, the image forming system that is achieved in this way becomes superior to conventional systems.

What is claimed is:

1. An image forming apparatus comprising:

an image bearing body for bearing a latent image;

a plurality of attach/detach sections to each of which a developer container for containing developer used for developing said latent image can be attached; and a container attachment mechanism for allowing a developer container containing developer of a certain color to be attached to any of said plurality of attach/detach sections, and a developer container containing developer of a color other than said certain color to be attached only to a predetermined attach/detach section of among said plurality of attach/detach sections.

2. An image forming apparatus according to claim 1, wherein:

said container attachment mechanism includes a plurality of openable/closable lid units, each of said lid units being connected to a respective one of said plurality of attach/detach sections and allowing said developer container to be attached to said attach/detach section by being closed; and said lid unit closes when said developer container containing said developer of said certain color is inserted into any of said plurality of attach/detach sections, whereas said lid unit closes only when said developer container containing said developer of the color other than said certain color is inserted into said predetermined attach/detach section of among said plurality of attach/detach sections.

3. An image forming apparatus according to claim 2, wherein:

each of said developer container containing said developer of said certain color and developer containers that each contains developer of a color other than said certain color and different among each developer container, is provided with a projecting section;

said lid units connected to each of said plurality of attach/detach sections has a cut-out section for preventing said projecting section from interfering with that lid unit so that that lid unit will close; and said lid unit closes when said developer container containing said developer of said certain color is inserted into any of said plurality of attach/detach sections due to said cut-out section preventing the interference, whereas said lid unit closes only when said developer container containing said developer of the color other than said certain color is inserted into said predetermined attach/detach section of among said plurality of attach/detach sections due to said cut-out section preventing the interference.

4. An image forming apparatus according to claim 3, wherein:

said plurality of attach/detach sections include attach/detach sections corresponding respectively to said developer containers each containing said developer of the respective colors other than said certain color;

the position of said projecting section provided on each of said developer containers is different among said developer container containing said developer of said certain color and said developer containers each containing said developer of the respective colors other than said certain color;

all of said lid units connected to said plurality of attach/detach sections each has a first cut-out section for preventing said projecting section provided on said developer container containing said developer of said certain color from interfering with that lid unit; and the lid units connected to the attach/detach sections corresponding to said developer containers each containing said developer of the respective colors other than said certain color each has a second cut-out section for preventing said projecting section provided on each of those developer containers from interfering with that lid unit.

5. An image forming apparatus according to claim 4, wherein:

each of said developer containers each containing said developer of the respective colors other than said certain color has a second projecting section at a same position as said projecting section provided on said developer container containing said developer of said certain color.

6. An image forming apparatus according to claim 4, wherein:

each of said lid units has a connecting section that is connected to said attach/detach section, and is openable/closable taking said connecting section as an axis; and a distance between said connecting section and said first cut-out section is larger than a distance between said connecting section and said second cut-out section.

7. An image forming apparatus according to claim 4, wherein:

said lid unit engages with and is fastened to said developer container at a fastening position when closed; and a distance between said fastening position and said first cut-out section is smaller than a distance between said fastening position and said second cut-out section.

8. An image forming apparatus according to claim 1, wherein:

said developer container is a developing device provided with a developer bearing body for bearing the developer used for developing said latent image borne on said image bearing body.

9. An image forming apparatus according to claim 1, wherein:

said developer of said certain color is black developer.

10. An image forming apparatus comprising:

an image bearing body for bearing a latent image;

a plurality of attach/detach sections to each of which a developer container for containing developer used for developing said latent image can be attached; and a container attachment mechanism for allowing a developer container containing developer of a certain color to be attached to any of said plurality of attach/detach sections, and a developer container containing developer of a color other than said certain color to be attached only to a predetermined attach/detach section of among said plurality of attach/detach sections;

wherein said container attachment mechanism includes a plurality of openable/closable lid units, each of said lid units being connected to a respective one of said plurality of attach/detach sections and allowing said developer container to be attached to said attach/detach section by being closed;

said lid unit closes when said developer container containing said developer of said certain color is inserted into any of said plurality of attach/detach sections, whereas said lid unit closes only when said developer container containing said developer of the color other than said certain color is inserted into said predetermined attach/detach section of among said plurality of attach/detach sections;

each of said developer container containing said developer of said certain color and developer containers that each contains developer of a color other than said certain color and different among each developer container, is provided with a projecting section;

said lid units connected to each of said plurality of attach/detach sections has a cut-out section for preventing said projecting section from interfering with that lid unit so that that lid unit will close;

said lid unit closes when said developer container containing said developer of said certain color is inserted into any of said plurality of attach/detach sections due to said cut-out section preventing the interference, whereas said lid unit closes only when said developer container containing said developer of the color other than said certain color is inserted into said predetermined attach/detach section of among said plurality of attach/detach sections due to said cut-out section preventing the interference;

said plurality of attach/detach sections include attach/detach sections corresponding respectively to said developer containers each containing said developer of the respective colors other than said certain color;

the position of said projecting section provided on each of said developer containers is different among said developer container containing said developer of said certain color and said developer containers each containing said developer of the respective colors other than said certain color;

all of said lid units connected to said plurality of attach/detach sections each has a first cut-out section for preventing said projecting section provided on said developer container containing said developer of said certain color from interfering with that lid unit;

the lid units connected to the attach/detach sections corresponding to said developer containers each containing said developer of the respective colors other than said certain color each has a second cut-out section for preventing said projecting section provided on each of those developer containers from interfering with that lid unit;

each of said developer containers each containing said developer of the respective colors other than said certain color has a second projecting section at a same position as said projecting section provided on said developer container containing said developer of said certain color;

each of said lid units has a connecting section that is connected to said attach/detach section, and is openable/closable taking said connecting section as an axis;

a distance between said connecting section and said first cut-out section is larger than a distance between said connecting section and said second cut-out section;

said lid unit engages with and is fastened to said developer container at a fastening position when closed;

a distance between said fastening position and said first cut-out section is smaller than a distance between said fastening position and said second cut-out section;

said developer container is a developing device provided with a developer bearing body for bearing the developer used for developing said latent image borne on said image bearing body; and said developer of said certain color is black developer.

11. An image forming system comprising:

a computer; and an image forming apparatus that is connectable to said computer and that includes:

an image bearing body for bearing a latent image;

a plurality of attach/detach sections to each of which a developer container for containing developer used for developing said latent image can be attached; and a container attachment mechanism for allowing a developer container containing developer of a certain color to be attached to any of said plurality of attach/detach sections, and a developer container containing developer of a color other than said certain color to be attached only to a predetermined attach/detach section of among said plurality of attach/detach sections.

* * * * *